US012291946B1

(12) United States Patent
Parks et al.

(10) Patent No.: US 12,291,946 B1
(45) Date of Patent: May 6, 2025

(54) DOWNHOLE PERFORATING GUN SYSTEM AND METHODS OF MANUFACTURE, ASSEMBLY AND USE

(71) Applicant: SWM International, LLC, Pampa, TX (US)

(72) Inventors: David C. Parks, Calgary (CA); Dan Salkhai Ang, Keller, TX (US)

(73) Assignee: SWM International, LLC, Pampa, TX (US)

( * ) Notice: Subject to any disclaimer, the term of this patent is extended or adjusted under 35 U.S.C. 154(b) by 0 days.

(21) Appl. No.: 18/407,109

(22) Filed: Jan. 8, 2024

Related U.S. Application Data

(63) Continuation of application No. 17/831,900, filed on Jun. 3, 2022, now Pat. No. 11,867,032.

(60) Provisional application No. 63/196,922, filed on Jun. 4, 2021.

(51) Int. Cl.
*E21B 43/1185* (2006.01)

(52) U.S. Cl.
CPC ..... *E21B 43/1185* (2013.01)

(58) Field of Classification Search
CPC .... E21B 43/1185; E21B 43/116; E21B 47/12; F42C 19/06; F42D 1/04; F42D 1/042
See application file for complete search history.

(56) References Cited

U.S. PATENT DOCUMENTS 4,637,478 A 1/1987 George
7,762,331 B2 7/2010 Goodman et al.
7,934,558 B2 5/2011 Hales et al.
8,181,718 B2 5/2012 Burleson et al.
9,464,508 B2 10/2016 Lerche et al.
9,605,937 B2 3/2017 Eitschberger et al.
9,677,363 B2 6/2017 Schacherer et al.
9,896,920 B2 2/2018 Holder
10,598,002 B2 3/2020 Sites
10,844,697 B2 11/2020 Parks et al.
(Continued)

FOREIGN PATENT DOCUMENTS

WO 2015173592 A1 11/2015

OTHER PUBLICATIONS

Dynaenergitcs; DynaEnergetics Brochure; 2021 DMC Global Inc.
(Continued)

*Primary Examiner* — Daniel P Stephenson
(74) *Attorney, Agent, or Firm* — Cabello Hall Zinda, PLLC

(57) ABSTRACT

A downhole perforating gun system provides wireless electrical communication between an inner body conductor, a switch, a detonator, and a feedthrough. Ends on gun carriers of the system couple together end-to-end at end connections. Internal tapered thread is defined in an interior of each carrier's first end, and external tapered thread is defined externally on each carrier's second end. The internal tapered thread of one carrier can thread to the external tapered thread of another carrier. A metal-to-metal contact and/or an annular seal can seal the carriers' interiors from an external environment, and bulkheads can seal between the carrier's interiors at the end connections. Each bulkhead can have a feedthrough conductor to electrically conduct across the end connections. A bulkhead flange can be captured between a distal face and an internal shoulder at the end connection, and a switch can be disposed on the bulkhead.

29 Claims, 40 Drawing Sheets

(56) References Cited

U.S. PATENT DOCUMENTS

| | | | |
|---|---|---|---|
| 11,078,762 | B2 | 8/2021 | Mauldin et al. |
| 11,091,987 | B1 | 8/2021 | Benker et al. |
| 11,168,546 | B2 | 11/2021 | Melhus et al. |
| 11,255,650 | B2 | 2/2022 | Sullivan et al. |
| 11,414,965 | B2 | 8/2022 | Zhao et al. |
| 11,674,371 | B1 | 6/2023 | Bradley et al. |
| 11,867,032 | B1 * | 1/2024 | Parks ..... E21B 43/1185 |
| 2009/0050322 | A1 | 2/2009 | Hill et al. |
| 2016/0273902 | A1 | 9/2016 | Eitschberger |
| 2017/0009559 | A1 | 1/2017 | Spring et al. |
| 2018/0299239 | A1 | 10/2018 | Eitschberger et al. |
| 2019/0195054 | A1 | 6/2019 | Bradley et al. |
| 2019/0212118 | A1 | 7/2019 | Saltarelli et al. |
| 2020/0256168 | A1 | 8/2020 | Knight et al. |
| 2021/0230986 | A1 | 7/2021 | Macgillivray |
| 2022/0010660 | A1 | 1/2022 | Dyess et al. |
| 2022/0056789 | A1 | 2/2022 | LaGrange et al. |

OTHER PUBLICATIONS

Geodynamics; GEODynamics Brochure; VaporGun 2 3/4; Palenls:www.perf.com/patenls; 2020 GEODynamics.

Final Written Decision for IPR2022-01372 dated Feb. 5, 2024, 65-pgs.

* cited by examiner

DOWNHOLE PERFORATING GUN SYSTEM AND METHODS OF MANUFACTURE, ASSEMBLY AND USE

REFERENCE TO RELATED APPLICATIONS

This application is a continuation of U.S. Non-provisional application Ser. No. 17/831,900 filed Jun. 3, 2022, which claims priority to U.S. Provisional Application No. 63/196,922 filed Jun. 4, 2021, the entire contents of which are incorporated herein by reference in their entireties.

TECHNICAL FIELD

The present disclosure relates generally to downhole perforating gun systems, and more particularly to perforating gun system manufacture, assembly, and methods of operation thereof.

BACKGROUND

In a conventional oil and gas well, the wellbore is cased and cemented to isolate the wellbore from the surrounding formations. However, the surrounding formations are what contain the reservoirs containing oil and gas. Therefore, it is necessary to penetrate the casing and cement at the depth of the producing reservoir to provide a flow path for the oil and gas. This is done through perforating.

A perforating gun is a device used to perforate the casing and cement in a wellbore. The perforating gun contains several shaped explosive charges. A conventional perforating gun includes an outer gun carrier containing charges which can shoot radially outward when detonated. Typically, multiple perforating guns are connected together to form a string. The perforating string is conveyed downhole with a wireline or tubing string.

Because the perforating guns are explosive, it is important to isolate the guns in a string from each other. This requires the gun string to maintain electrical connectivity with the surface even after some of the guns are detonated. Previously, the guns have been electrically connected with a plurality of wires. This is time consuming for those installing the gun string and results in a failure point for the guns.

Therefore, what is needed is a perforating gun system that addresses one or more of the foregoing issues.

SUMMARY

A downhole perforating gun system comprises a first cylindrical gun carrier comprising a first end, a second end, and a central axis extending axially therethrough, an inner body conductor disposed within the carrier, a charge holder disposed within the carrier, a charge positioned within the charge holder, a bulkhead disposed proximate the first end of the gun carrier and comprising a central throughbore, a sealing element disposed within a groove formed on an outer surface of the bulkhead, a feedthrough disposed within the throughbore of the bulkhead, a detonator comprising a first wireless conductive contact, and a switch disposed within the carrier at an axial position between the bulkhead and the second end of the carrier and comprising a second wireless conductive contact in electrical communication with the inner body conductor, a third wireless conductive contact in electrical communication with the feedthrough, and a fourth wireless conductive contact in electrical communication with the first wireless conductive contact of the detonator.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Figure 1:
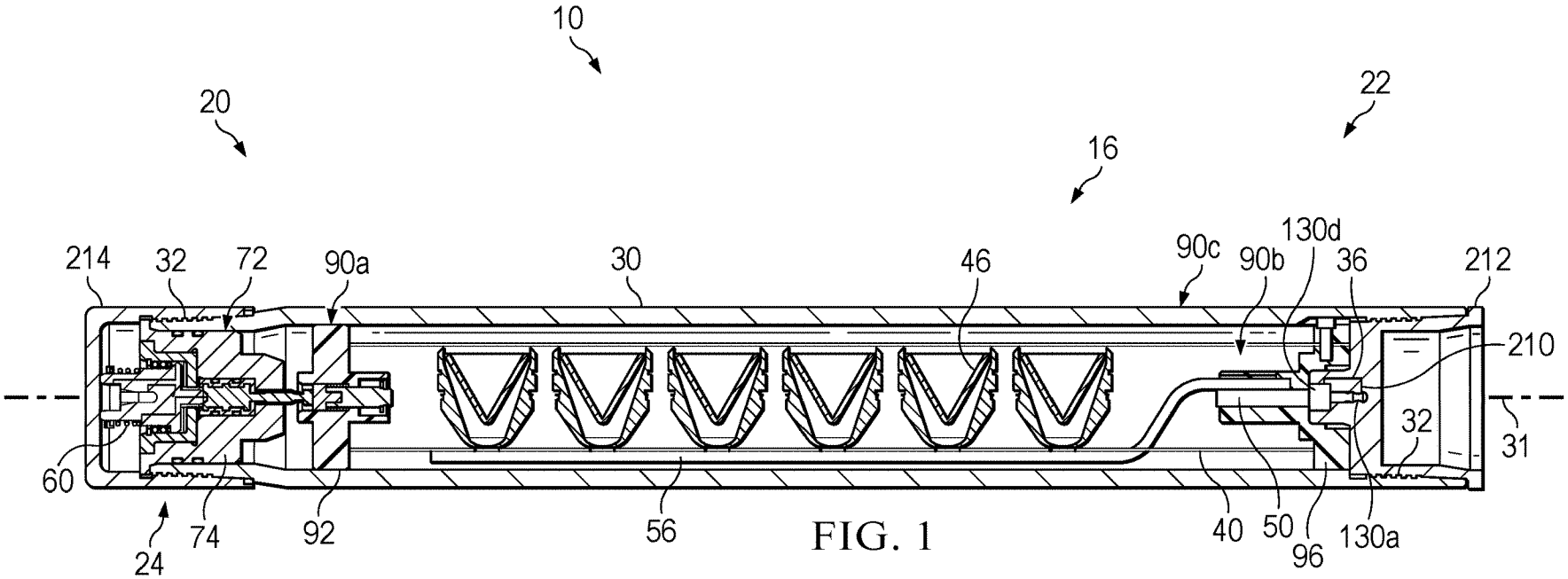
FIG. 1 is a cross-sectional side view of a perforating gun string, in accordance with embodiments of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar components, features and elements are referenced with like or identical reference numerals or are apparent from the figures and/or the description herein. When reference numbers are followed by a lower case letter (e.g., 110*a*, 110*b*), they are each the same type of component (e.g., 110) but have a different location or use. The figures are not necessarily to scale and certain features and certain views of the figures may be shown exaggerated in scale or in schematic in the interest of clarity and conciseness.

As used herein and throughout various portions (and headings) of this patent, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. It should also be noted that the use of "(s)" in reference to an item, component or action (e.g., "surface(s)") throughout this patent should be construed to mean "at least one" of the referenced item, component or act.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ". Further, reference herein and in the appended claims to components and aspects in a singular tense does not necessarily limit the present disclosure or appended claims to only one such component or aspect, but should be interpreted generally to mean one or more, as may be suitable and desirable in each particular instance.

As used herein and in the appended claims, the following terms have the following meanings, except and only to the extent as may be expressly specified differently in a particular claim hereof and only for such claim(s) and any claim(s) depending therefrom:

The term "and/or" as used herein provides for three distinct possibilities: one, the other or both. All three possibilities do not need to be available-only any one of the three. For example, if a component is described as "having a collar and or a coupling", some embodiments may include a collar, some embodiments may include a coupling and some embodiments may include both. Since the use of "and/or" herein does not require all three possibilities, a claim limitation herein that recites "having a collar and or a coupling" would be literally infringed by a device including only one or more collars, one or more couplings or both one or more couplings and one or more collars.

The terms "conductor" and variations thereof mean and include anything that could be in the conductor or semiconductor class of materials but not in the insulator class of material.

The terms "conducting", "conductive" and variations thereof mean and refer to being able to conduct electric current.

The terms "conductive contact" and variations thereof mean and include at least one plate, button, tab, pin, ring, sleeve, patch, strip, band, length or track of sufficiently conductive material (e.g., comprising or coated with copper, aluminium, tin, brass, silver, etc.) affixed to, formed, embedded, molded or fit into, carried by or otherwise associated with the referenced component for transmitting electric current to or from the component.

The terms "conductive interface" and variations thereof mean and include one or more points or areas of electrical contact, or connection, formed between two or more adjacent conductive components. Thus, the conductive interfaces 26 are not in and of themselves distinct components.

The terms "conductive trace" and variations thereof mean and include at least one line, strip, band, length or track of sufficiently conductive material affixed to, formed, molded, embedded or fit into, carried by or otherwise associated with one or more referenced components for transmitting electric current in a desired path. The conductive trace could include, for example, uninsulated wire core that is molded, formed or fit into the component(s).

The terms "coupled", "connected", "engaged" and the like, and variations thereof mean and include either an indirect or direct connection or engagement. Thus, if a first device couples to a second device, that connection may be through a direct connection, or through an indirect connection via other devices and connections.

The terms "elongated" and variations thereof as used herein mean and refer to an item having an overall length (during the intended use of the item) that is greater than its average width.

The terms "generally", "substantially" and variations thereof as used herein mean and include greater than 50%.

The terms "modular" and variations thereof mean and refer to including one or more components provided in distinct systems, or modules, that can be independently created and simply and quickly interconnected.

[The terms "operator", "assembler" and variations thereof as used herein mean and include one or more humans, robots or robotic components, artificial intelligence-driven components/circuitry, other components and the like.

Any component identified as a "plate" herein includes, but is not limited to, a plate as that term is commonly understood (e.g., a thin, flat sheet or strip of metal or other material), and may have non-planar surfaces or construction, may not be thin per se, may have any other form suitable for use in the particular configuration in which it is used (e.g., may be a curved or curvilinear-shaped member, housing, cone, sleeve, flange, collar, etc.) may be comprised of multiple parts or a combination thereof.

The terms "rigidly coupled" and variations thereof mean connected together in a manner that is intended not to allow any, or more than an insubstantial or minimal amount of, relative movement therebetween during typical or expected operations. In other words, if components A and B are rigidly coupled together, they are not movable relative to one another (more than a minimal or insubstantial amount) during typical or expected operations.

The terms "spring" and variations thereof mean and refer to one or more resilient members (e.g., compression or torsion springs, helical springs, radial wave springs, radial springs, coil springs, Bellville-washers, bow springs, banana springs, leaf springs, disc springs) and/or or non-resilient members (e.g., sleeve, ring, pin, coupling, piston, a conductive ring biased with a banana or bow spring) capable of being biased against, and/or providing biasing forces upon, one or more other members or components. Accordingly, the "spring" may be a spring (in its literal sense) or any other component or combination of components configured to be biased by, or able to spring-bias, one or more other members or components. Moreover, when a component is described herein as "biased" or "spring-biased", the component is arranged to be forced or pressed in one or more directions by one or more springs, and/or other mechanisms or forces (e.g., gas, liquid, power-driven, electronically driven), and in at least some cases can be moved back (in the opposite general direction) upon the application of force(s) to the component sufficient to overcome the pressing forces thereupon. Thus, biasing or spring biasing does not require the use of one or more actual springs to provide the biasing force(s), any desired or suitable mechanism or arrangement of parts may be used, except and only to the extent as may be expressly recited and explicitly required in a particular claim hereof and only for such claim(s) and any claim(s) depending therefrom.

The terms "through-connector" and variations thereof mean and include at least one wire-free conductive trace affixed to, formed, embedded, molded or fit into, carried by or otherwise associated with the charge holder 40 or other component for transmitting electric current in a desired path. The through-connector could, for example, include uninsulated wire-core that is molded, formed or fit into or attached to the charge holder 40 or other component(s).

The terms "wire", "electrical wire" and variations thereof mean and include one or more strands or rods of conductive material (e.g., metal) that has its own self-insulation. For example, wire often has a conductive core with plastic and/or rubber extruded at least partially thereover. Thus, "wire" as used therein, refers to at least partially self-insulated wire. Also, for this patent, "wire" is not limited in any way by the nature, form or details of composition, type or format of its conductive core (e.g., single or multistrand, flexible or solid, braided or not braided) or insulation (e.g., plastic, rubber, other) or format (e.g., cable or wire formats).

Figure 2:
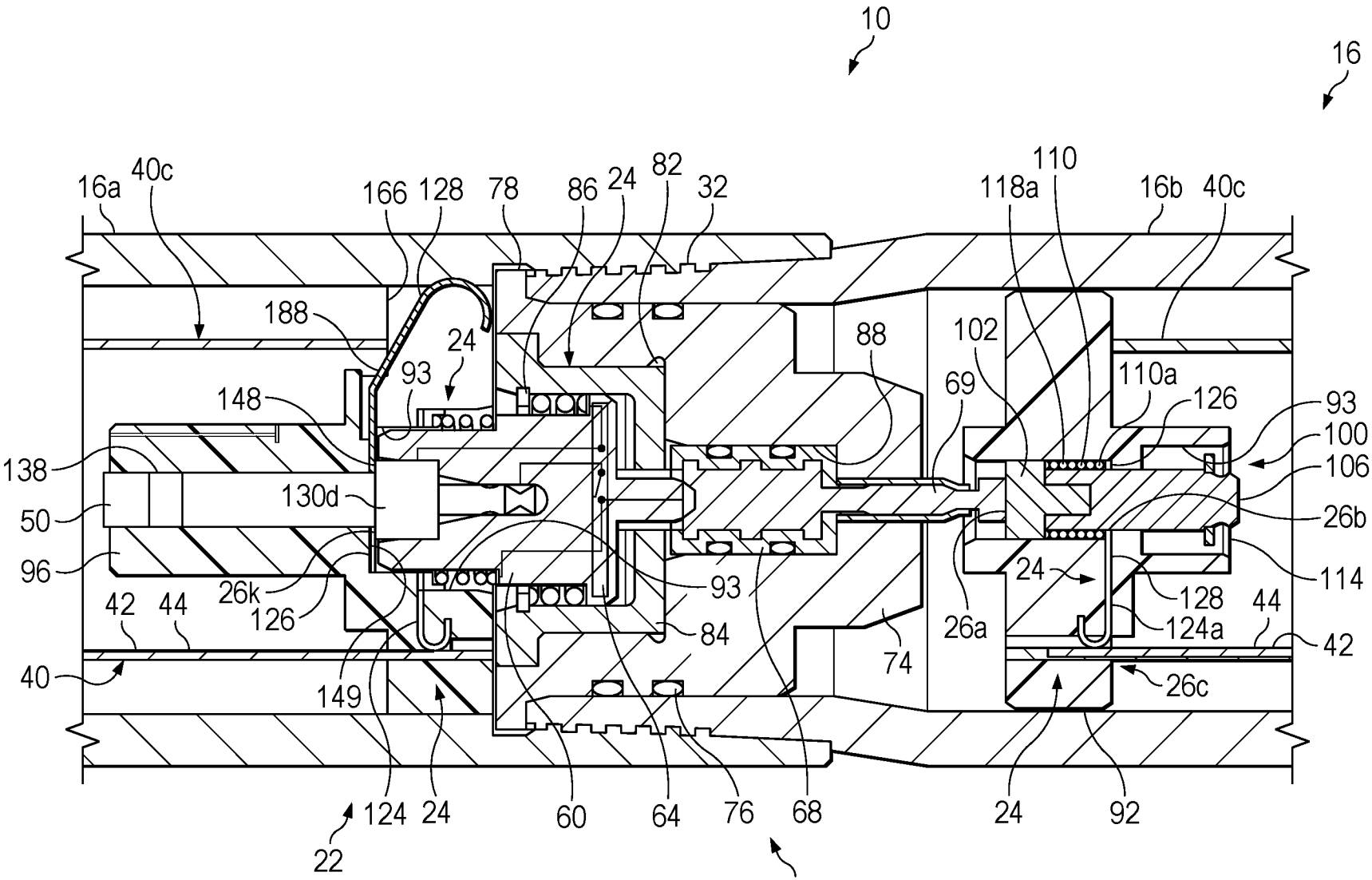
FIG. 2 is a cross-sectional side view of the connection of two perforating guns, in accordance with embodiments of the present disclosure.

Referring initially to FIGS. 1 & 2, an exemplary perforating gun string, or system, 10 may include one or more perforating guns 16. In this embodiment, a first gun 16*a* is shown uphole of an interconnected second gun 16*b*. When more than one gun 16 is included, the guns 16 are typically included in a string, or line, of components for deployment to the desired position in the underground borehole. Traditionally, an intermediate (a.k.a. tandem or reusable) sub (not shown) is used to connect adjacent guns 16.

Each exemplary gun 16 has an upper, or uphole, end 20 and a lower, or downhole, end 22. In the illustrated system 10, each gun 16 includes, among other things, (i) an outer body, or carrier, 30 having a central axis 31 extending axially therethrough, (ii) an inner body, or charge holder, 40 configured to carry one or more explosives (e.g., shaped-charges) 46 and (iii) one or more detonators 50 for igniting the explosives 46 as desired, such as through one or more detonation cords 56. The detonator 50 of each gun 16 is actuated by a dedicated controller (a.k.a. the switch or switch assembly) 60, which may include one or more printed circuit boards (PCB) 64 configured to provide electrical signals to the detonator 50 to set off the explosives 46.

Electric current sufficient to ultimately ignite the explosives 46 is normally provided downhole to the gun system 10 from the surface, such as via a wireline, and then through each gun 16 to its associated switch(es) 60 and detonator(s) 50 and to the next successive downhole gun 16 (or other tool or component), if any, via multiple conductive electrical components 24 in the gun system 10 at various conductive interfaces 26 formed therebetween. For example, electric current is typically provided to each switch 60 via one or more inner body conductor 42 associated with the charge holder 40 that is immediately uphole of the switch 60 and which often comprises multiple insulated electrical wires (not shown) wrapped around the (typically metal, cylindrical) charge holder. Electric current is then typically provided to the next successive downhole gun 16 via a feedthrough 68.

However, the exemplary perforating gun system 10 may have more, less or other components than those described above and, when included, any of the above components may have any suitable form. Thus, the present disclosure is not limited to any of the above details.

Referring still to FIGS. 1 & 2, in accordance with various distinct independent aspects of the present disclosure, one or more of the electrical components 24 in each gun 16, the conductive interfaces 26 formed therebetween and the electric current flow paths formed thereby may be non-wired. In some embodiments (such as those described and shown herein), the entire gun 16 may be wire-free. This may, for example, eliminate the need for connecting or soldering wires and the jumbled birds-nest of wires typically needed in many conventional perforating guns and the potential reliability, poor connection and other problems associated therewith, reduce the time, effort and other concerns in manufacturing, assembling and using such conventional gun systems, for any other purposes or a combination thereof.

For example, one or more pairs of non-wired electrical components 24 may abut one another to form the desired conductive interfaces 26, have non-wired, (e.g., audio) plug-jack or ball-socket, type electrical connections or any other suitable arrangement of parts to create one or more non-wired interfaces 26. In some embodiments, a ball-socket type electro-mechanical can be preferred, for example, to allow one or both interconnected components to rotate relative the other and tolerate or accommodate some misalignment or tilt. Accordingly, any suitable configuration, combination and type of electrical components 24 can be used to achieve the desired wire-free arrangement. Moreover, the present disclosure is not limited to the particular components and methods described herein and shown in the appended figures for providing a wire-free gun 16 or a gun having one or more wire-free electrical components 24, conductive interfaces 26 and/or electric current flow paths.

Still referring to FIGS. 1 & 2, in accordance with various distinct independent aspects of the present disclosure, if desired, one or more components of the gun system 10 may be provided, or assembled, in distinct modules to provide a modular system 10. For example, the illustrated gun system 10 includes multiple easily and quickly interconnectable wire-free distinct modules, including, without limitation, the switch assembly 60, a bulkhead assembly 72, uphole and downhole end fitting assemblies 90*a*, 90*b* and a charge holder assembly 90*c*. The modular gun system 10 can allow quick and easy assembly and arming of each gun 16 and quick and easy disassembly and replacement of any of the modules (e.g., upon component failure). If desired, the gun 16 may be designed not to require any tools to assemble each gun 16 or interconnect multiple guns 16 together.

In the present embodiments, the detonator 50 and switch 60 are not provided in the same module of the gun system 10 and need not be interconnected until the gun 16 is ready for use at the work site. If desired, the gun 16 may be configured so that the exemplary switch 60 and other electrical components 24 may be tested without the presence of the detonator 50, allowing these components to be inspected, tested and replaced independent of one another. Further, the detonator 50 and switch 60 may be sourced from different suppliers, providing greater equipment acquisition and management flexibility. In some embodiments, separating of the detonator 50 and switch 60 from the same module can allow the switch 60 to be designed with a shorter length and greater width than conventional guns 16, saving room in the length of the gun 16 and improving related efficiencies (reducing cost and storage, transportation, manpower and related needs, allowing more axial space in the gun for additional explosives 46 and/or other components and in the borehole for additional guns 16 and/or other components).

Referring to FIG. 2, in accordance with other independent aspects of the present disclosure, in some embodiments, adjacent guns 16 may be directly releasably interconnected together without the use of any intermediate subs therebetween. This may be done to reduce complexity in the manufacturing, supplier sourcing, shipping, handling and assembly of perforating gun systems, reduce on-site assembly and disassembly time, manpower needs, assembly equipment, points of failure and safety concerns, increase space in the component string, for any other reasons or a combination thereof. Thus, the present disclosure is not limited by the particular reason(s) for directly interconnecting adjacent guns 16 together.

Any suitable techniques and components may be used to directly interconnect adjacent guns 16 together without the use of intermediate subs therebetween. For example, the lower end 22 of the uphole gun 16*a* and the upper end of the next successive gun 16*b* may be formed with mateable respective tapered threads 32. The tapered threads may meet API, OCTG, NPT or BSPT pipe thread standards or take any other suitable form. The general use of tapered threads is discussed in publicly available documents, such as https://www.industrialspec.com/about-us/blog/detail/tapered-pipe-threads-standards-intro, the entire contents of which are hereby incorporated by reference herein in its entirety; however, the present disclosure is in no way limited by or to the contents of this reference.

Still referring to FIG. 2, in this embodiment, the carrier 30 at the lower end 22 of the uphole gun 16*a*, or "box end" of the gun, is formed with female tapered threads 32 around its ID, while the carrier 30 at the upper end of the downhole gun 16*b*, or "pin end" of the gun, is formed with male tapered threads 32 around its OD. The respective guns 16*a*, 16*b* are thus threadably engageable. Such arrangement is sometimes referred to herein as a "tapered pin-by-box connection" or variations thereof. Various electrical components 24 of the exemplary gun 16 may be configured (e.g., as described below and shown in the appended figures) to be electrically connected upon the threaded connection of adjacent guns 16*a*, 16*b* and without any further actions (e.g., without connecting any wires).

In some instances, the tapered pin-by-box connection may provide sufficient sealing (e.g., pressure and liquid seals) between the interconnected carriers 30 by the metal-to-metal contact therebetween, eliminating the need for any separate seal members (e.g., O-ring seals) across the threads 32. Thus, if desired, the tapered pin-by-box connection may be used without any separate seal members at or across the connection of the adjacent carriers 30.

A tapered pin-by-box connection may be provided for any suitable reason. For example, this arrangement may provide improved bending strength, tolerance and performance as compared to straight-thread connections. The tapered threads may be stronger in tension, bending and torsion than straight-thread connections because a tapered thread arrangement is thicker where the stress risers of those forces would be and tapers to thinner (e.g., it is thicker where thickness matters, and thinner where it does not matter). The concentric grooves in the connection may provide tensile strength that results in a connection stronger than the individual carriers 30 and with a dual metal-to-metal seal. For another example, the tapered pin-by-box connection may allow the adjacent guns 16 to be interconnected quicker (e.g., with less rotations) than with straight-thread connections. For yet another example, the absence of separate seal members across or at the tapered pin-by-box connection eliminates additional points of failure of such seals.

Still referring to FIG. 2, in accordance with other distinct independent aspects of the present disclosure, in some embodiments, various components of the gun system 10 may be carried by or provided in one or more bulkheads 74 configured to be inserted into one end 20 or 22 of each gun 16. The bulkheads 74 may be useful, for example, when intermediate subs are not employed between adjacent guns 16, optimize the use of space in each gun 16, for any other reason or a combination thereof.

When included, the bulkhead 74 may have any suitable form, configuration, components and operation. In the present embodiments, the bulkhead 74 is formed in a generally cylindrical, or barrel-like, shape (e.g., FIG. 21) and which can be pushed into, threaded or otherwise and secured in the upper end 20 of each illustrated gun 16. For example, the bulkhead 74 may be removably, friction-fit into and sealing engaged with the corresponding carrier 30 with the use of one or more seals 76 (e.g., O-rings) disposed between the bulkhead 74 and ID of the carrier 30. However, in other embodiments, the bulkhead 74 may not be cylindrical or barrel-shaped and may be secured to the carrier 30 or other component in any other suitable manner (e.g., threadable engagement).

Still referring to FIG. 2, the exemplary bulkhead 74 may include multiple interconnected cavities for at least partially housing various other components of the associated gun(s) 16. Any desired configuration of cavities may be included. For example, a switch cavity 82 formed in the uphole end of the bulkhead 74 may at least partially house the switch 60 that actuates the detonator 50 located in the immediately preceding uphole gun 16*a*. A feedthrough cavity 88 in communication with the switch cavity 82 may be formed in the downhole end of the exemplary bulkhead 74 to at least partially house the feedthrough 68. However, the switch 60 and/or feedthrough 68 may be housed in any other desired components. For example, the switch 60 may be housed at least partially in the downhole fitting 96.

If desired, one or more retainers 84 may be associated with the bulkhead 74 to secure one or more other components thereto. The retainer 84 may have any suitable form, construction, configuration, location and operation. In the embodiment of FIG. 2, the cup-shaped retainer 84 is releasably engaged in the switch cavity 82 from the uphole end of the bulkhead 74 (e.g., via mating threads, snap-fit, friction-fit, etc.) and configured to at least partially carry the switch 60 therein and secure it to the bulkhead 74. For example, one or more retainer rings 86 (or other components) may be used to releasably secure the switch to the retainer 84. The illustrated retainer 84 is constructed at least partially of conductive material (e.g., low-alloy steel), such as to form part of the grounding path of the switch 60 and/or detonator 50, for any other purpose or a combination thereof. In other embodiments, the retainer 84 may be constructed of non-conductive material.

In other embodiments, (e.g., FIGS. 20 & 21), instead of positioning the retainer 84 radially outwards of the switch 60 in the switch cavity 82 (e.g., FIG. 22) to secure the switch 60 to the bulkhead 74, the retainer 84, when included, may be located elsewhere to free-up the annual space around the switch 60, allow the use of a wider/thinner switch 60 or for any other suitable purpose. In such instances, a different feature may be provided to secure the switch 60 to the bulkhead 74, such as one or more retainer rings 86 (or other components). In this embodiment, the retainer 84 is generally cylindrically shaped and releasably coupled to the bulkhead 74 (e.g., via mating threads, snap-fit, friction-fit, etc.) at or proximate to its downhole end and configured to secure the feedthrough 68 in the feedthrough cavity 88. However, the retainer 84 may be non-cylindrical, may not secure the feedthrough 68 in the cavity 88 and may be coupled to the bulkhead 74 or other component in any other manner or be integral thereto.

In at least some embodiments, the exemplary bulkhead 74 may include a shoulder 78 configured to be captured between adjacent interconnected carriers 30 in the assembled gun system 10. The shoulder 78 may be included for any suitable purpose(s). For example, the shoulder 78 may assist in maintaining the desired position of the bulkhead 74 in relation to the carriers 30 during use of the gun system 10. For another example, the shoulder 78 may receive and absorb some of the kick forces upon ignition of the explosives 46 in the gun 16*b*.

The bulkhead 74 may be constructed at least partially of electrically conductive material to serve as part of the grounding circuit for one or more other components of the gun system 10, for any other purpose or a combination thereof. In this illustrated embodiments, the bulkhead 74 is constructed of metal and is useful for grounding the associated switch 60 and detonator 50 (e.g., to the carrier 30).

Figure 3:
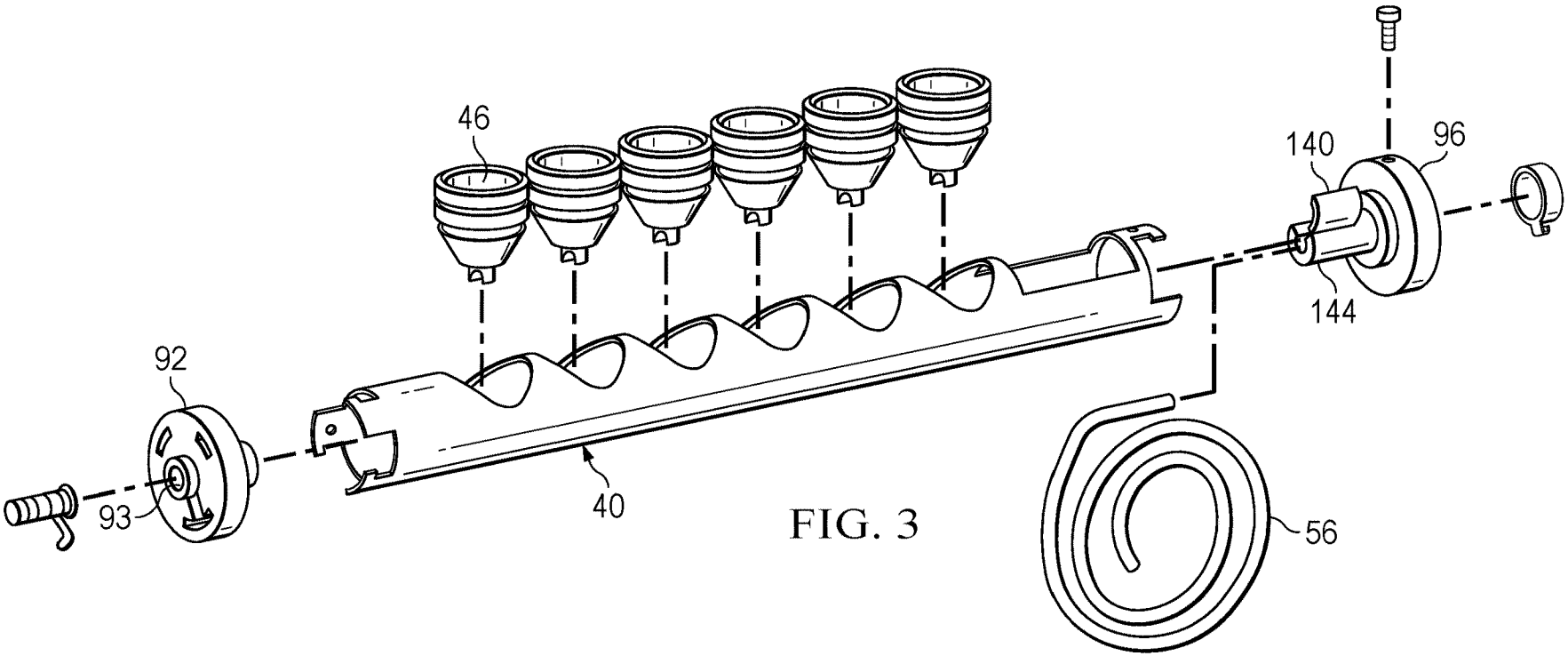
FIG. 3 is an exploded view of a perforating gun string, in accordance with embodiments of the present disclosure.

Referring now to FIGS. 1-3, in accordance with other distinct independent aspects of the present disclosure, the charge holder 40 may be secured in the gun 16 in any suitable manner. For example, the charge holder 40 may be releasably, mechanically engaged with and carried by one or more uphole end fittings 92 at or proximate to its upper end, and one or more downhole end fittings 96 at or proximate to its lower end.

Figure 17:
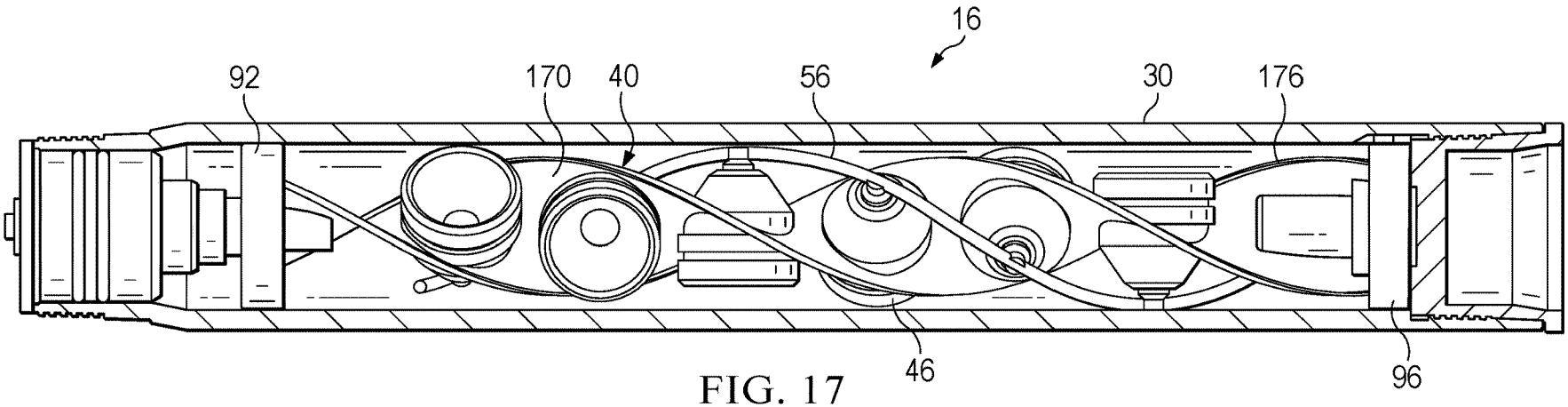
FIG. 17 is a cross-sectional view of a perforating gun with a curved charged holder, in accordance with embodiments of the present disclosure.

The end fittings 92, 96, when included, may have any suitable form configuration, construction and operation. In the present embodiments, each end fitting 92, 96 each has a generally cylindrical shape, includes at least one (e.g., circular) central bore 93 extending axially therethrough, at least partially houses one or more other components of the gun 16 and is configured to be slid into the carrier 30 during assembly (e.g., FIGS. 10 & 17). For example, the end fitting 92, 96 may centralize the charge holder(s) 40 in the carrier 30 and hold one or more electrical components 24. The exemplary end fittings 92, 96 are constructed of plastic but could be constructed of any other suitable materials(s). However, in other embodiment, the end fittings 92, 96 may have one or more different or additional purposes and any other configuration. For example, either or both end fittings 92, 96 may be non-cylindrical (e.g., include fins), be part of, or integrated with, the charge holder 40 (e.g., as a single component that includes end fittings 92, 96 and charge holder 40). It should also be noted that, in some embodiments, the uphole end fitting 92 and components associated there with may be used at the downhole end 22 of the gun 16 and the downhole end fitting 96 and associated components may be at the uphole end 20 of the gun 16. For example, the illustrated embodiments of gun 16 could be flipped 180°.

Referring again to FIG. 2, the exemplary uphole end fitting 92 may at least partially house any suitable gun components that help facilitate the communication of electric current from the immediately preceding uphole gun 16*a*

(e.g., through the feedthrough 68) down to the gun 16*b*. For example, the central bore 93 of the uphole end fitting 92 may at least partially house a plunger 100 that electrically contacts one or more feedthrough conductors 69 extending from the illustrated feedthrough 68 (or conductive contacts (not shown) provided in, or on the feedthrough 68).

When included, the plunger 100 may have any suitable form, configuration, components, construction and operation. In the present embodiments, the plunger 100 includes a conductive contact button 102 rigidly (and selectively releasably) carried by a nonconductive insulator 106. The exemplary contact button 102 and insulator 106 may have any suitable form, configuration, construction and operation. For some non-limiting examples, the contact button 102 may be metallic, at least partially coated with conductive material, include one or more conductive contacts (not shown), and the insulator 106 is elongated and plastic. However, in other embodiments, the insulator 106 may take any other form (non-elongated) or not included and any other component(s) may help insulate the contact button 102 (if desired). For example, the contact button 102 could be self-insulated or insulated by a different component (e.g., the end fitting 92).

In the present embodiments, the contact button 102 and insulator sleeve 106 are capable of concurrently sliding back and forth in the central bore 93 of the uphole end fitting 92 and configured to be spring-biased in the uphole direction to force the contact button 102 into electrical contact with the feedthrough conductor 69 at a first conductive interface 26*a* and allow the transmission of electric current therebetween. Any suitable components may be used to bias the contact button 102 into sufficient contact with the feedthrough conductor 69. For example, a spring 110 may bias the contact button 102 (and insulator sleeve 106) as desired. In the present embodiments, the spring 110 is a helical, or coil, spring but may take any other form (e.g., radial wave spring, biased sleeve). However, in other embodiment, only the contact button 102 slides back and forth without the insulator sleeve 106.

Still referring to FIG. 2, if necessary, the plunger 100 may include one or more retention clips 114 or other components configured to prevent the contact button 102 and insulator sleeve 106 from falling or popping out the uphole end of the central bore 93, at least during assembly of the gun 16. Electric current may be communicated from the exemplary contact button 102 (or other component) to the inner body conductor 42 of the gun 16*b* in any suitable manner. For example, the spring 110 (a.k.a. the first contact spring 110*a*) may be constructed at least partially of conductive material and serve as an intermediate conductor 118 (a.k.a. the first intermediate conductor 118*a*) to communicate electric current from the contact button 102 to the inner body conductor 42.

In the present embodiments, the spring 110 is axially-oriented in the gun 16 (e.g., inside the central bore 93 of the end fitting 92) and radially inwards of the inner body conductor 42. The exemplary spring 110 electrically contacts the contact button 102 and an intermediate electrical connector 124 (a.k.a. the first intermediate electrical connector 124*a*), which electrically contacts the inner body conductor 42. For example, the spring 110 may be biased between the contact button 102 and connector 124*a*. However, in other embodiments, the spring 110 could be oriented differently, directly electrically contact the inner body conductor 42 or have any other configuration. Also, different or additional electrical components 24 (e.g., one or more spring retainers) could be included at any desired location(s) in the electric flow path between the feedthrough 68 and inner body conductor 42. Moreover, the first intermediate conductor 118*a* could have any other form, configuration and operation.

Figure 18:
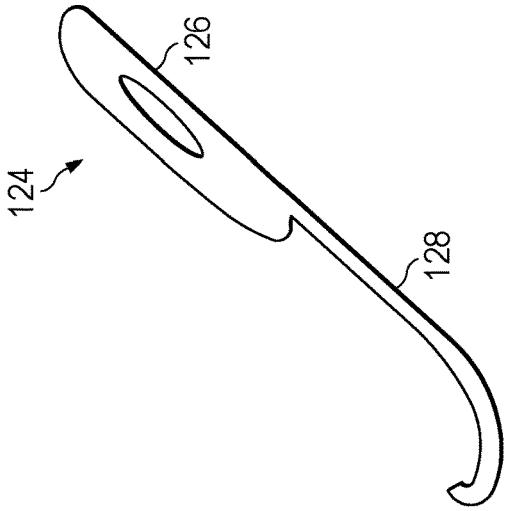
FIG. 18 illustrates a spring-biasable arm, in accordance with embodiments of the present disclosure.

Referring again to FIG. 2, when included, the intermediate electrical connector 124 may have any suitable form, configuration, location and operation. In this example, the intermediate electrical connector 124 is electrically conductive, carried in the end fitting 92 and extends between the spring 110 and the inner body conductor 42 at respective second and third conductive interfaces 26*b*, 26*c*. The illustrated intermediate electrical connector 124 (e.g., ring terminal) includes a base, or ring, 126 (e.g., FIG. 18) configured to extend around the insulator sleeve 106 (or other component) and electrically contact the spring 110. At least one arm spring-biasable arm 128 is shown extending generally radially outwardly from the illustrated base 126 (e.g., through a slot 129*a* formed in the end fitting 92, FIGS. 7-8A-B) and configured to electrically contact the inner body conductor 42. If desired, the arm 128 may be spring-biased radially outwardly to ensure effective electrical contact with the inner body conductor 42. This particular form of intermediate electrical connector 124 is sometimes referred to as a "shepherds-hook" due to the general shape of the arm 128. For example, when the exemplary charge holder assembly 90*c* (e.g., end fittings 92, 96, charge holder 40, explosives 46, det-cord 56, FIG. 10) is pushed into the carrier 30, the illustrated arm 128 may engage the inner body conductor 42 under friction to deflect it radially inwardly against its outward spring tension and thus assist in providing a robust and reliable electrical connection therebetween.

However, the first intermediate electrical connector 124*a* can have any other form (e.g., a piston and helical spring) and location. And in other embodiments, the above-mentioned electrical components 24 may not be provided in or associated with the uphole end fitting 92, but instead carried by or associated with any other component(s) of the gun system 10.

Still referring to FIG. 2, if desired, all, or any combination, of the feedthrough conductor 69, contact button 102, first intermediate conductor 118*a*, first intermediate electrical connector 124*a* may be non-wired and form wire-free conductive interfaces 26 therebetween. In the present embodiments, they are all wire-free. However, any other combination, configuration and location of components may be used to help facilitate the communication of electric current into the upper end 20 of each gun 16. For example, in some embodiments, the entire gun 16 or any desired part thereof may be wired (e.g., include one or more electrical components 24 having wire(s) and/or conductive interfaces 26 formed with one or more wires).

Figure 4:
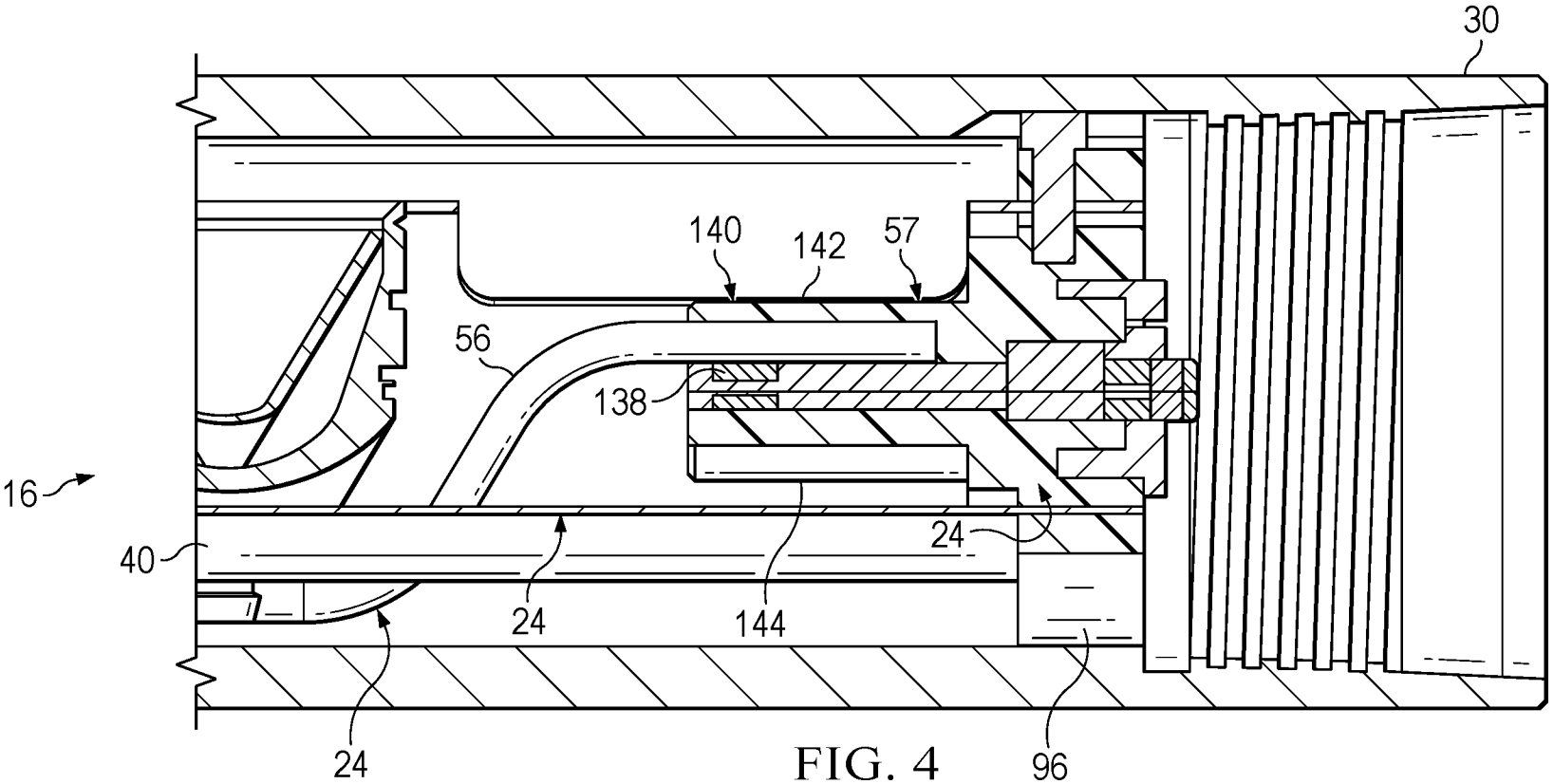
FIG. 4 is a cross-sectional side view of the downhole end of the perforating gun, in accordance with embodiments of the present disclosure.
Figure 5A:
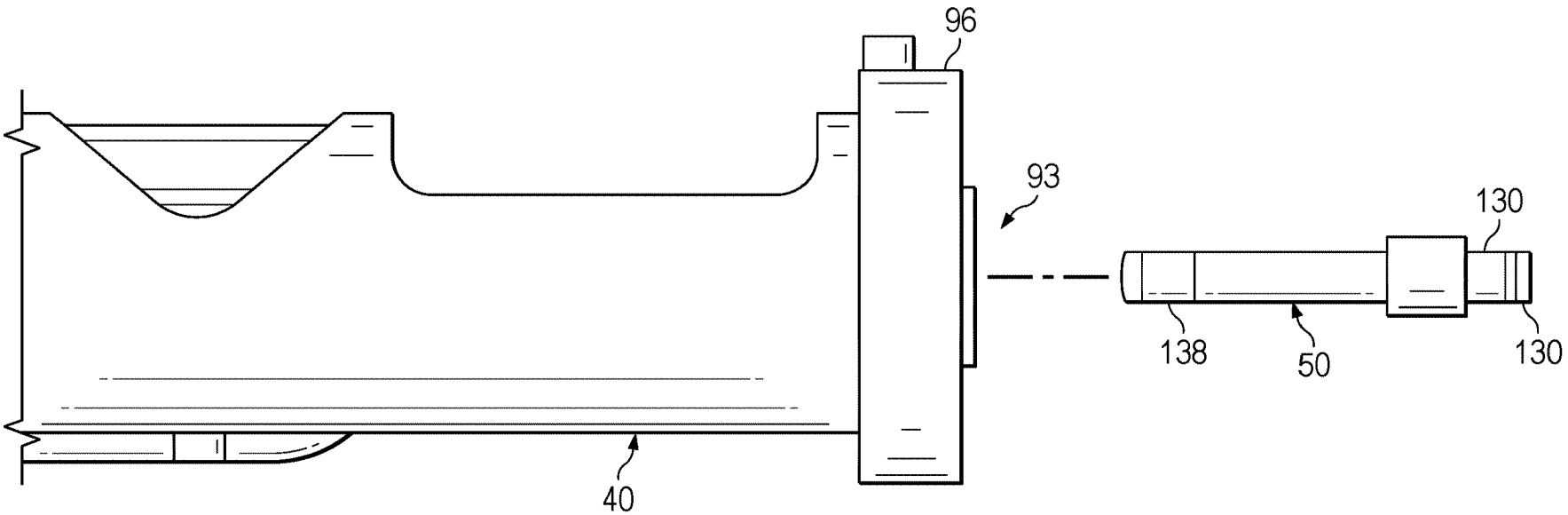
FIG. 5A is an exploded view of a perforating gun charge holder and detonator, in accordance with embodiments of the present disclosure.
Figure 5B:
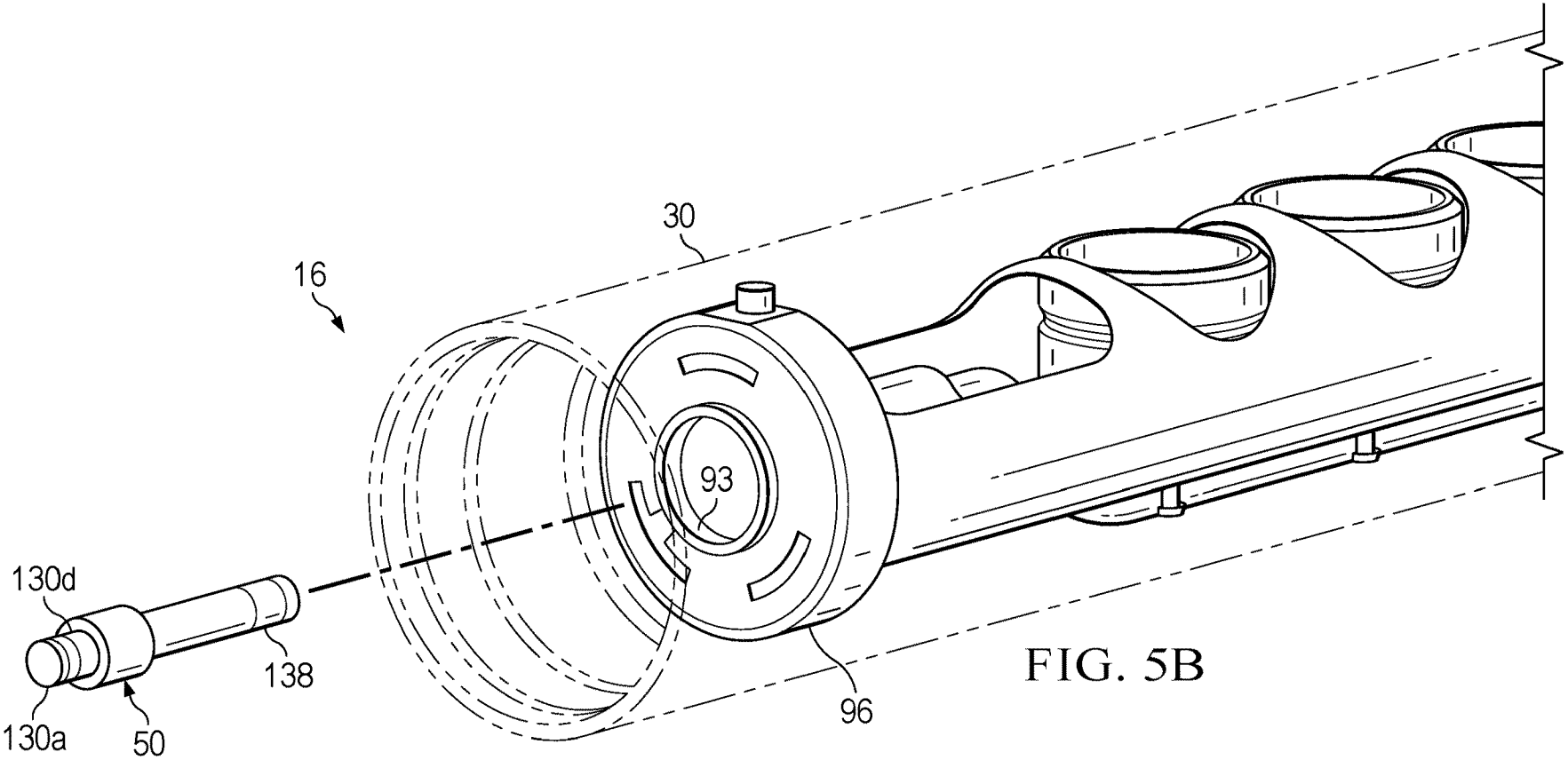
FIG. 5B is an exploded view of a perforating gun charge holder and detonator, in accordance with embodiments of the present disclosure.
Figure 6:
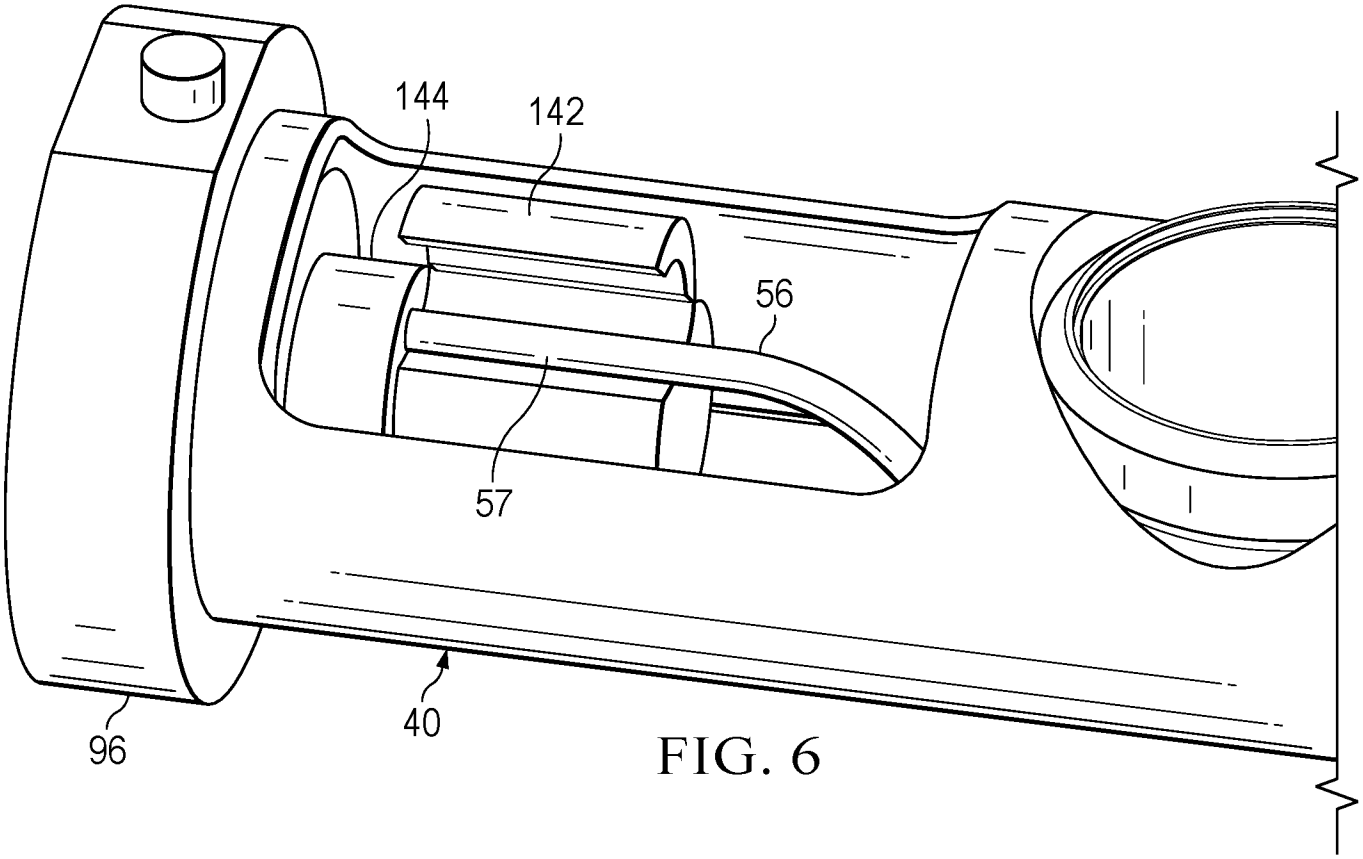
FIG. 6 is a cut-away view of the downhole end of the perforating gun, in accordance with embodiments of the present disclosure.

Now referring to FIGS. 4-6, in accordance with various distinct independent aspects of the present disclosure, the exemplary downhole end fitting 96 may be configured to at least partially seat, or house, the detonator 50, switch 60 (FIG. 1), one or more other electrical components 24 associate with the gun 16, other components or a combination thereof. In other embodiments, such components may be housed or carried in any other suitable component.

In some instances, the downhole end fitting 96 may be equipped with a det-cord clamp 140 configured to secure the lower end 57 of the det-cord 56 in a desired position in the gun 16 and relative to the detonator 50 to receive ignition signals therefrom. If desired, the det-cord clamp 140 may be integral, or rigidly coupled, to the end fitting 96. In the present embodiments, the det-cord clamp 140 is formed in or associated with an (e.g., elongated) detonator sleeve 144 extending uphole from the downhole end fitting 96. The det-cord clamp 140 (and detonator sleeve 144, if included) may be provided to save the time, effort and need for the gun assembler to find a conventional separate det-cord clip (which can be easily lost or disengaged) and use it to manually couple the end of the det-cord 56 to the detonator 50, for any other benefit or a combination thereof. For example, many current perf guns require an assembler to manually insert his/her fingers into a window formed in the charge holder 40 to make that tedious, delicate connection.

The det-cord clamp 140 may have any suitable form, configuration and operation. In the present embodiments, the det-cord clamp 140 includes a hinged door 142 that can be opened to allow placement of the end 57 of the det-cord 56 into the desired position in the end fitting 96 and thereafter closed to secure that position. When the exemplary detonator 50 is inserted into the bore 93 of the end fitting 96 (e.g., from the downhole end of the fitting 96), one or more explosive interface 138 formed, or provided, on or in, or extending from the detonator 50 will abut the det-cord 56 sufficient to transmit desired ignition signals through the det-cord 56 to the explosives 46. In the illustrated embodiments (e.g., FIGS. 4 & 5A-B), the explosive interface 138 of the detonator 50 includes one or more ring, or band, extending at least partially around the detonator 50, but could take any other suitable form.

Figure 7:
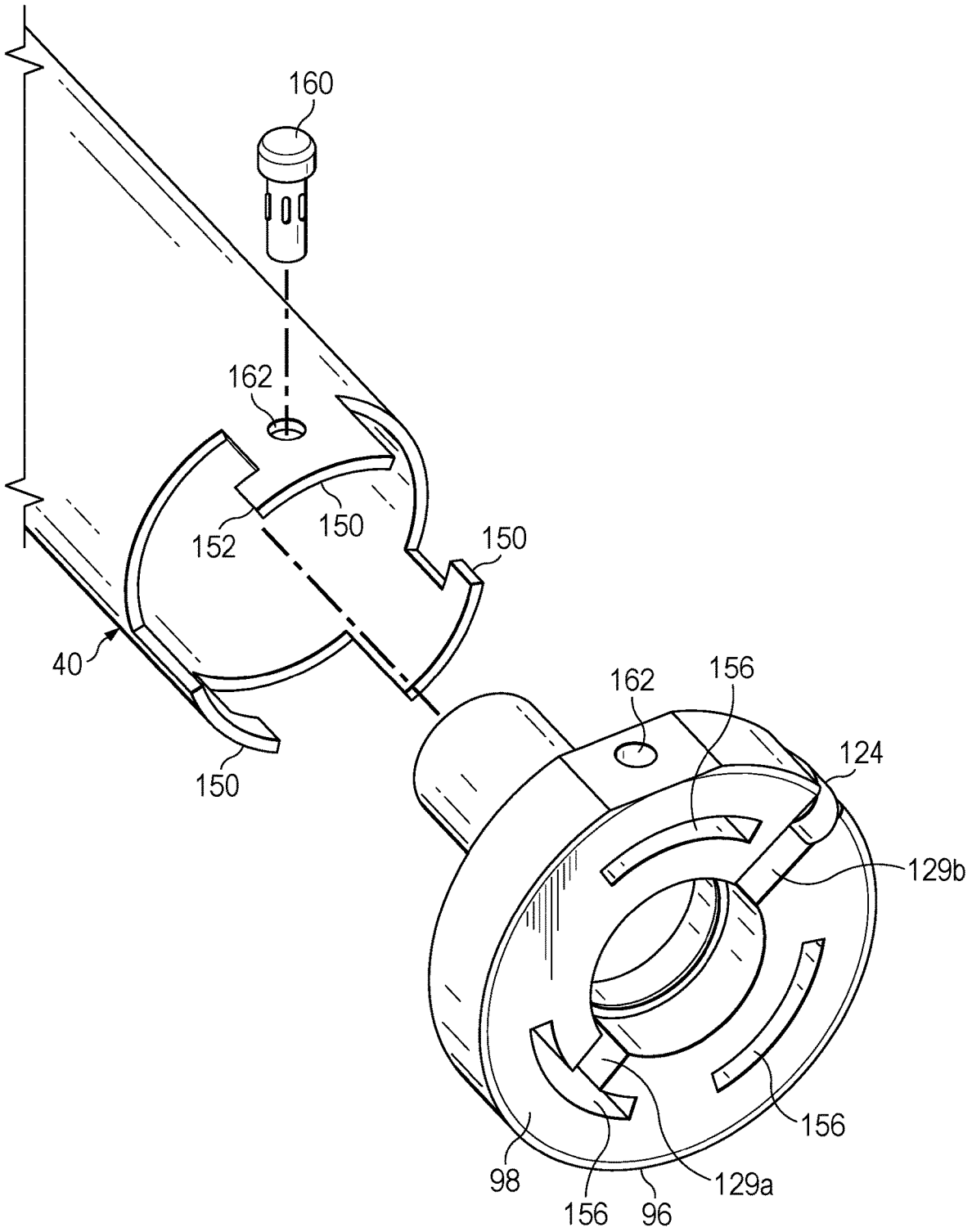
FIG. 7 is an exploded view of a perforating gun string with a twist-lock connection, in accordance with embodiments of the present disclosure.
Figure 8A:
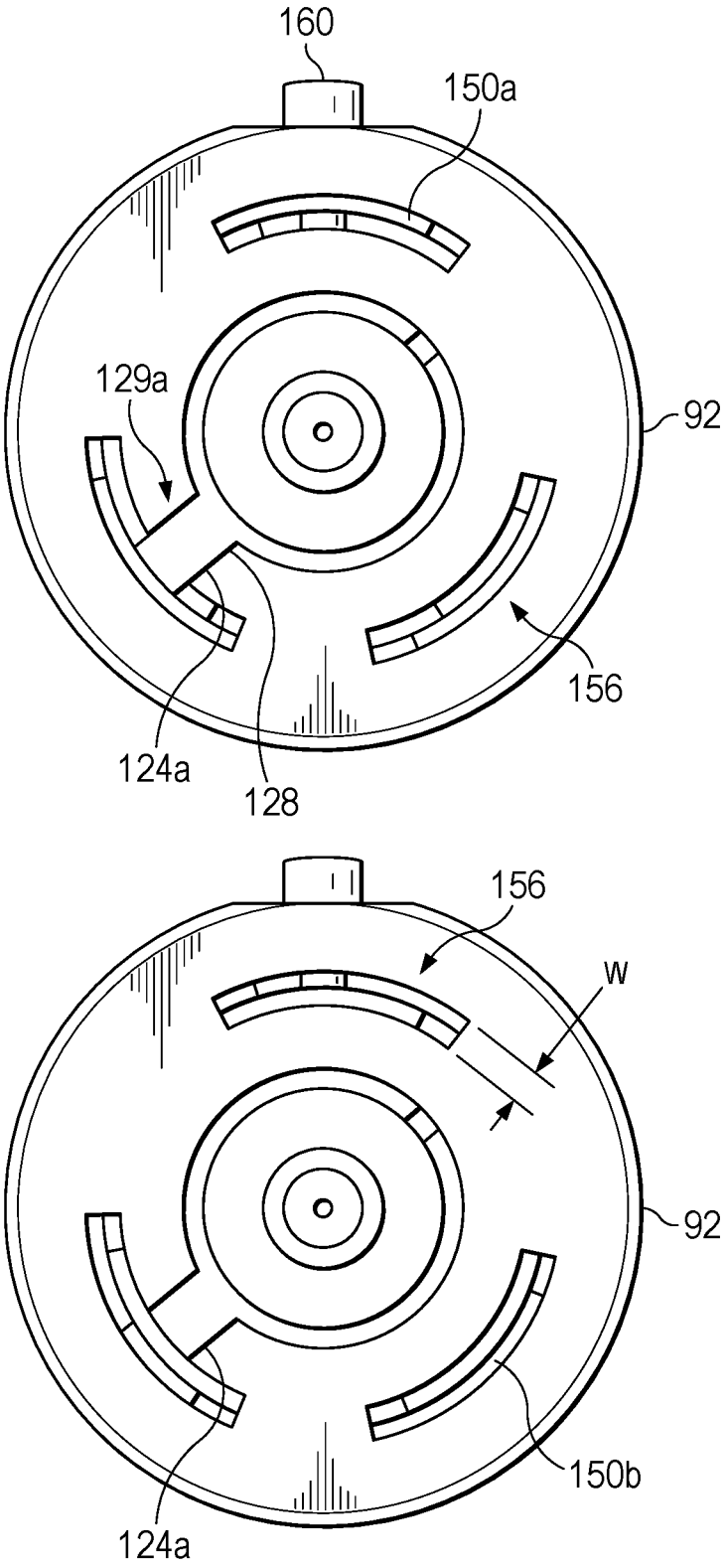
FIG. 8A illustrates an end fitting in accordance with embodiments of the present disclosure.
Figure 8B:
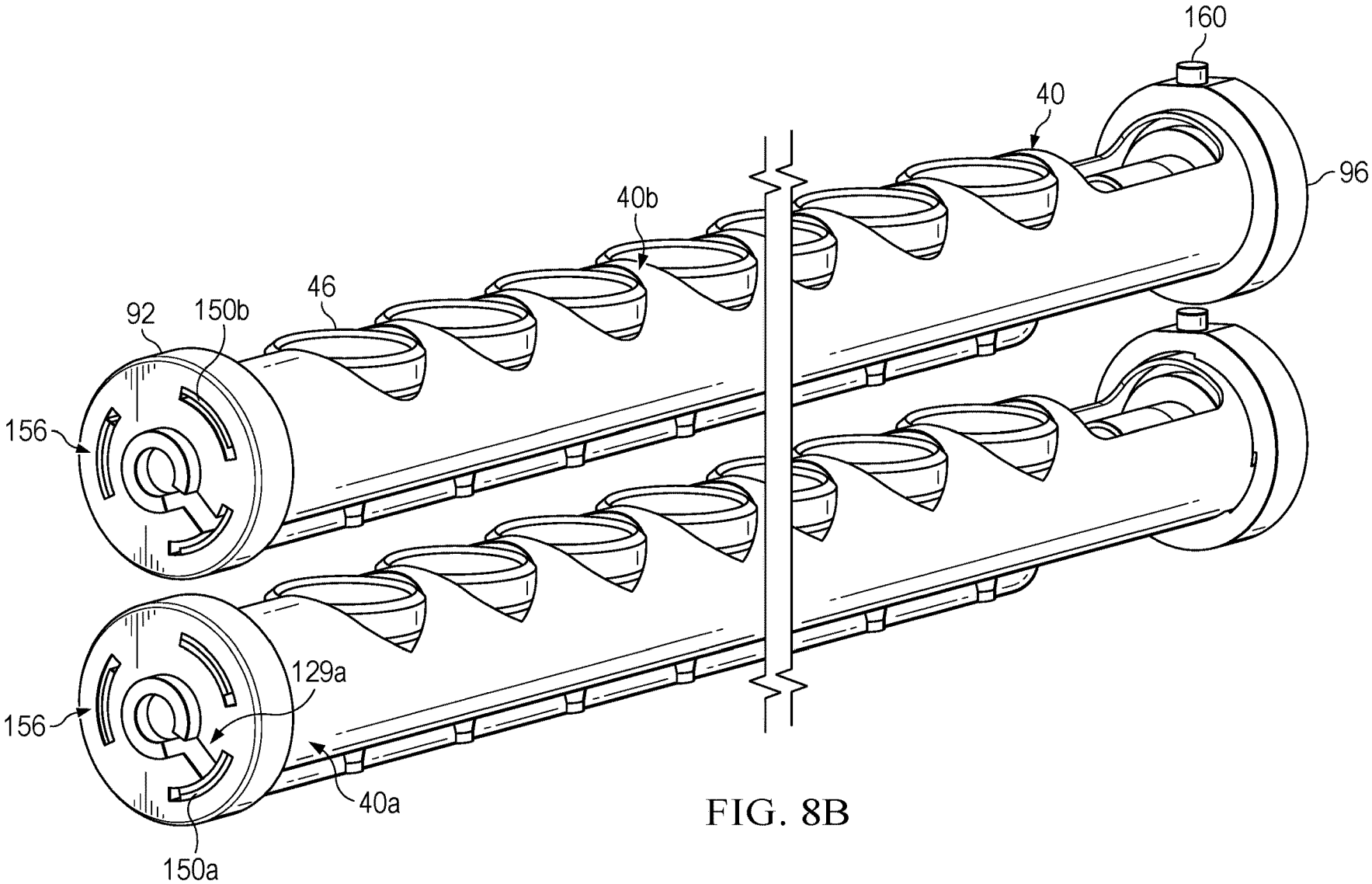
FIG. 8B illustrates a side view of a charge holder with the end fittings, in accordance with embodiments of the present disclosure.

Referring now to FIGS. 7-8B, in accordance with other distinct independent aspects of the present disclosure, the charge holder 40 may be associated with the end fittings 92, 96 (or other component(s)) in any suitable manner. For example, they may be formed integrally as one component (e.g., 90*c*, FIG. 32). For another example, a twist-lock connection may be employed between the charge holder 40 and one or more of the end fittings 92, 96. As shown in FIG. 7, the illustrated charge holder 40 includes at least one finger 150 (e.g., three) at each end thereof that is slidable at least partially through, and is rotatable relative to, a receiving slot 156 formed in the corresponding end fitting 92, 96 (and vice versa). For example, after the receiving slots 156 of an exemplary end fitting 92, 96 are slid over the corresponding fingers 150 and the end fitting 92, 96 is rotated or twisted (or vice versa), a tab 152 extending from the finger 150 will abut the outer face 98 of the end fitting 92, 96 to prevent the charge holder 40 from backing out. In the present embodiments, proper seating (e.g., and tight engagement) of the charge holder 40 in the exemplary end fittings 92, 96 should align the respective first and second intermediate electrical connectors 124*a*, 124*b* (e.g., FIG. 2) with the inner body connector 42 (e.g., the through-connector 44, as described below) to form reliable electrical interfaces therebetween.

Referring again to FIGS. 7-8B, if desired, one or more releasable mechanical connectors 160 may be engaged in corresponding aligned holes 162 in one or more corresponding fingers 150 (or any other part) of the charge holder 40 and the end fitting 92, 96 to help secure them together. The connector 160 may have any suitable form and operation. In this embodiment, the connector 160 is a pin with helically cut teeth so it can be pushed into locking engagement and screwed out for disengagement. In other embodiments, the connector 160 may be a screw, snap or other mechanism. In yet other embodiments, any other configuration of components and/or features may be used to couple or associated the charge holder 40 and end fittings 92, 96 or otherwise secure the charge holder 40 in the carrier 30. In the present embodiments, a single connector 160 secures each end of each charge holder 40 in position.

When included, the end fittings 92, 96 may be designed to receive different sizes of charge holders 40. This sort of "universal" end fitting 92, 96 may be beneficial, for example, to be able to use the same type of end fittings 92, 96 in the assembly of different perforating guns 16 requiring differing arrangements of explosives 46. Referring to FIGS. 8A-B, each receiving slot 156 in the illustrated end fittings 92, 96 may have a width W that will accommodate fingers 150 extending from different sized charge holders 40. For example, when the charge holders 40 are cylindrical in shape, they can be formed having different diameters (e.g., to provide different explosive arrangements). A first (smaller) charge holder 40*a* may have an outer diameter (e.g., 1¾") that is smaller than the outer diameter (e.g., 1⅞") of a second (larger) charge holder 40*b*. To accommodate both (or any desired) sizes of charge holders 40, the width W of each receiving slot 156 in the exemplary end fittings 92, 96 may be formed to accept a finger 150 of either type of charge holder 40. In this embodiment, each finger 150*a* of the exemplary smaller charge holder 40*a* is shown abutting the inner surface that forms the corresponding receiving slot 156, while each finger 150*b* of the larger charge holder 40*b* is shown abutting or hugging the outer surface that forms the respective corresponding receiving slot 156. However, any configuration of components and features may be used to accommodate different shapes, sizes and types of charge holders 40.

Figure 9:
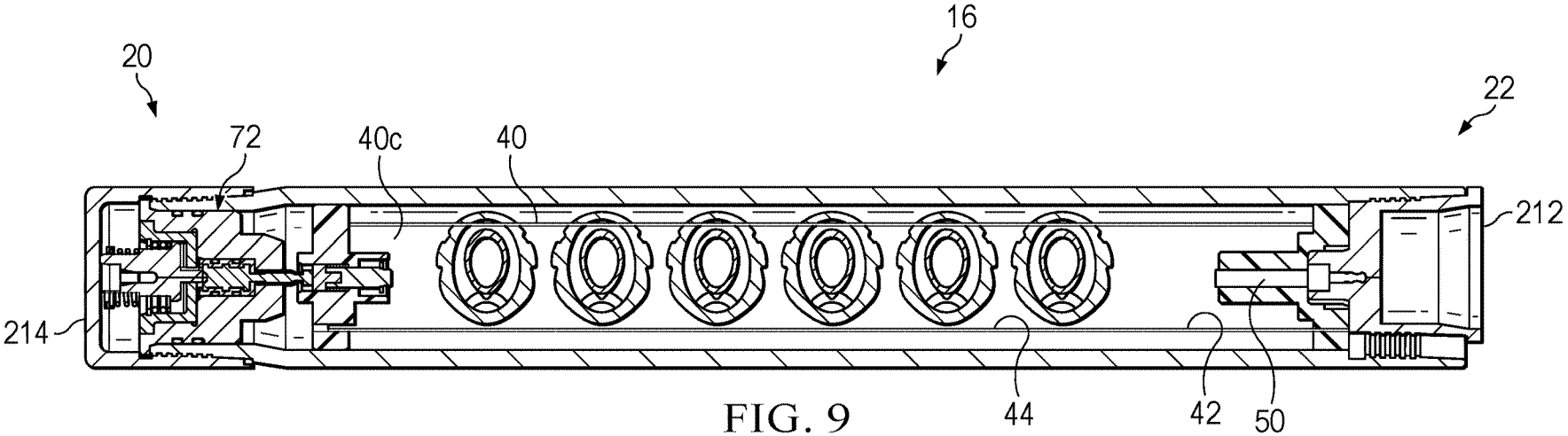
FIG. 9 is a cross-sectional side view of a perforating gun, in accordance with embodiments of the present disclosure.

In accordance with other distinct independent aspects of the present disclosure, the charge holder 40 may have any suitable form, configuration, components, construction and operation. Referring now to FIGS. 2 & 9, for example, the charge holder 40 may be constructed at least partially of insulative material (e.g., which cannot conduct the voltage required to provide the necessary explosive ignition) that can withstand the elevated temperatures expected in use of the perforating system 10. This sort of charge holder 40 is sometimes referred to herein as non-conductive, or insulator, charge holder 40*c*. Non-limiting and non-exclusive examples of non-conductive charge holders 40*c* may be constructed at least partially of cardboard, nylon, plastic, rubber, silk, non-conductive fabric or fibrous material, or variations or combinations thereof. Insulator charge holders 40*c* may be used to simplify manufacturing, transportation, handling, assembly, cost and/or safety concerns associated with metal charge holders 40, insulate electrical through-connectors 44 (as described below) that may be associated with the charge holder 40, allow the use of a non-wired or non-insulated inner body conductors 42 (e.g., through-connectors 44) therewith, for any other purpose(s) or a combination thereof.

The charge holder 40 may have any suitable shape, form, construction and configuration. In this embodiment, for example, the charge holder 40 has a general cylindrical shape. In some other embodiments, such as those shown in FIGS. 10-12, the charge holder 40 may take the form of, or include, one or more plates 170 (a.k.a. the charge plate) configured to carry the explosives 46 in a desired orientation. However, the charge holder 40 may have any other desired shape.

Figure 10:
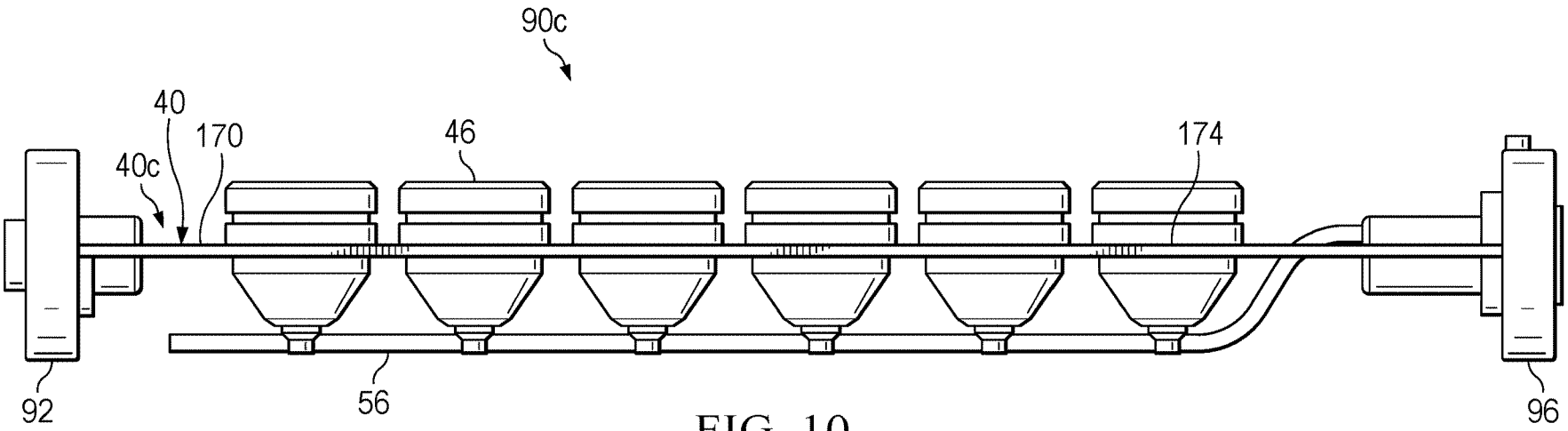
FIG. 10 illustrates a side view of the shaped charges within the charge holder, in accordance with embodiments of the present disclosure.
Figure 11:
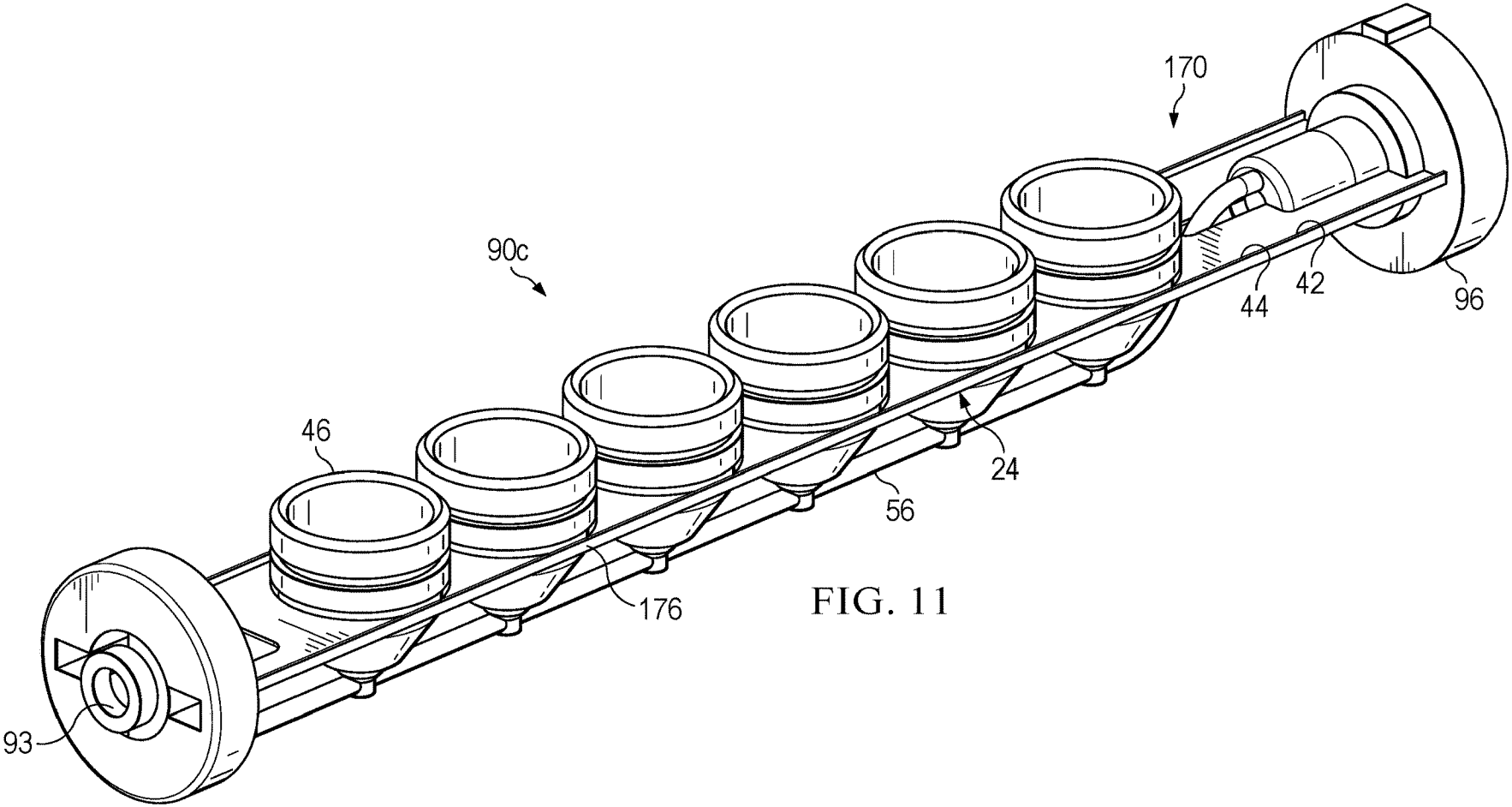
FIG. 11 illustrates shaped charges within a charge holder, in accordance with embodiments of the present disclosure.
Figure 12:
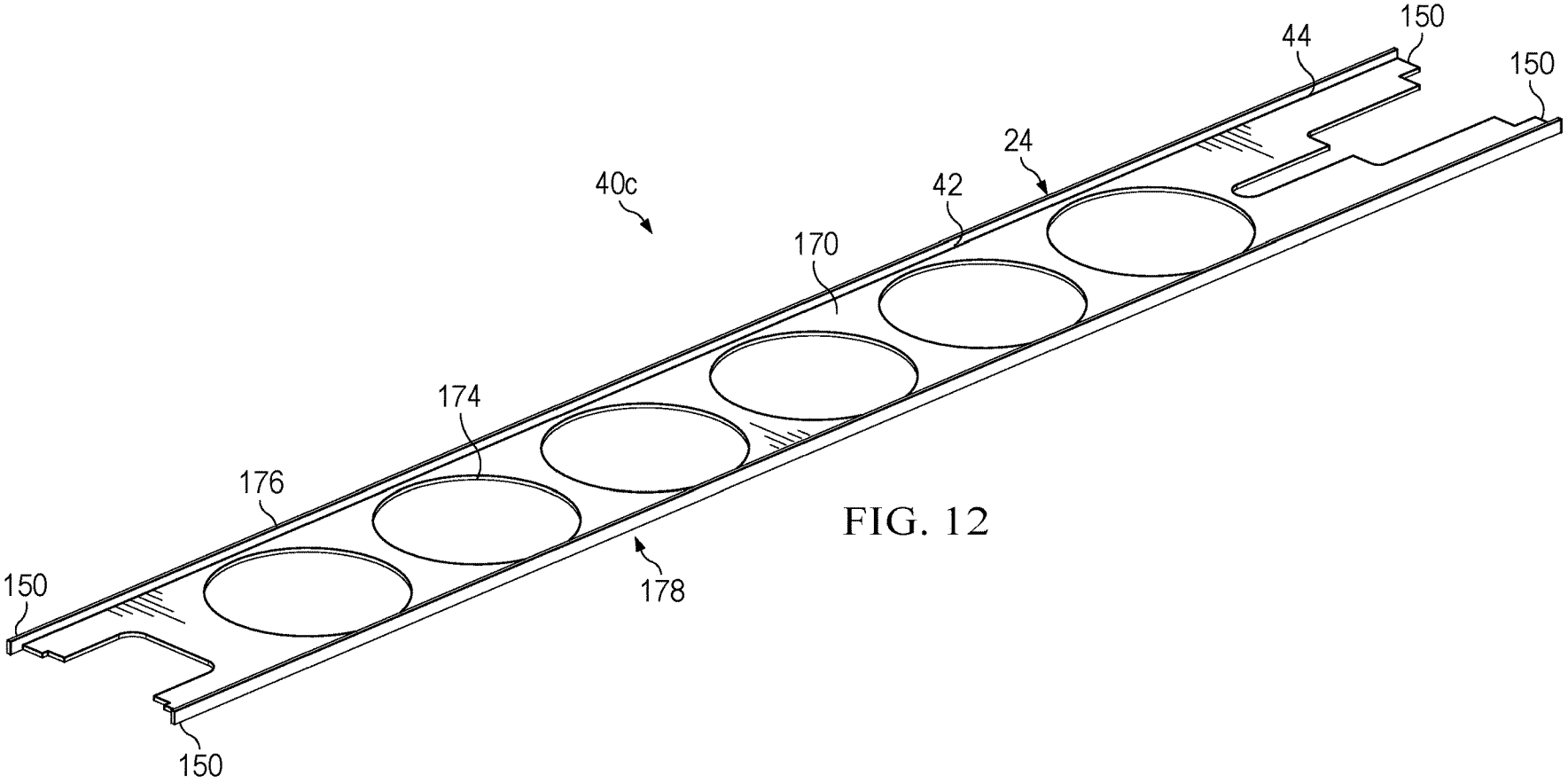
FIG. 12 illustrates a charge holder, in accordance with embodiments of the present disclosure.

Still referring to FIGS. 10-12, the charge plate 170 may have any suitable form, configuration and components. For example, the charge plate 170 may be pre-formed at a desired length, or custom cut-to-size as needed, such as from a large (e.g., 50'-100' long, etc.) roll or sheet of plate material (e.g., similar to the uses of extruded aluminum and Unistrut material in other industries). Likewise, the charge plate 170 may be pre-formed with charge holes 174, or custom-perforated as-needed to provide the desired number and location of charge holes 174.

Figure 15:
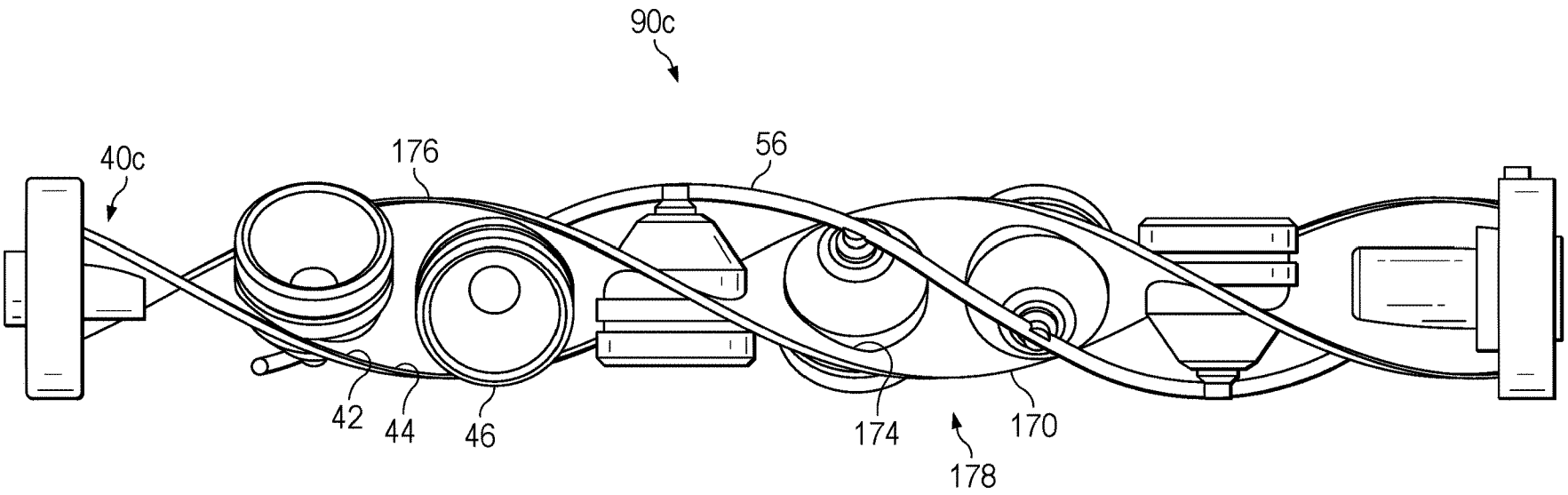
FIG. 15 illustrates a loaded curved charged holder, in accordance with embodiments of the present disclosure.
Figure 16:
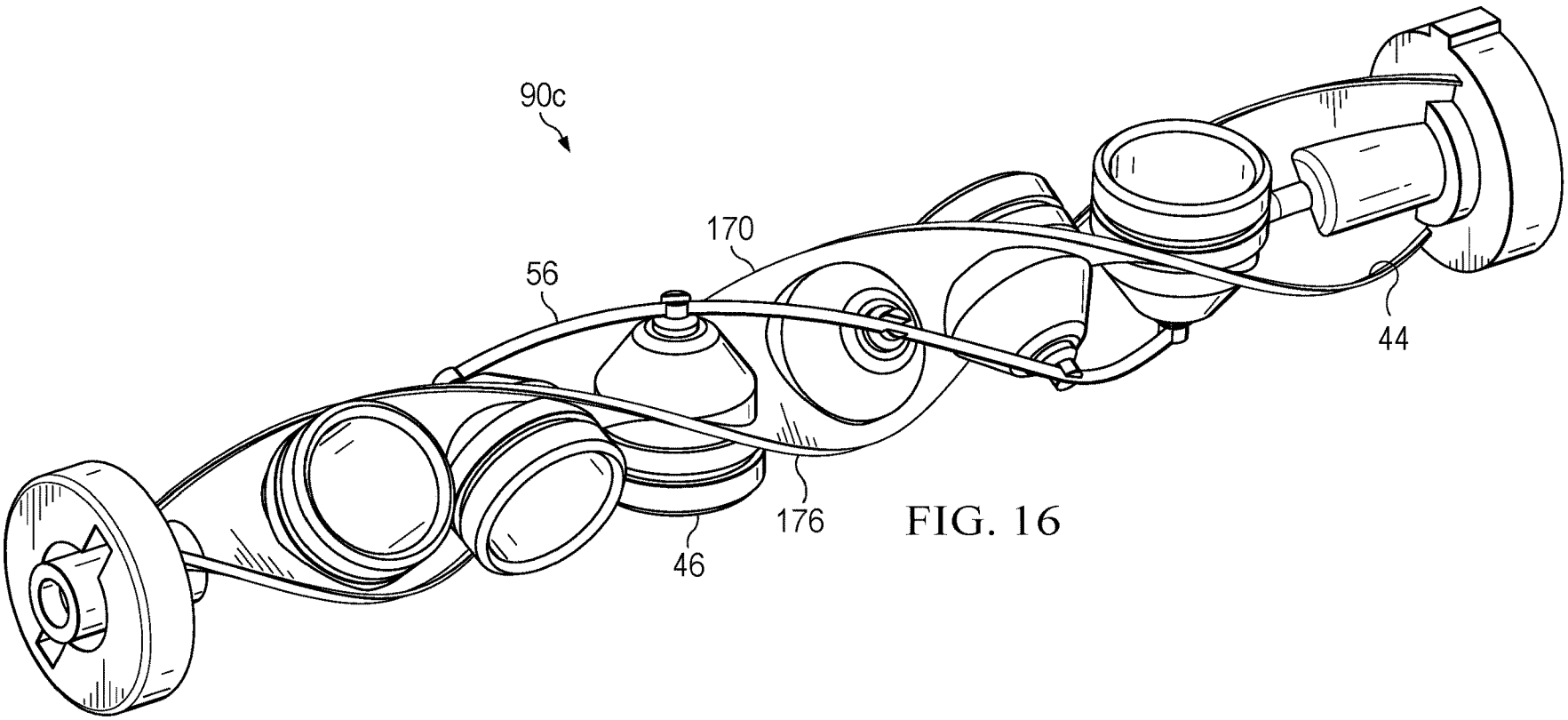
FIG. 16 a loaded curved charged holder, in accordance with embodiments of the present disclosure.

The charge plate 170 may also have any desired shape. In the present embodiment, the charge plate 170 has a rectangular, tray-like shape and includes an inwardly facing lip 176 extending down each side edge 178. The exemplary charge plate 170 may be flat (e.g., FIGS. 10-12), such as to position the explosives 46 to be carried thereby in the same plane, or curved (e.g., FIG. 15-17), such as to position the explosives 46 carried thereby at different angles and/or orientations).

Figure 13:
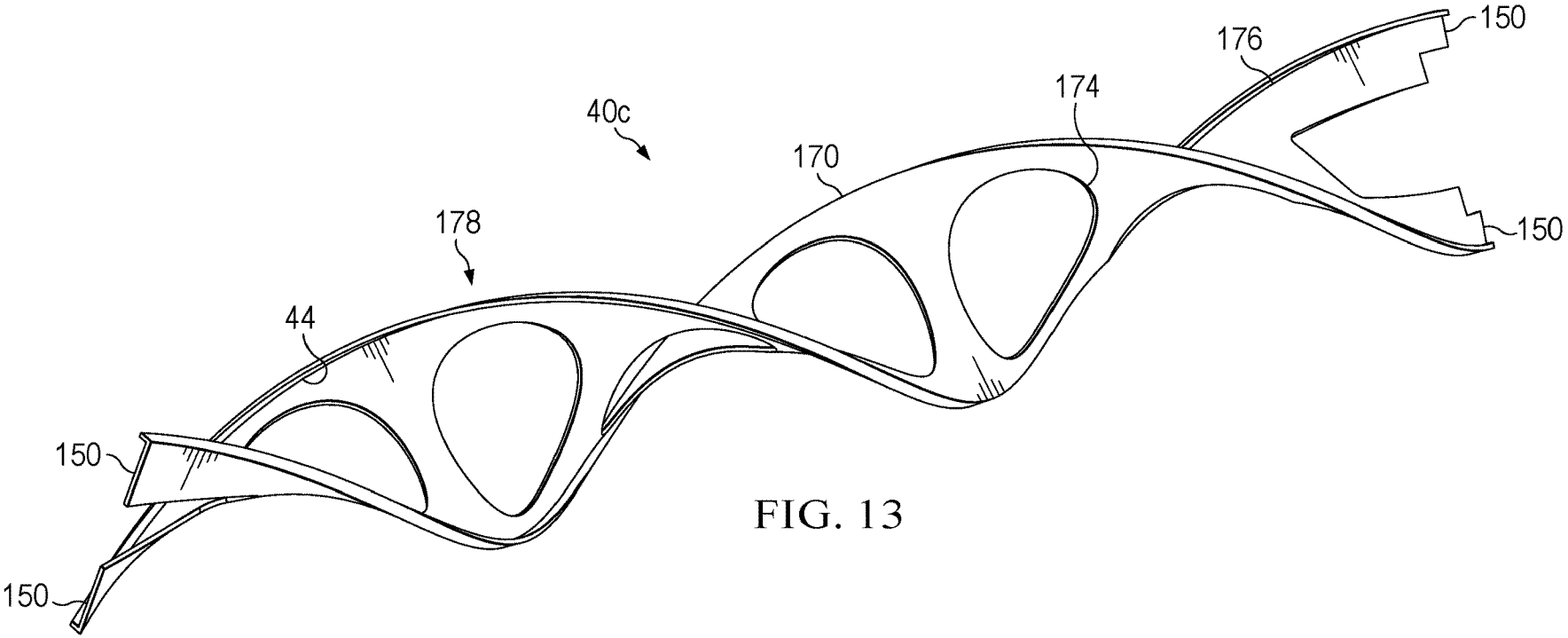
FIG. 13 illustrates a curved charge holder, in accordance with embodiments of the present disclosure.
Figure 14:
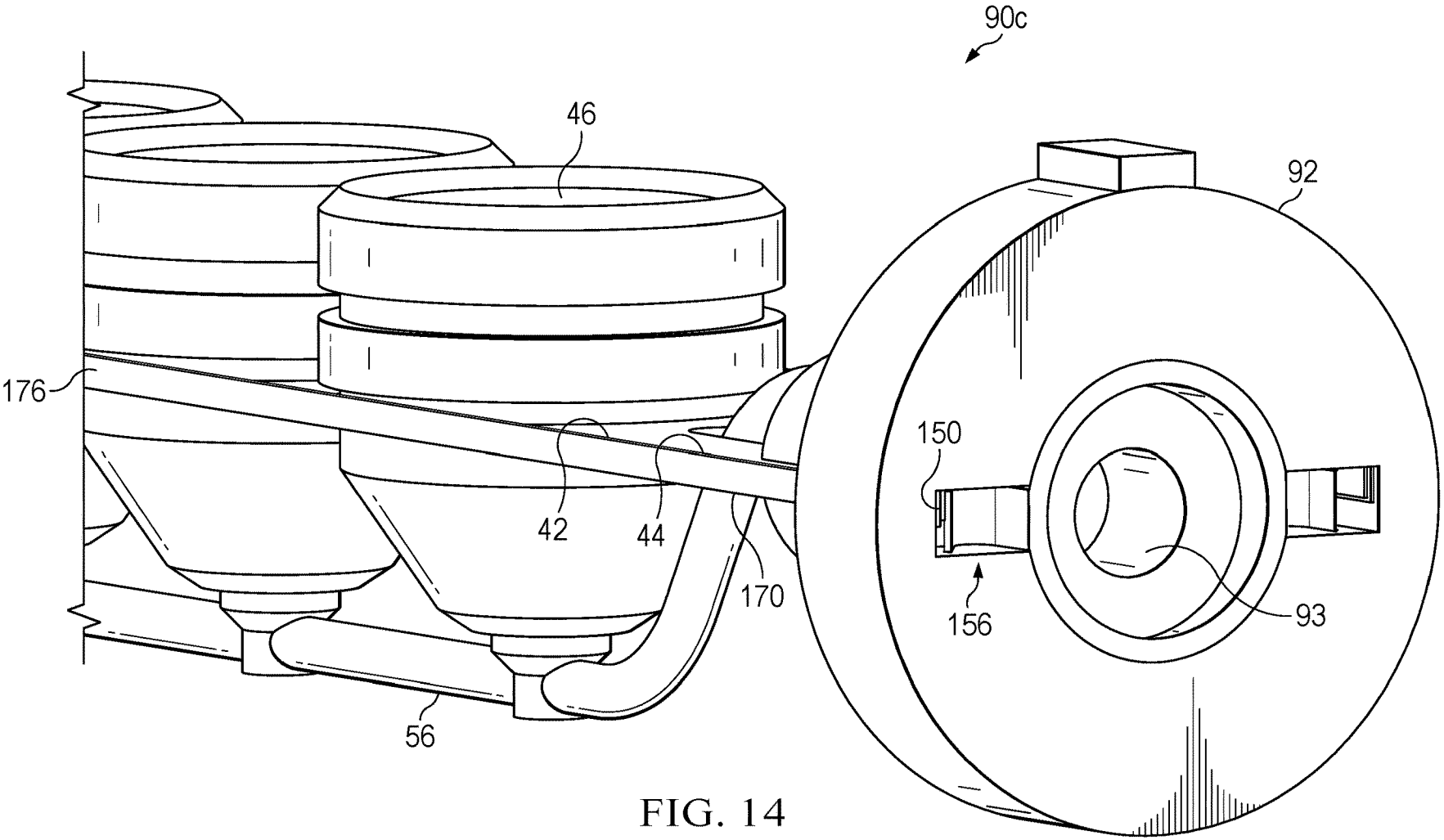
FIG. 14 illustrates an end fitting connected to the charge holder, in accordance with embodiments of the present disclosure.

If desired, the charge plate 170 may be formed of deformable (e.g., bendable, twistable, moldable, etc.) material that can be shaped or re-shaped, as-needed, to provide the desired explosive orientation and positioning for the perforating gun 16. In the present embodiment, the flat charge plate can be bent to form a curved charge plate. For example, referring to FIGS. 12 & 13, the charge holes 174 may first be punched or formed into the flat plate 170 or plate material, then the plate 170 selectively twisted or molded into a desired curved shape to form a curved charge plate with the desired respective angles/orientations for the charge holes 174 (and the explosives ultimately placed therein). In different embodiments, any suitable deformable material that is, or later becomes known to be, capable of retaining a desired non-planar shape may be used to form the charge plate 170. For example, the plate 170 may be constructed of plastically deformable material, such as thermoplastic material (e.g., heated, bent and recured), bendable metal, nylon, cardboard or other material or material combinations. In some instances, the charge plate material may require a certain amount of over-bending or over-molding due to spring-back to arrive at the desired final shape and orientation of charge holes 174.

Referring to FIGS. 10-17, in some instances, it may be desirable to construct the plate 170 at least partially of insulative material to form a non-conductive, or insulator, charge holder 40*c* (e.g., as described above). However, the present disclosure is not limited by the type of material, configuration or method of forming the charge plate 170.

If desired, the inner body conductor 42, such as the through-connector 44 (e.g., as described below), may be pre-applied to the pre-formed plate 170, or the roll or sheet of plate material, in advance to save on the time, labor and expense of wrapping wire (or other types of) inner body conductor 42 during assembly of the gun 16, for any other reason or a combination thereof.

When included, the charge plate 170 may be secured in the gun 16 in any suitable manner. For example, the charge plate 170 form of charge holder 40 may be releasably, mechanically engaged with and carried by the end fitting 92, 96 similarly as described above. In the present embodiment, referring to FIGS. 12 & 13, each charge plate 170 is shown including one or more fingers 150 that engage respective aligned receiving slots 156 (e.g., FIG. 14) in the associated end fitting 92, 96. In this example, the fingers 150 are not twist-locked to the end fittings 92, 96, but engaged with an interference fit. If desired, multiple sets (not shown) of receiving slots 156 may be formed in each end fitting 92, 96 to provide different anchor locations for the charge plate 170. However, the charge plate 170 could be secured in the gun 16 in any other manner, such as with bolts, mateable features (e.g., one or more detents in end fitting 92, 96 and one or more slots in the charge plate 170, etc.), combined charge holder assembly 90*c* interference fit into carrier 30.

Charge plates 170 may be used for any suitable reason. For example, the use of charge plates 170 may allow simplification and improved durability and reliability of the inner body conductors 42 and the use of a non-wired inner body conductors 42 (e.g., through-connectors 44 as described below), custom design of the charge holder 40, improved efficiency and flexibility in the manufacture and assembly of the gun 16, improved effectiveness in use of the gun system 10, simplification of materials supply sourcing, the ability to accommodate last minute instructions from the user, for any other purposes or a combination thereof. In some embodiments, the charge plates 170 may be custom designed at the job site, field location or staging area (e.g., to accommodate last minute user specifications, provide as-needed perforating guns 16, etc.).

Referring again to the embodiments of FIGS. 2 & 9, in accordance with various distinct independent aspects of the present disclosure, electric current may be transmitted through the inner body conductor 42 along at least part of the length of the gun 16 (e.g., gun 16*a* generally from its upper to its lower ends 20, 22) to ultimately provide electric current to the detonator 50 of that gun 16*a* and to at least the next successive gun (e.g., 16*b*) in the gun system, for any other purpose(s) or a combination thereof. The inner body conductor 42 may have any suitable form, configuration, location, components and operation. In some embodiments, the inner body conductor 42 may be in the traditional form of insulated wires (not shown) or incorporate one or more wires, may be associated with the charge holder 40, any other suitable component or may itself form an independent component extending through the desired length of the gun 16.

In the present embodiment, the inner body conductor 42 includes one or more through-connectors 44. The through-connector 44 may have any suitable form, configuration, material construction, orientation and placement. The through-connector 44 may be fixed-in-place (e.g., applied to, embedded or formed in the charge holder 40), formed in a substantially straight orientation or in any desired pattern, continuous or non-continuous and may or may not include insulating material. For example, the through-connector 44 may not need to include insulating material when sufficiently insulated (e.g., from shorting) by one or more other components. In the present embodiment, the through-connector 44 does not include insulating material when used with the insulator charge holder 40*c* (which sufficiently insulates the through-connector(s) 44).

Still referring to FIGS. 2 & 9, the through-connector 44 may be applied to, formed into or onto or otherwise associated with the charge holder 40 (or other component) in any suitable manner and, if desired, in advance and prior to assembly of the gun 16. In the present embodiment, the through-connector 44 is a single conductive trace extending down the ID of the illustrated cylindrical insulator charge holder 40*c*. In other embodiments, the through-connector 44 may be run at least partially down the OD of the charge holder 40 or at any other suitable location. For example, when the charge holder 40 includes one or more charge plates 170 (e.g., FIGS. 10-12), the through-connector 44 may be provided at a known location (e.g., along the inside of an inwardly facing lip 176 on one or both side edges 178) to align it with other electrical components 24 it will engage when the gun 16 is assembled. In the present embodiment, the through-connector 44 is pre-applied to the roll or sheet of tray-like material as a specified location, the material is then cut to size to form the charge plate 170, the charge holes 174 are then punched or cut therein and, if necessary, the plate 170 is bent or molded into the desired shape. Thereafter, the explosives 46 can be dropped in and the plate 170 inserted into the carrier 30.

The use of through-connectors 44 can provide one or more advantages, such as eliminating the time and labor intensive effort and expense in assembling and connecting other forms of inner body conductors 42 (e.g., wrapping wire-type inner body conductors 42 around charge holders 40) and eliminating potential reliability issues, assembly errors and equipment failure events that can occur therewith (e.g., steel charge holders 40 nicking and damaging wire-type inner body conductors 42, assembly errors), saving on the need for and cost of steel charge holders 40 and the associated costs and safety and other problems associated with manufacturing, shipping and handling steel charge holders 40, better conservation and management of raw materials by avoiding the need for steel charge holders 40, any other benefits or a combination thereof.

The use of through-connectors 44 on charge plates 170 may provide the above and/or additional benefits. For example, providing the through-connector 44 along the same pre-defined path on the charge plate 170 may eliminate the need to plan out placement of the inner body conductor 42 for different variations of phasing and orientation of shaped charges 46 to be used in different guns 16. In the present embodiment, after the exemplary charge plate 170 (with one or more through-connectors 44 provided thereon) is selectively twisted into a non-planar shape, the twist will both route the through-connector 44 and orient the shaped-charges 46 as desired, eliminating the need to independently determine where the inner body connector 42 (e.g., wire) should be routed (for each different configuration of shaped-charges 46 or each gun 16).

Figure 19A:
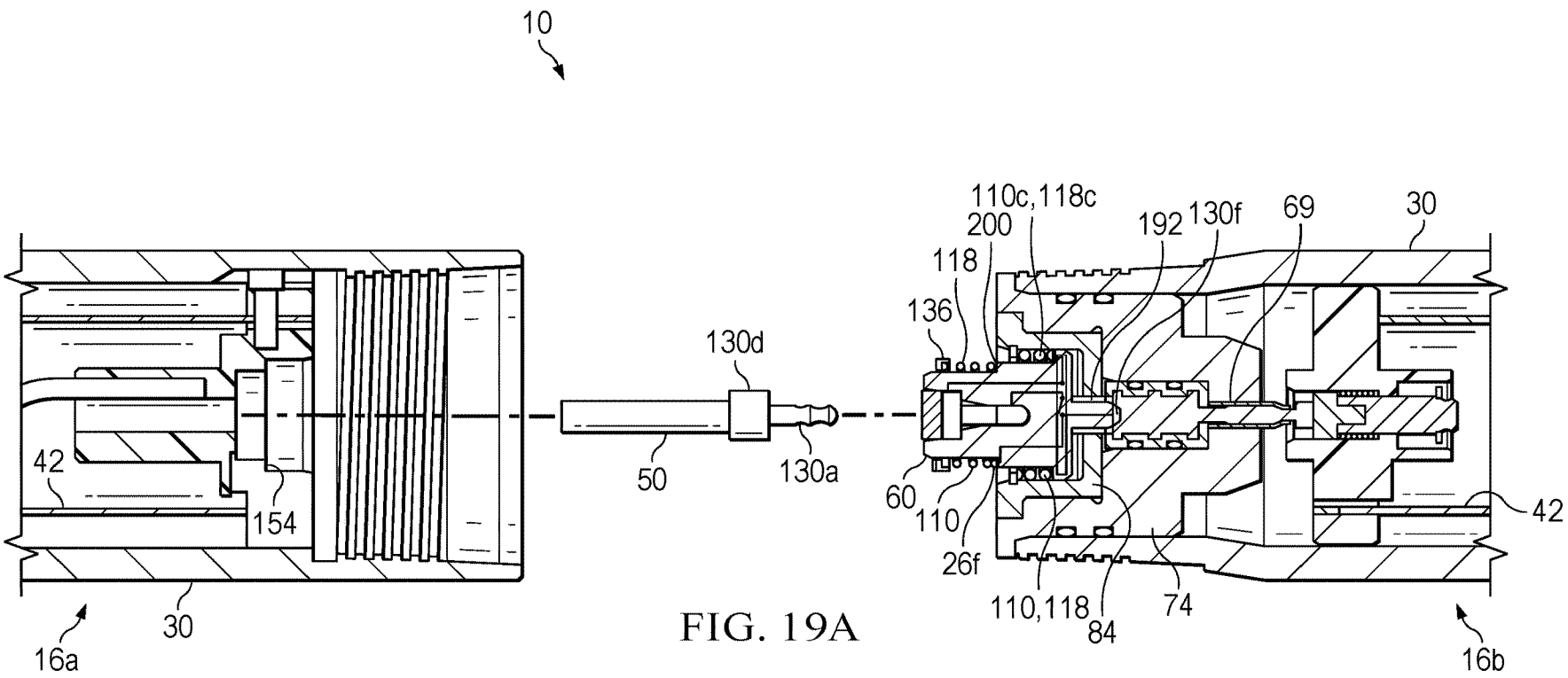
FIG. 19A illustrates the connection between two perforating guns, in accordance with embodiments of the present disclosure.
Figure 19B:
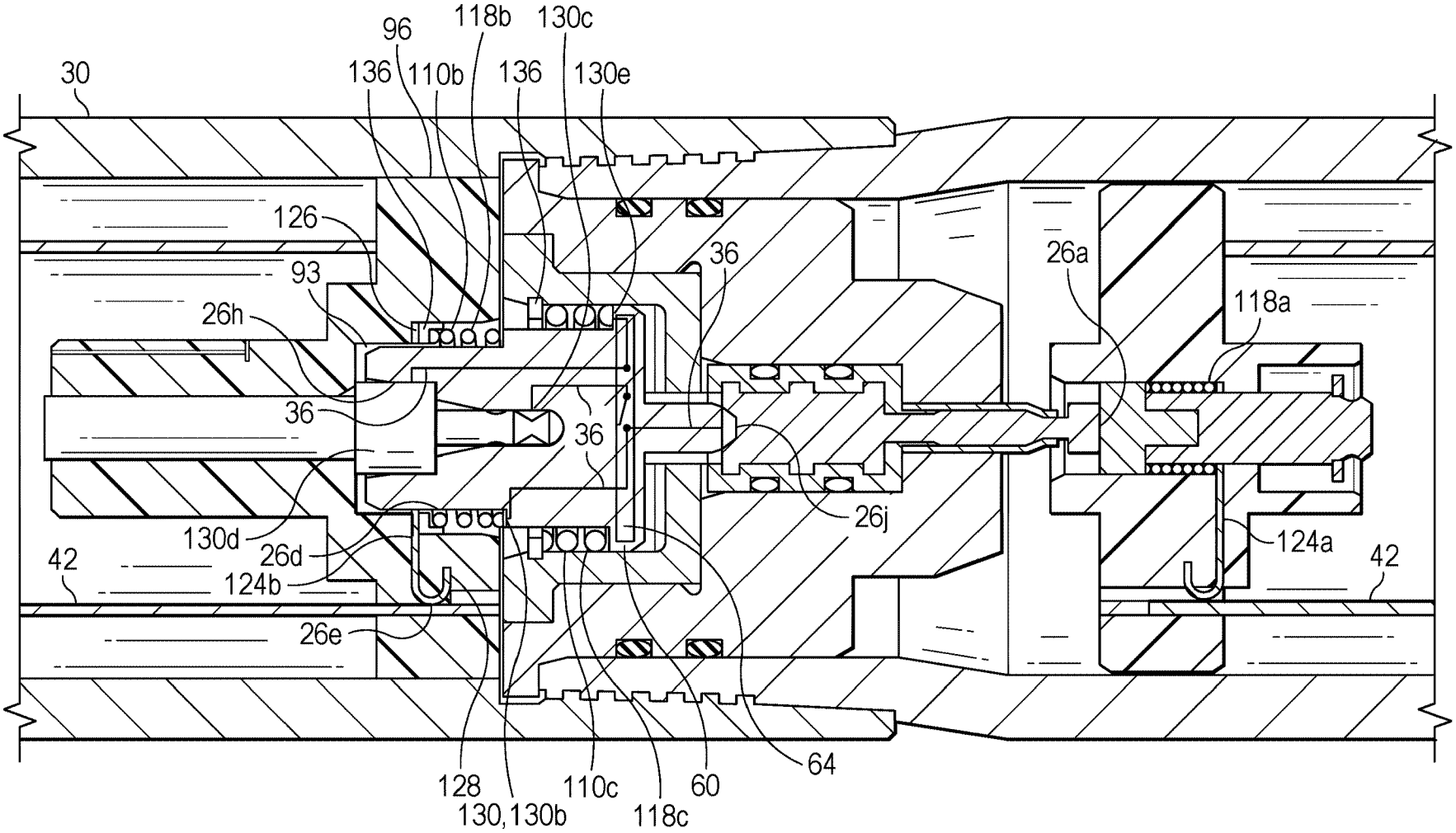
FIG. 19B illustrates the connection between two perforating guns, in accordance with embodiments of the present disclosure.

Referring now to the embodiment of FIGS. 19A-B, in accordance with other distinct independent aspects of the present disclosure, electric current may be transmitted to the switch 60, detonator 50, next successive gun 16, other components or a combination thereof in any suitable manner. For example, the inner body conductor 42 may transmit electric current to the switch 60 that actuates the detonator 50 of that gun 16 (e.g., gun 16*a*) and to the next successive gun 16 (e.g., gun 16*b*) or other component in the gun system 10 in any suitable manner and with any desired components.

In this embodiment, one or more intermediate conductors 118 (a.k.a. the second intermediate conductor 118*b*) may be disposed between the inner body conductor 42 and switch 60 to allow electric flow therebetween. This intermediate conductor 118 may have any suitable form, configuration, components, construction and operation. For example, the second intermediate conductor 118*b* may be a conductive spring 110 (a.k.a. the second contact spring 110*b*) electrically coupled, at or proximate to its uphole end, to the inner body conductor 42 and to one or more conductive contacts 130 of the switch 60 (a.k.a. the first conductive contact 130*b* of the switch 60) at or proximate to its downhole end (e.g., at conductive interface 26*f*).

Still referring to FIGS. 19A-B, the exemplary second contact spring 110*b* may be electrically coupled between the inner body conductor 42 and switch 60 in any suitable manner. In the present embodiment, the second contact spring 110*b* is a helical, or coil, spring but may take any other form (e.g., radial wave spring, biased sleeve). The illustrated spring 110 is axially-oriented in the gun 16 (e.g., inside the central bore 93 of the end fitting 96) and radially inwards of the inner body conductor 42. At its downhole end, the exemplary spring 110*b* is biased into electrical contact with the first conductive contact 130*b* of the switch 60. At its uphole end, the illustrated spring 110*b* is biased against and electrically contacts an intermediate electrical connector 124 (a.k.a. the second intermediate electrical connector 124*b*), which electrically contacts the inner body conductor 42. Thus, the conductor 118*b* (e.g., spring 110*b*) pushes or is pushed in both axial directions to assist in forming a reliable electrical connection between the inner body conductor 42 and switch 60. However, in other embodiments, the second contact spring 110*b* (or other form of second intermediate conductor 118*b*) could directly contact the inner body conductor 42 to allow the flow of electric current therebetween. Accordingly, the second intermediate conductor 118*b* could have any other form, configuration, location and operation.

Referring still to FIGS. 19A-B, when included, the second intermediate electrical connector 124*b* may have any suitable form, configuration, location and operation. In this example, the second intermediate electrical connector 124*b* extends between the spring 110*b* and the inner body conductor 42 at respective fourth and fifth conductive interfaces 26*d*, 26*e*. The illustrated second intermediate electrical connector 124*b* is a shepherds-hook type connector (e.g., similar to the first intermediate electrical connector 124*a* as described above) and carried in the downhole end fitting 96. Similarly, this exemplary connector 124*b* includes a base, or ring, 126 (e.g., FIG. 18) configured to extend around the switch 60 in the central bore 93 of the end fitting 96 (or other component) and electrically contact the second contact spring 110*b*. At least one spring-biasable arm 128 is shown extending generally radially outwardly from the illustrated base 126 (e.g., through a slot (not shown) in the end fitting 96) and configured to electrically contact the inner body conductor 42. If desired, the connector 124*b* may abut a ledge 154 formed in the end fitting 96 and/or the illustrated arm 128 may be spring-biased radially outwardly to ensure effective electrical contact between the inner body conductor 42 and second intermediate conductor 118*b*. For example, when the exemplary charge holder assembly 90*c* is pushed into the carrier 30, the illustrated arm 128 may engage the inner body conductor 42 under friction to deflect it radially inwardly against its outward spring tension and thus assist in providing a robust and reliable electrical connection therebetween However, the second intermediate electrical connector 124*b* may have any other form (e.g., a piston and helical spring), configuration and location. And in other embodiments, the above-mentioned electrical components 24 may not be at least partially housed in or associated with the downhole end fitting 96, but instead carried by or associated with any other component(s) of the gun system 10.

Referring still to FIGS. 19A-B, if desired, one or more additional electrical components 24 may be included at any desired location(s) in the electric flow path between the inner body conductor 42 and switch 60. For example, one or more wire-free, conductive spring retainers, or rings, 136 may be disposed between the intermediate conductor 118*b* and the intermediate electrical connector 124*b* and/or the first conductive contact 130*b* of the switch 60. Also, all or any combination of the second intermediate conductor 118*b*, second intermediate electrical connector 124*b*, first conductive contact 130*b* of the switch 60 and other electrical components 24 in this electrical flow path may be non-wired and form wire-free conductive interfaces 26 therebetween. In the embodiments herein, they are all wire-free. However, any other form, combination, configuration and location of components (or a single conductive component) may provide to electrically couple the inner body conductor 42 and associated switch 60.

Referring now to FIG. 19A-21, in other distinct independent aspects of the present disclosure, electric current may be provided to the detonator 50 in any suitable manner. For example, an electric circuit may be provided to the detonator 50 via the switch 60. In the illustrated embodiments, the switch 60 includes one or more conductive contacts 130 (a.k.a. the second conductive contact 130*c* of the switch 60) configured to be electrically coupled with one or more conductive contacts 130 of the detonator 50 (a.k.a. the first conductive contact 130*a* of the detonator 50) at one or more conductive interfaces 26*g* to provide electric current to the detonator 50 (e.g., controlled via switch functionality of the PCB 64). The exemplary switch 60 includes another conductive contact 130 (a.k.a. the third conductive contact 130*e* of the switch 60) configured to be electrically coupled with one or more conductive contacts 130 of the detonator 50 (a.k.a. the second conductive contact 130*d* of the detonator 50) at one or more conductive interfaces 26*h* to complete the circuit and, if desired, ground (e.g., as described below) the switch 60 and detonator 50. Depending upon the embodiment, some, all or none of the conductive contacts 130*a-f* and/or the conductive interfaces 26*f*, 26*g* may be wired or wire-free. In the present embodiments, they are all wire-free.

When included, the first and second conductive contact 130*a*, 130*d* of the detonator 50 may have any suitable form, configuration, construction and location. In FIGS. 19A-B, for example, each conductive contact 130*a*, 130*d* of the detonator 50 includes one or more metallic patch, ring, or band extending at least partially around the detonator 50. For another example, in FIGS. 20-21, the first conductive contact 130*a* of the detonator 50 includes one or more metallic pad, cap or tab at, or proximate to, the downhole end of the detonator 50, while the second conductive contact 130*d* includes one or more metallic patch, ring, or band extending at least partially around the detonator 50. For a further example, either or both contacts 130*a*, 130*d* may include a bow spring seated in and extending radially out of a receptacle (e.g., like used in vehicle cigarette lighters or cell phone charger).

Referring again to FIGS. 19A-21, the corresponding respective pairs of conductive contacts 130*c*, 130*e* of the exemplary switch 60 and conductive contacts 130*a*, 130*d* of the detonator 50 may be electrically connected in any suitable manner. For example, the respective conductive contacts 130*c* & 130*a* may directly contact or engage one another and the conductive contacts 130*e* & 130*d* may directly contact or engage one another when the gun 16 is assembled. In the present embodiments, the respective pairs of contacts 130 abut and electrically contact one another when the switch 60 and detonator 50 are mated together. The illustrated detonator 50 is shaped like a plug and the exemplary switch 60 is shaped like a jack (e.g., similar to an audio plug-jack connection) to form the electrical circuit when the switch 60 is pushed onto the detonator 50 or vice versa. However, any other suitable form (e.g., ball/socket) of electrical connection between the switch 60 and detonator 50 may be used. In some embodiments, one or more intermediate electrical components 24 may be provided between either or both respective pairs of contacts 130 of the switch 60 and detonator 50. In yet other embodiments, electric current may be provided to the detonator 50 from another component, such as the inner body conductor 42.

Figure 20:
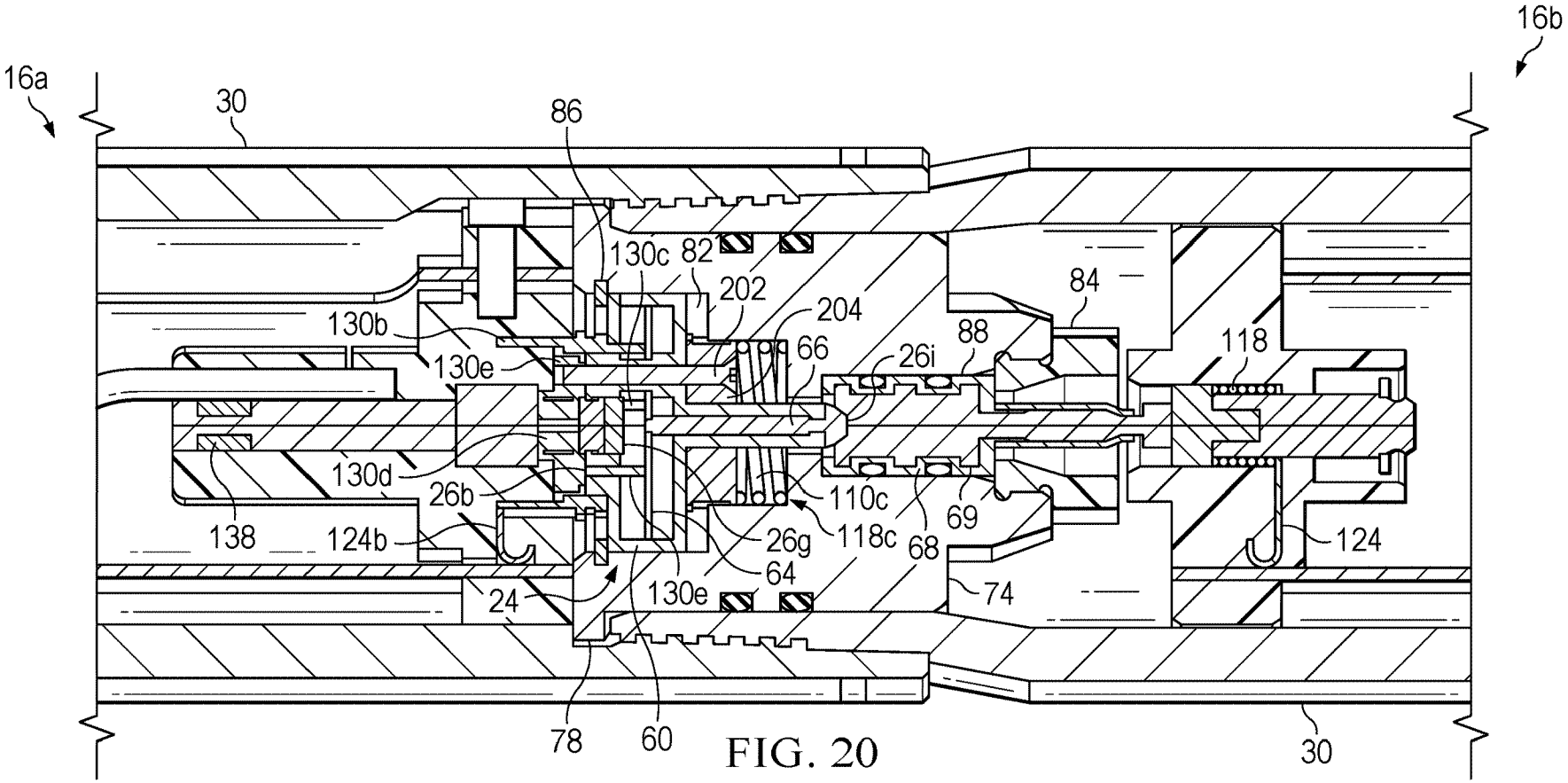
FIG. 20 illustrates the connection between two perforating guns, in accordance with embodiments of the present disclosure.
Figure 21:
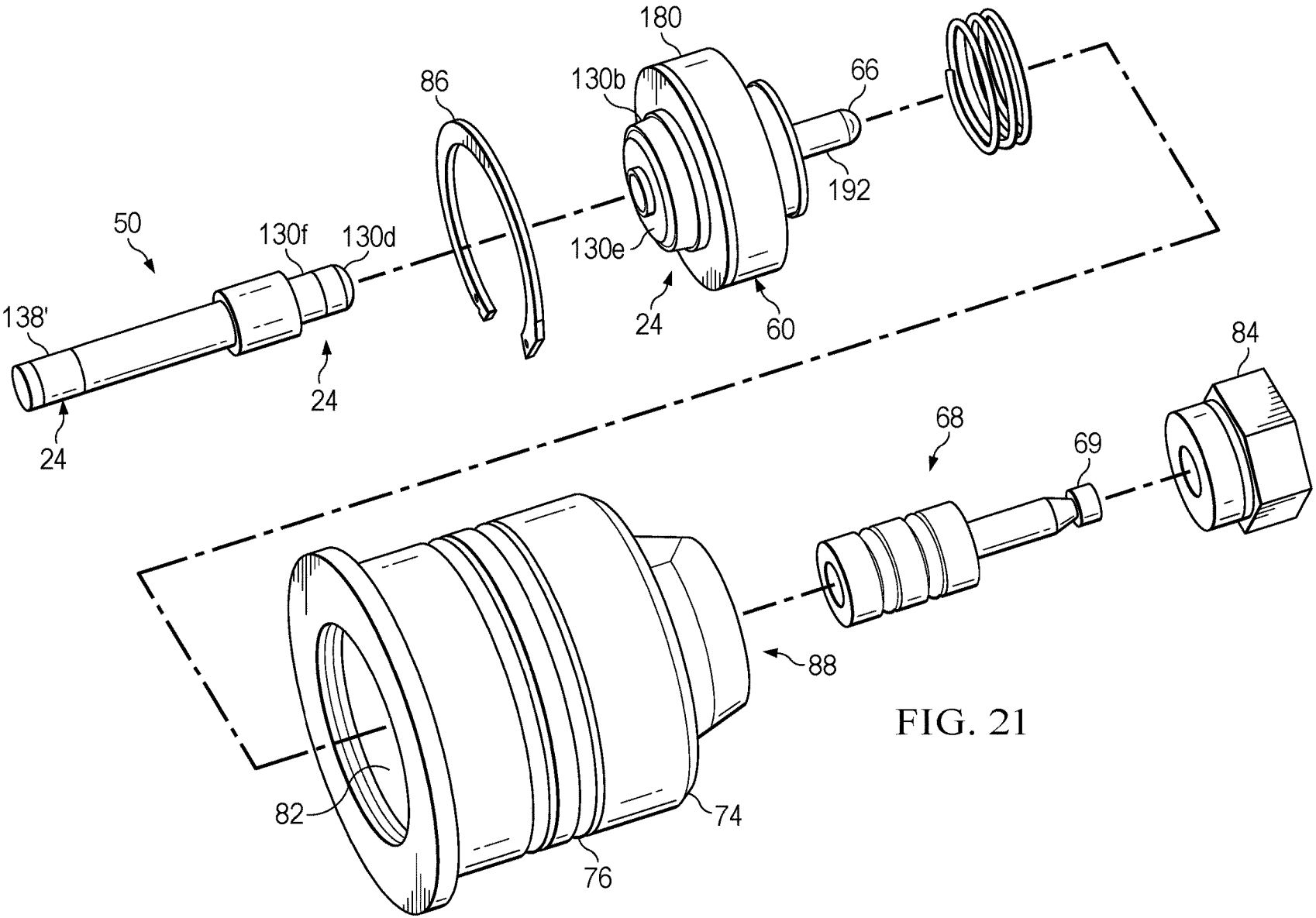
FIG. 21 is an exploded view of the downhole end of a perforating gun, in accordance with embodiments of the present disclosure.
Figure 22:
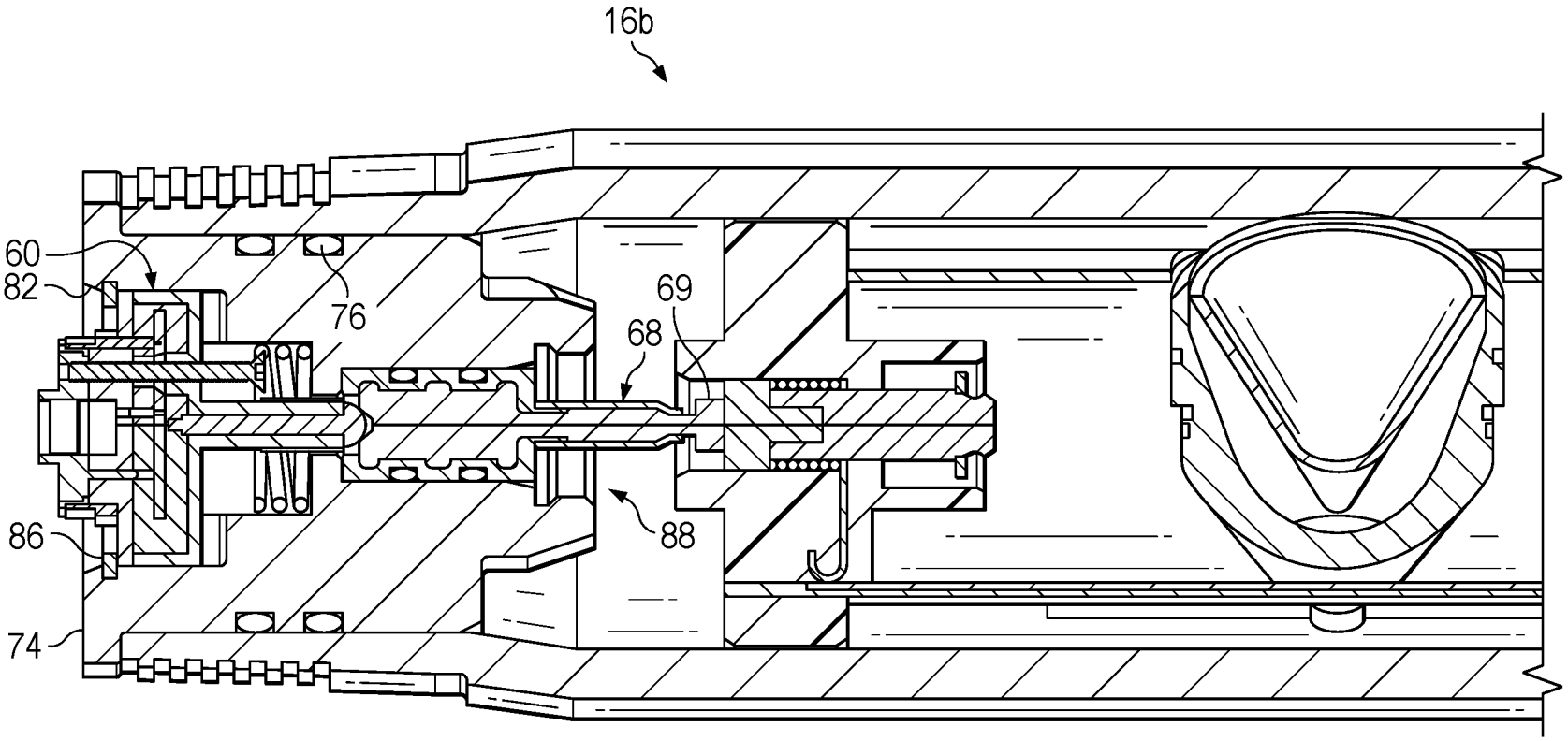
FIG. 22 illustrates the uphole end of a perforating gun, in accordance with embodiments of the present disclosure.

Referring to FIGS. 20 & 21, electric current may be transmitted to the next successive gun 16 (e.g., gun 16*b*) and/or other downhole components in any suitable manner. For example, electric current may be provided from the switch 60 to the feedthrough 69 and controlled via switch functionality of the PCB 64. In this embodiment, the switch 60 includes one or more switch conductors 66 configured to transmit electric current to the feedthrough conductor(s) 69 at one or more conductive interfaces 26*h*. The illustrated switch conductor 66 has an at least partially ball-shaped downhole end, while the feedthrough conductor 69 has an at least partially corresponding socket shaped uphole end to form a wire-free, ball-socket type conductive interface 26*i*.

In the embodiment of FIGS. 19A-B, the switch 60 instead includes at least one conductive contact 130 (e.g., the fourth conductive contact 130*f* of the switch 60) at or proximate to its downhole end for electrically contacting the feedthrough conductor 69. For example, one or more conductive traces 36 could be provided in the switch 60 to electrically couple the PCB 64 with the contact 130*f*. However, any other suitable form (e.g., plug-jack connection) of electrical connection between the switch 60 and feedthrough 68 may be used. In some embodiments, one or more intermediate electrical components 24 may be provided in the electrical path between the switch 60 and feedthrough 68. In yet other embodiments, electric current may be provided from another component, such as the inner body conductor 42, to the feedthrough 68 (or other component) to provide electricity in the downhole direction. Depending upon the embodiment, any desired combination of the switch conductor 66 or conductive contact 130*f*, feedthrough conductor 69, conductive interface 26*i* and the electric flow path between the gun 16*a* and feedthrough 68 may be wire-free. In the present embodiments, they are all wire-free.

Figure 23:
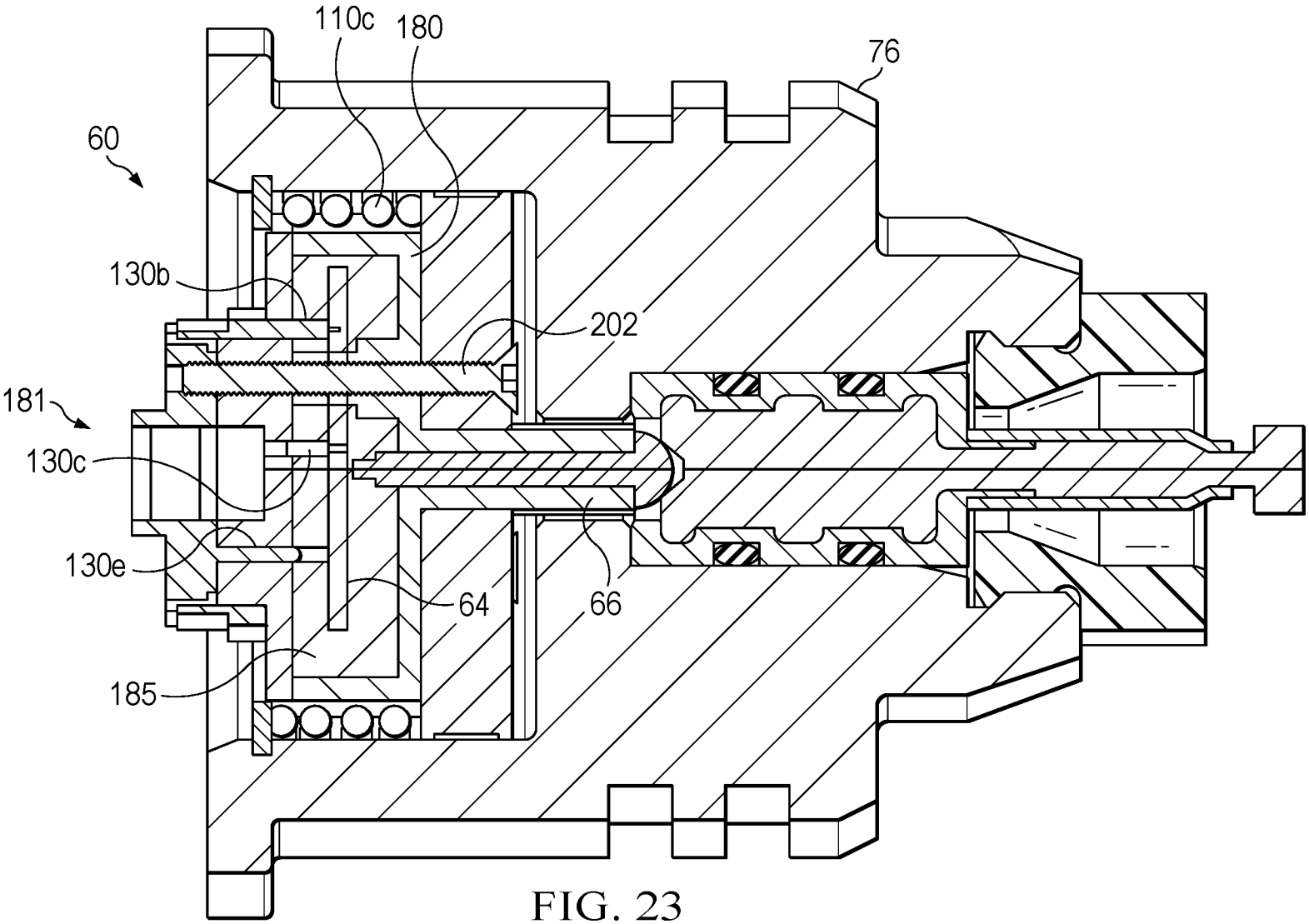
FIG. 23 illustrates the switch, in accordance with embodiments of the present disclosure.
Figure 24:
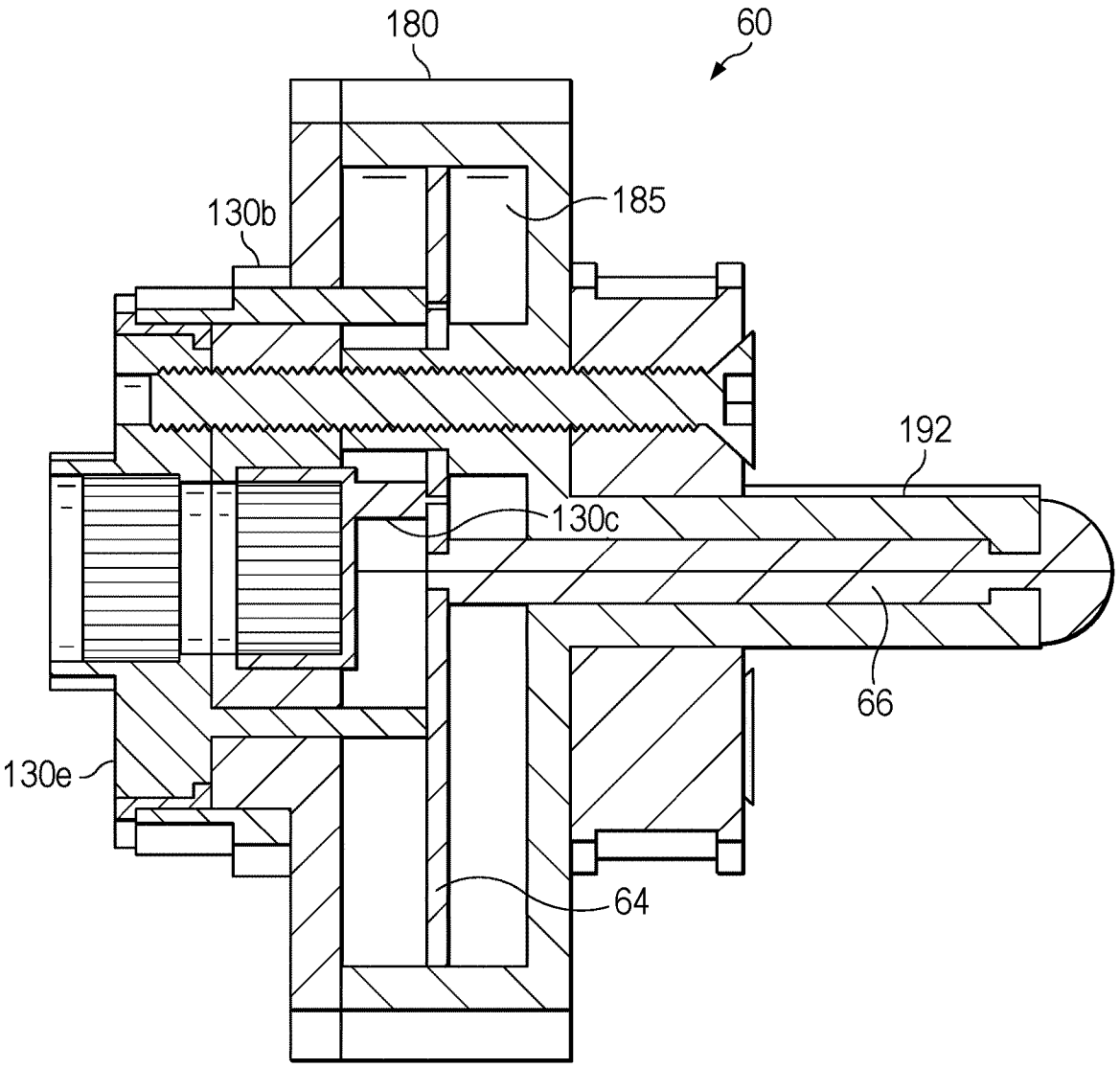
FIG. 24 illustrates the switch, in accordance with embodiments of the present disclosure.
Figure 26:
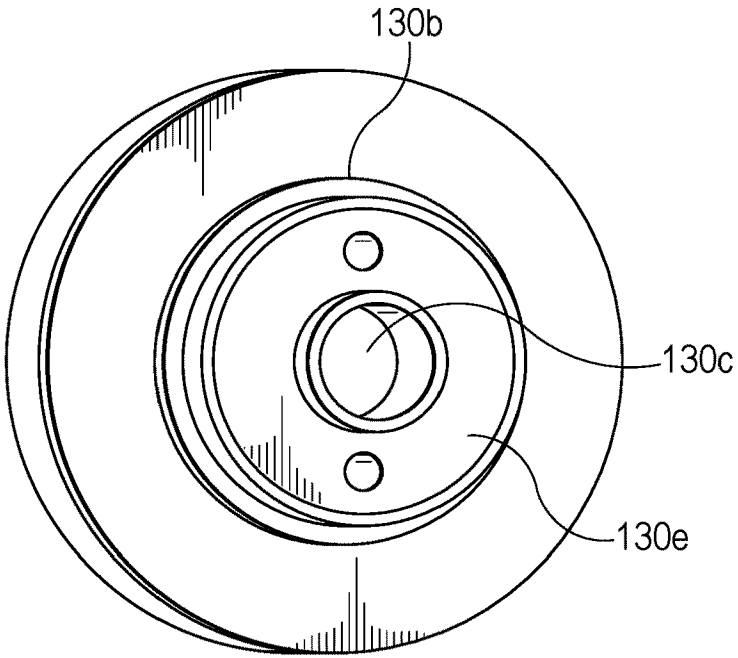
FIG. 26 illustrates conductive contacts, in accordance with embodiments of the present disclosure.
Figure 25:
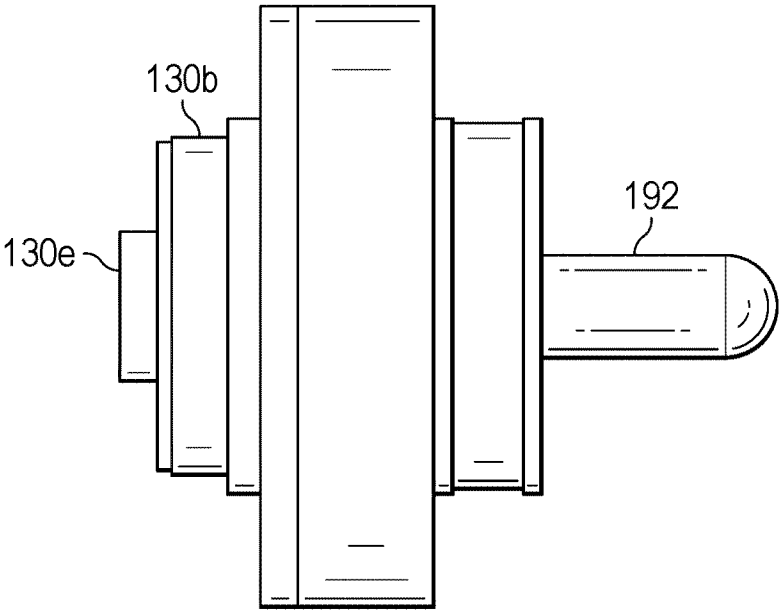
FIG. 25 illustrates conductive contacts, in accordance with embodiments of the present disclosure.

Referring now to FIGS. 23 & 24, in other distinct independent aspects of the present disclosure, the switch 60 may have any suitable form, configuration, components, construction and operation. In the illustrated embodiments, the switch 60 has a generally circular cross-sectional shape and, along with the PCB(s) 64 therein, faces uphole and downhole to optimize the use of space inside the cylindrical carrier 30, allow the switch 60 to extend out radially so it can be wider and thinner (e.g., shorter in the axial direction) which can free up axial space in the gun 10 for more explosives 46 or reduce the length of the gun 16 (e.g., allowing a larger quantity of guns 16 in the gun system 10 per run, reducing time, cost, manpower etc.), allow easy and/or wire free engagement, and relative rotatability, of the switch and detonator 50, for any other purpose(s) or a combination thereof. However, in other embodiments, the switch 60 may have any other cross-sectional shape (hexagonal, square, rectangular, etc.), orientation or configuration. The exemplary switch 60 includes a generally circular central bore 181 extending partially therein from its uphole end and configured to mate with or fit over part of the detonator 50 (FIG. 21) when the gun system 10 is assembled.

In this embodiment, the switch 60 includes a housing 180 that contains and insulates the PCB(s) 64 and conductive contacts 130*b*, 130*c*, and 130*e* and switch conductor 66. For example, the housing 180 may be constructed at least partially of non-conductive material (e.g., plastic) and can include one or more insulators 185 (e.g., filler material, such as epoxy, non-conductive rings or plates, etc.) to insulate and/or absorb shock around the PCB 64, for any other purpose(s) or a combination thereof. If needed, the exemplary housing 180 can include a non-conductive sleeve 192 extending outwardly therefrom in the downhole direction to at least partially surround and insulate the switch conductor 66.

When included, the conductive contacts 130*b*, 130*c*, 130*e* may have any suitable form, configuration, construction, components, location and operation. Referring to FIGS. 25-28, the illustrated contacts 130*b*, 130*c*, 130*e* each include at least one conductive pin 182 and associated conductor ring 183. Each exemplary respective pin 182 extends from the PCB 64 in the uphole direction then engage the corresponding conductor ring 183. For another example, in other embodiments, any of the contacts 130*b*, 130*c*, 130*e* may be biased outwardly to help ensure reliable and effective electrical connection with the components they contact. In some embodiments, the contact 130 itself may be a spring, such as a bow spring (e.g., like used in vehicle cigarette lighters or cell phone charger) or biased outwardly by one or more other components.

Figure 29:
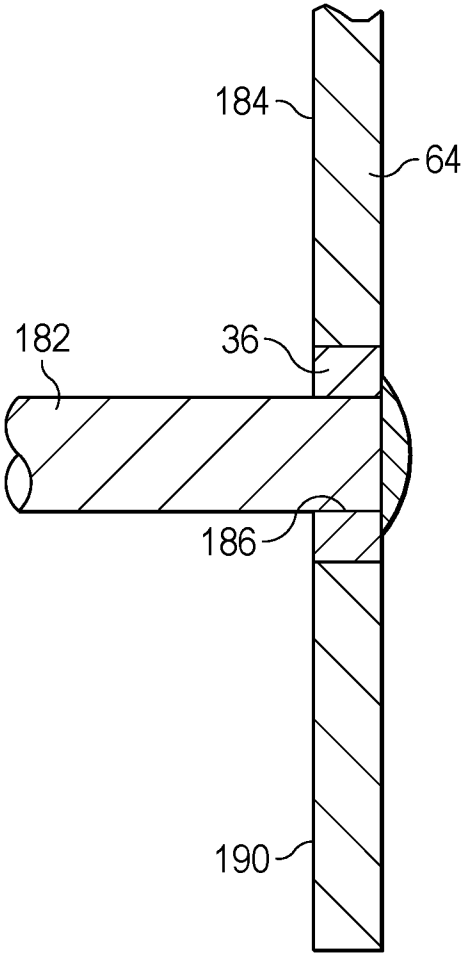
FIG. 29 illustrates conductive contacts, in accordance with embodiments of the present disclosure.
Figure 28:
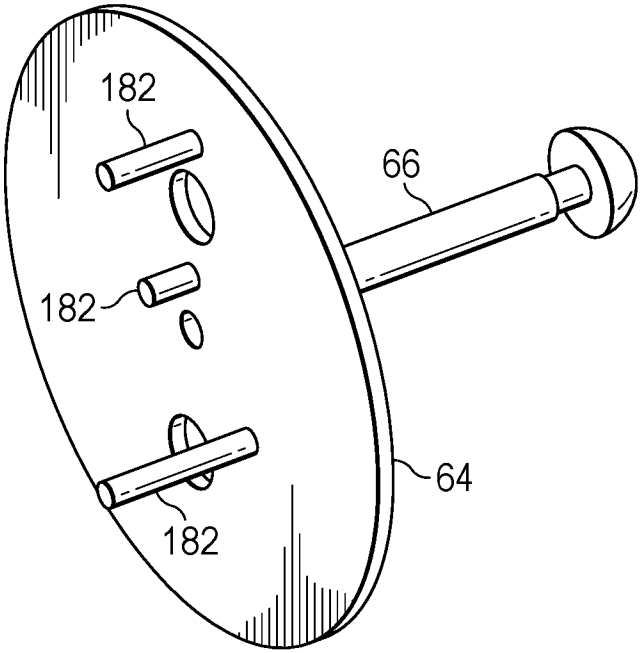
FIG. 28 illustrates conductive contacts, in accordance with embodiments of the present disclosure.

If desired, as shown in FIG. 29, each conductive pin 182 may extend outwards of the front face 184 of the PCB 64 from a corresponding hole 186 formed therein, contact one or more conductive traces 36 in the PCB 64 (e.g., that extends at least partially around the hole 186) and be soldered to the rear face 190 of the PCB 64 (e.g., similarly as in construction of semiconductor chips). Also if desired, the exemplary switch conductor 66 may engage the PCB 64 in the same manner but in the opposite direction. The exemplary switches 60 and PCB 64 are entirely wire-free, but in other embodiments the switch 60 and/or PCB 64 may include wires and have any other configuration of components.

In the embodiment of FIG. 19A-B, the conductive contacts 130*b*, 130*c* & 130*e* of the switch 60 are metallic rings, patches or bands electrically coupled with the PCB 64 with non-wired conductive traces 36. If desired, the conductive contact 130*b* may, for example, extend around a ledge 200 of the switch 60 and conductive contacts 130*c* & 130*e* may extend at least partially around the ID of the central bore 181 of the switch 60 to help provide strong electrical connections, for any other purpose(s) or a combination thereof. The illustrated conductive contact 130*f* of the switch 60 is a conductive pad, cap or patch also electrically coupled with the PCB 64 with non-wired conductive traces 36 and may be provided at the distal end of the housing 180 (e.g., at or near the tip of the sleeve 192). Thus, in this embodiment, all the conductive contacts 130 of the switch 60 are electrically coupled to the PCB 64 via one or more insulated, non-wired conductive traces 36 formed or provided in the switch 60. However, the conductive contacts 130*b*, 130*c*, 130*e* & 130*f* may have any other form, configuration and location and may be electrically coupled to the PCB 64 with wires or in any other manner. For example, any of the contacts 130*b*, 130*c*, 130*e*, 130*f* may be biased outwardly to help ensure reliable and effective electrical connection with the components they contact. In some embodiments, the contact 130 itself may be a spring, such as a bow spring (e.g., like used in vehicle cigarette lighters or cell phone charger) or biased outwardly by one or more other components.

If desired, the switch 60 and detonator 50 may be configured to be rotatable relative to each other to allow them to be provided and tested separately from other, allow the guns 16 to be threadably interconnected for any other purpose(s) or a combination thereof. For example, the absence of any wired connections between the switch 60 and detonator 50, cylindrical shape of the detonator 50, shape, configuration and location of the conductive contacts 130*a*, 130*d* of the detonator 50 and conductive contacts 130*c*, 130*e* of the switch 60 or any combination thereof may help allow relative rotatability between these components. In FIG. 2, the exemplary conductive contacts 130*c*, 130*e* of the switch 60 include metallic rings, patches or bands that will electrically contact the ring-shaped conductive contacts 130*a*, 130*d* of the detonator 50 after rotation and engagement of the components. In FIG. 20, the exemplary conductive contacts 130*c*, 130*e* include conductor rings 183 that will electrically contact the ring-shaped conductive contacts 130*a*, 130*d* of the detonator 50 after rotation and engagement of the components. In another example, the contacts 130*c*, 130*e* of the switch 60 may each only include one or more pins 182 that will electrically contact the ring-shaped conductive contacts 130*a*, 130*d* of the detonator 50 after rotation and engagement of the components. However, any other form and configuration of parts may be used to allow relative rotatability of the detonator 50 and switch 60.

In the illustrated embodiments, the switch 60 is rotatable relative to the downhole end fitting 96, such as to allow electrical coupling of the conductive contact 130*f* of the switch 60 and the second intermediate conductor 118*b*. However, this may not be necessary in other configurations.

Referring to FIGS. 19A-B, in accordance with various distinct independent aspects of the present disclosure, the switch 60 (e.g., PCB 64) and/or detonator 50 may be grounded in any suitable manner. For example, the detonator 50 and switch 60 may be grounded together to one or more carriers 30 in the gun system 10. In the present embodiment, the grounding path of the detonator 50 and switch 60 goes through the adjacent retainer 84, bulkhead 74 and carrier 30. However, in other configurations, the detonator 50 and/or switch 60 may be directly grounded to the bulkhead 74 (e.g., FIG. 20), carrier(s) 30 or other conductive component.

Still referring to FIGS. 19A-B, in the illustrated embodiment, the third conductive contact 130*e* of the switch 60 is electrically coupled to the retainer 84 to provide the grounding path. For example, an intermediate conductor 118 (the third intermediate conductor 118*c*) may be electrically coupled between the third conductive contact 130*e* and the retainer 84 to complete the grounding circuit.

This intermediate conductor 118 may have any suitable form, configuration, components, construction and operation. For example, the third intermediate conductor 118*c* may be a conductive spring 110 (a.k.a. the third contact spring 110*c*) that is biased and electrically coupled at or proximate to one end thereof to the conductive contact 130*e* and at its other end to the retainer 84 (e.g., through one or more conductive spring retainers, or rings, 136). The illustrated contact spring 110*c* is a helical, or coil, spring but may take any other form (e.g., radial wave spring, biased sleeve).

However, the third intermediate conductor 118*c* could have any other form and operation and any other combination, configuration and location of suitable components (or a single conductive component) may comprise the grounding path for the detonator 50 and/or switch 60. In addition, any or all of the components and features forming the grounding path of the detonator 50 and/or switch 60 may be non-wired and form wire-free conductive interfaces 26 therebetween. In the present embodiment, the entire grounding path of the detonator 50 and switch 60 has non-wired components and is wire free.

Still referring to FIGS. 19A-B, the illustrated contact spring 110*c* may provide one or more additional capabilities. For example, the spring 110*c* may bias the switch 60, and thus its fourth conductive contact 130*f*, in the downhole direction so the contact 130*f* can make good electrical contact with the feedthrough conductor 69. The higher the spring rate or biasing forces of the exemplary third contact spring 110*c* (e.g., on the switch 60 and its fourth conductive contact 130*f*) in the downhole direction, the more robust and reliable the flow of electric current to the feedthrough 68. For example, the pressure applied to the conductive interface 26*j* between the conductive contact 130*d* and feedthrough conductor 69 could deform imperfections of the contact 130*d* and feedthrough conductor 69 to enhance electrical signal transmission.

Figure 27:
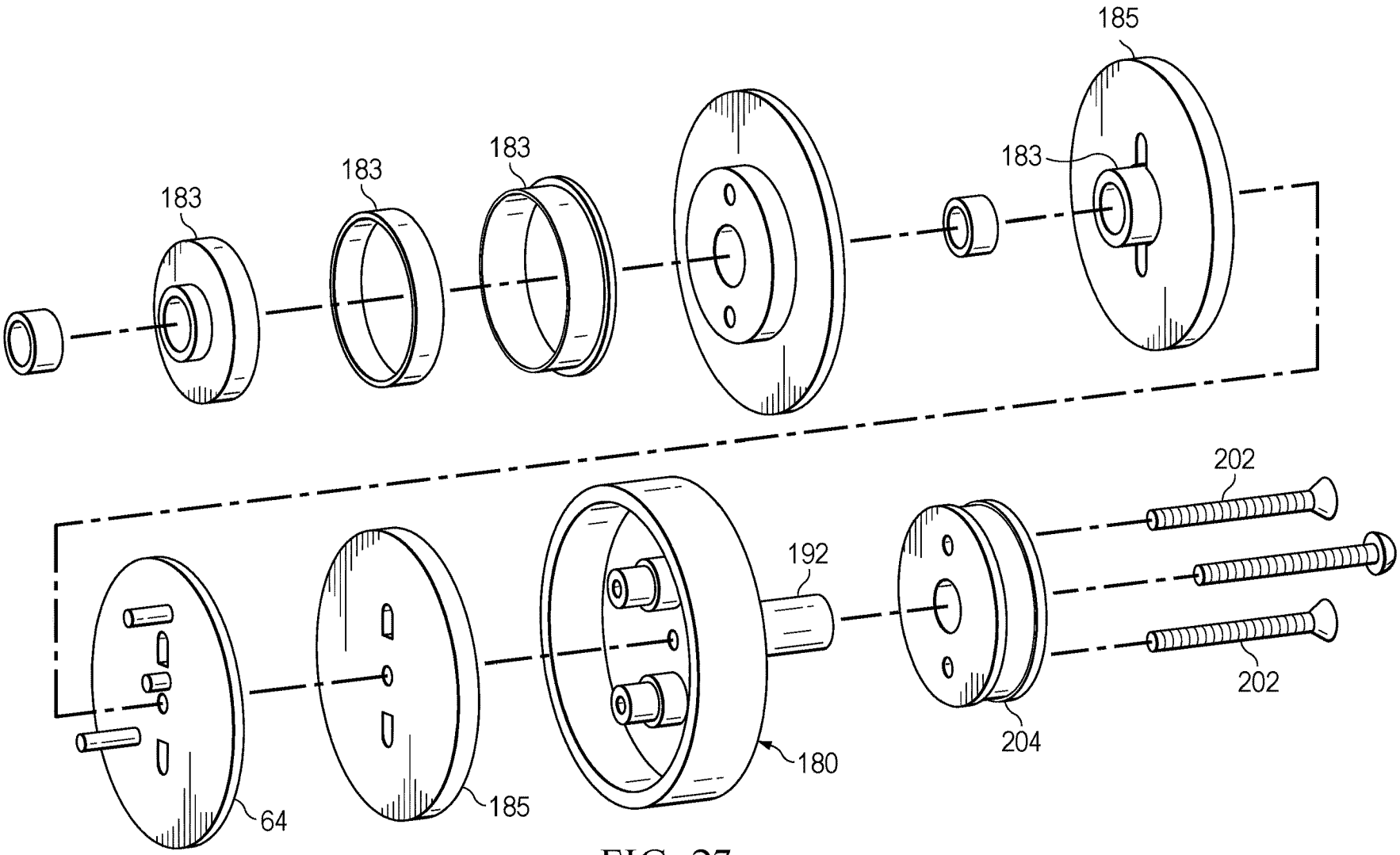
FIG. 27 illustrates conductive contacts, in accordance with embodiments of the present disclosure.

In the embodiment of FIGS. 20 & 27, the grounding path for the detonator 50 and switch 60 includes one or more bolts, or other mechanical connectors, 202 extending at least partially through the switch 60. The exemplary bolt(s) 202, which can be used to hold all (or some) of the components of the switch 60 together, is constructed at least partially of conductive material and electrically couples the third conductive contact 130*e* of the switch 60 and the third intermediate conductor 118*c* (e.g., the third contact spring 110*c*). If desired, the bolt 202 may engage a conductive grounding ring, or cap, 204 at the downhole end of the switch 60 to assist in providing good electrical connection between the contact 130*e* and conductor 118*c*, for any other purpose(s) or a combination thereof. In this embodiment, the third intermediate conductor 118*c* is biased between the bulkhead 74 and the grounding ring 204 (and possibly also the downhole end (head) of one or more bolts 202). The entire grounding path of the detonator 50 and switch 60 of this configuration includes all non-wired components and is wire free. However, any other configuration of components, with or without wires may be used to ground the switch 60 and/or detonator 50.

Referring specifically to FIG. 20, the illustrated contact spring 110*c* may provide one or more additional capabilities. In this example, the contact spring 110*c* biases the switch 60 in the uphole direction to help provide strong electrical connections for the conductive contacts 130 (e.g., contacts 130*b*, 130*c*, 130*e*) of the switch 60 at the uphole end of the switch 60, for any other purpose(s) or a combination thereof. The higher the spring rate or biasing forces of the exemplary third contact spring 110*c* in the uphole direction, the more robust and reliable the flow of electric current at the various conductive interfaces 26 formed by the switch contacts 130.

Referring back to FIG. 2, in accordance with various distinct independent aspects of the present disclosure, if desired, one or more redundant grounding paths (that differ from the primary grounding path, such as described above) may be provided in the gun system 10 to ensure grounding of the electrical circuit therein, such as if the primary ground fails (e.g., debris causes a break or blockage in the primary grounding path), for any other reason(s) or a combination thereof. Any suitable form, configuration, construction and location of components may be used to provide one or more redundant grounding paths. For example, the detonator 50 may be separately grounded to the carrier(s) 30 at a different location than the primary grounding path (e.g., as described above). In this embodiment, at least one redundant ground connector 188 may extend between and electrically couple the detonator 50 and the carrier 30. For example, the redundant ground connector 188 may electrically contact the second conductive contact 130*d* of the detonator 50, effectively grounding both the detonator 50 and switch 60.

Referring still to FIG. 2, when included, the redundant ground connector 188 may have any suitable form, configuration, location and operation. In this embodiment, the redundant ground connector 188 is a shepherds-hook type connector and carried in the downhole end fitting 96. This exemplary connector 188 includes a base, or ring, 126 (e.g., FIG. 18) configured to extend around the detonator 50 in the central bore 93 of the end fitting 96 (or other component) and electrically contact the second conductive contact 130*d* of the detonator 50. If desired, the base 126 may abut a ledge 148 of the detonator 50 and/or ledge 149 of the end fitting 96 to help ensure good electrical contact at that conductive interface 26*k* formed therebetween.

At least one spring-biasable arm 128 is shown extending generally radially outwardly from the illustrated base 126 (e.g., through a slot (129*b*, FIG. 7) in the end fitting 96) of the redundant ground conductor 188 and configured to electrically contact the carrier 30. If desired, the conductor 188 may abut a ledge 166 formed in the ID of the carrier 30 and/or the illustrated arm 128 may be spring-biased radially outwardly to help obtain strong electrical contact between the conductor 188 and carrier 30. For example, when the exemplary charge holder assembly 90*c* is pushed into the carrier 30, the illustrated arm 128 may engage the ledge 166 under friction to deflect it radially inwardly against its outward spring tension and thus assist in providing a robust and reliable electrical connection. However, the redundant ground conductor 188 may have any other form (e.g., a piston and helical spring), configuration and location.

In this example, the entire redundant grounding path of the detonator 50 and switch 60 is wire free. However, in other embodiments, wires may be included and any one or more additional or different electrical components 24 may be used at any desired location(s) to provide one or more redundant ground flow paths between any desired components.

Figure 31:
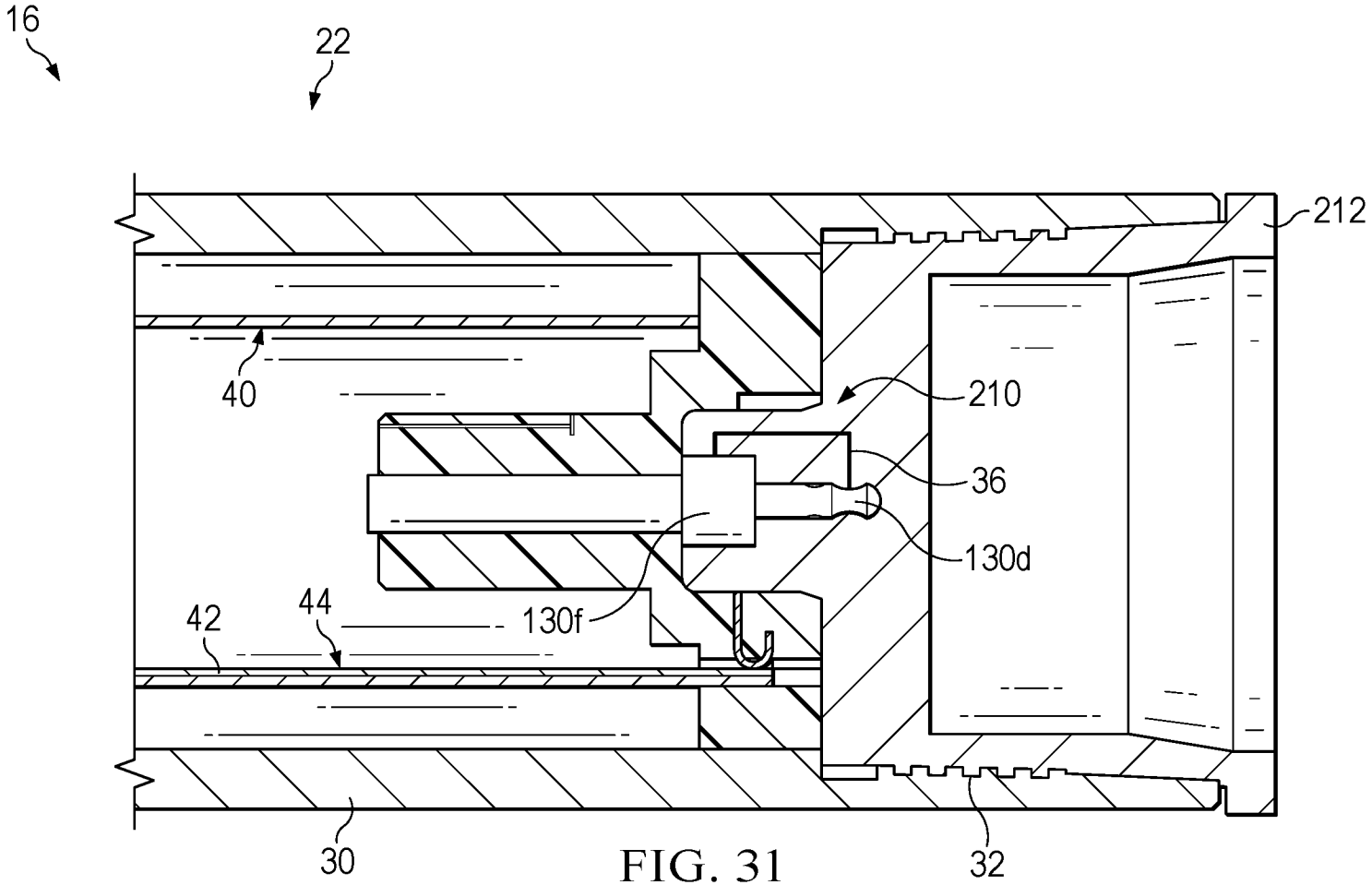
FIG. 31 illustrates a cross-sectional view of a shipping plug, in accordance with embodiments of the present disclosure.

Referring back to FIG. 1, in some embodiments, an option to store, handle and/or ship the gun 16 with the charge holder assembly 90*c* and detonator 50 loaded therein may be provided. For example, an insulated shorting conductor 210 may be securely electrically coupled to both conductive contacts 130*a*, 130*d* of the detonator 50 to electrically connect them together. The insulated shorting conductor 210 may have any suitable form, configuration and operation. In this example, the shorting conductor 210 is a conductive trace 36 provided in a shipping plug 212 (FIG. 31) constructed at least partially of electrically non-conductive material to insulate the shorting conductor 210. In this embodiment, the shipping plug 212 is plastic and releasably, firmly (e.g., threadably) coupled with the carrier 30 at the downhole end 22 of the gun 16. The exemplary shipping plug 212 may also help protect the downhole end of the carrier 30 and/or the threads 32 thereof, one or more components in the carrier 30 during storage, handling and/or shipping of the gun 16 or a combination thereof. However, any other suitable arrangement and configuration of components may be used to electrically short the detonator 50 when loaded in the gun 16 and/or protect one or more components of the gun prior to use thereof.

Figure 30:
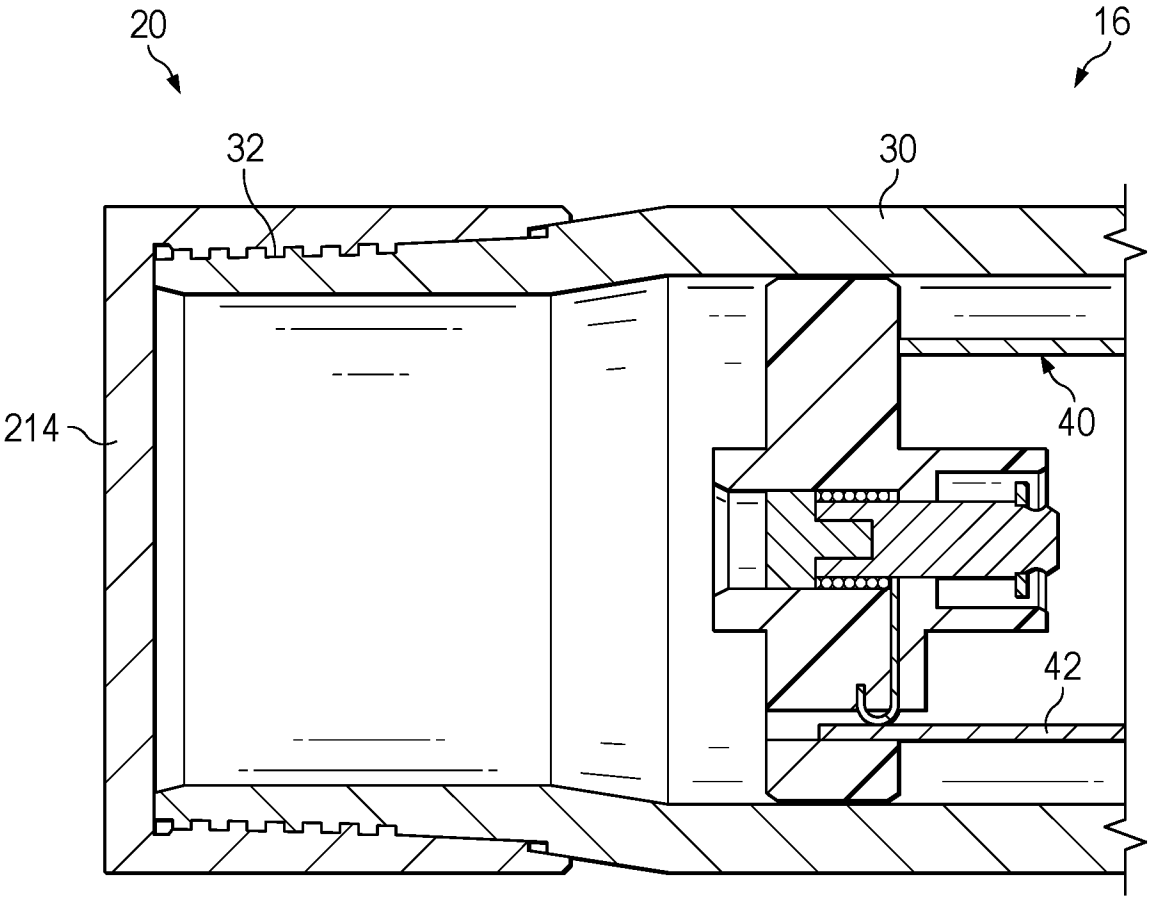
FIG. 30 illustrates a cross-sectional view of the uphole end of the perforating gun, in accordance with embodiments of the present disclosure.

Referring back to FIG. 1, if desired, the upper end 20 of the gun 16 may be secured during storage, handling and/or shipment of the gun 16 with or without the charge holder assembly 90*c* and detonator 50 loaded therein. Referring to FIG. 30, in this embodiment, a shipping cap 214 (e.g., FIG. 30) is releasably, firmly (e.g., threadably) coupled with the carrier 30 at the uphole end 20 of the gun 16. The illustrated shipping cap 214 is plastic, but may be constructed of any other suitable material. The exemplary shipping cap 214 may also help protect the uphole end of the carrier 30 and/or the threads 32 thereof, one or more components in the carrier 30 during storage, handling and/or shipping of the gun 16 or a combination thereof. However, any other suitable arrangement and configuration of components may be used to protect one or more components of the gun prior to use thereof.

In some embodiments, when the gun system 10 is shipped with two (or more) pre-assembled guns 16, such as shown in FIGS. 1 & 9, the guns 16 can be quickly and simply interconnected for use at the work site without any tools simply by removing the respective shipping plugs 212 and caps 214 therefrom and threadably engaging the upper end 20 of the carrier 30 of one gun 16*b* (e.g., FIG. 2) to the lower end 22 of the carrier 30 of the other gun 16*a*.

When any of the exemplary gun systems 10 are shipped without the detonator 50 in the gun 16, such as shown in FIG. 19A, the detonator 50 simply needs to be pushed into the downhole end fitting 96 of the first gun 16*a* and the second gun 16*b* threadably engaged with the first gun 16*a* (e.g., FIG. 19B). The first gun 16*a* is quickly and easily armed and ready for use without any tools.

Figure 32:
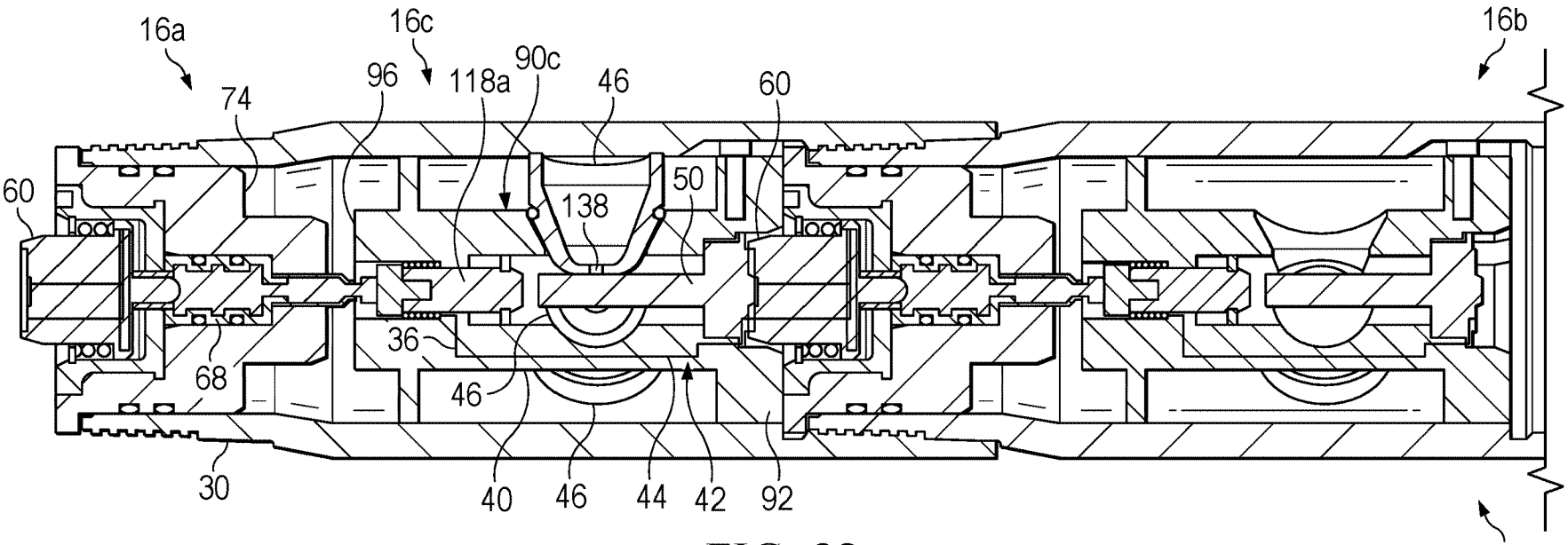
FIG. 32 is a cross-sectional side view of the connection of two perforating guns, in accordance with embodiments of the present disclosure.

Now referring to FIG. 32, in other distinct independent aspects of the present disclosure, the gun 16 (a.k.a. gun 16*c*) may be configured to operate without det-cord. In this embodiment, the gun 16*c* may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 28.

In this embodiment, all of the explosives 46 in the gun 16*c* are directly coupled to and ignited by the detonator 50, allowing significant shortening of the length of the gun 16. For example, three (3 each) explosives 46 are shown positioned around and electrically coupled to the detonator 50 in the same radial plane. In other embodiments, fewer or more explosives 46 may be included in one or more planes (e.g., depending upon the size of the explosives 46). To help simplify and shorten the exemplary gun 16, the charge holder 40 and upper and lower end fitting 92, 96 may be formed of a single unitary charge holder assembly 90*c* (e.g., constructed of plastic or other suitable material). The illustrated inner body conductor 42 (e.g., through-connector 44) may include one or more wire-free conductive traces 36 electrically coupled to the first intermediate conductor 118*a* at its uphole end (e.g., without the need for a first intermediate connector 124*a*), and the switch 60 and/or detonator 50 at its downhole end (e.g., without the need for a second intermediate conductor 118*b* or second intermediate connector 124*b*). Thus, if desired, the entire gun 16*c* may be wire free. However, any other configuration of components may be used to provide a det-cord free gun 16 with or without the use of wires.

Figure 33:
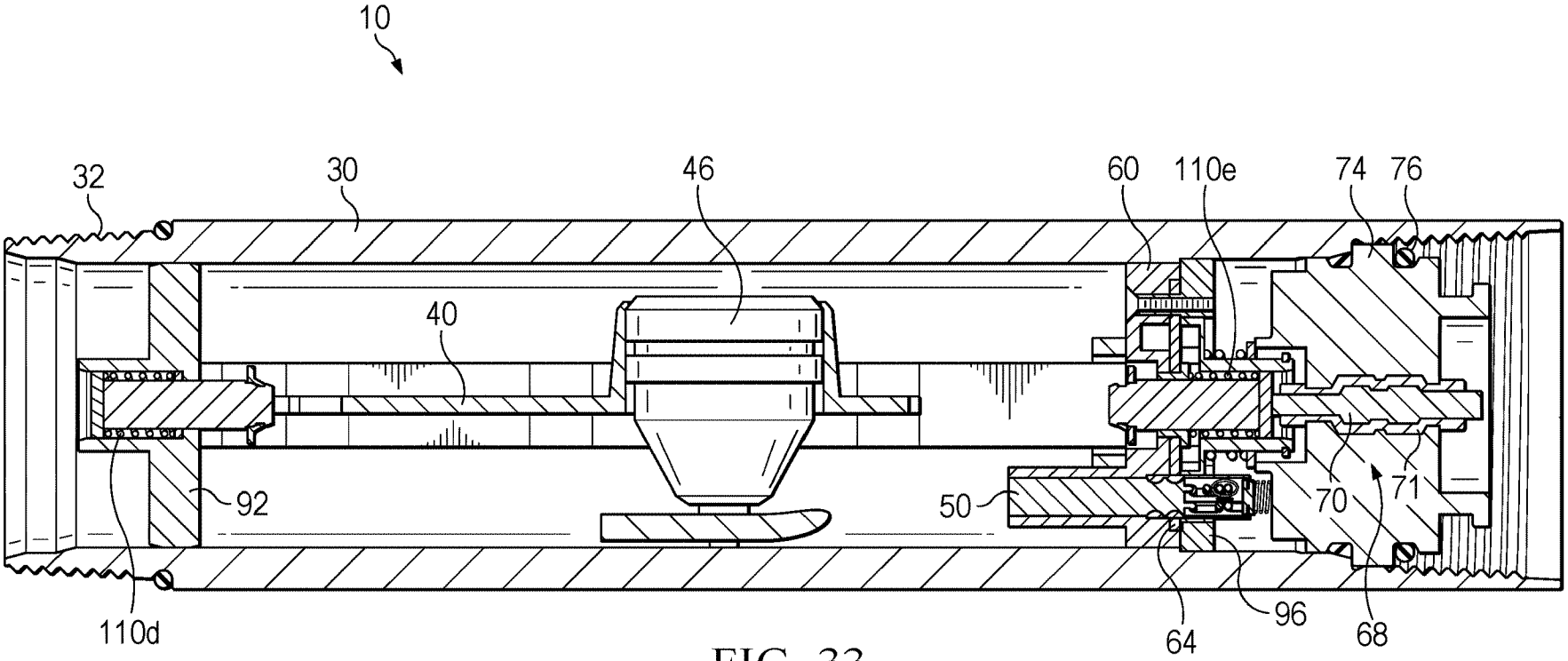
FIG. 33 a cross-sectional side view of a perforating gun in accordance with embodiments of the present disclosure.

Now referring to FIG. 33, in other distinct independent aspects of the present disclosure, a wireless switch 60 and detonator 50 may be located in the same gun 16. In this embodiment, the gun 16 may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 33.

As shown in FIG. 33, a switch 60 is positioned on the uphole side of bulkhead 74. In the illustrated embodiment, the switch 60 is coupled to a downhole end fitting 96, which is disposed between bulkhead 74 and switch 60. Consistent with the above discussion concerning other embodiments, it would be understood by one of skill in the art that alternatively the switch 60 could be positioned between the downhole end fitting 96 and the bulkhead 74.

As shown in the illustrated embodiment the downhole end fitting 96 and switch 60 are configured to receive detonator 50. In the illustrated embodiment, the wireless detonator axially extends within the carrier 30, parallel to the central axis 31, but is offset from the central axis 31. The isolated detonator 50 is described in further detail in FIG. 36 discussed below. It would be understood by one of skill in the art that this configuration of the switch 60 and detonator 50 is advantageous because, in addition to providing a wireless connection, it allows for a shorter gun.

Referring to FIG. 33, the threads 32 of the carrier 30 may be tapered at the downhole end and the uphole end. The tapered threads 32 allow the uphole gun 16*a* to form a sealed metal-to-metal contact with downhole gun 16*b*.

Still referring to FIG. 33, the charge holder 40 is coupled to the bulkhead 74. In the illustrated embodiment, the bulkhead 74 includes feedthrough 68 as described with reference to FIG. 35 below.

Figure 34:
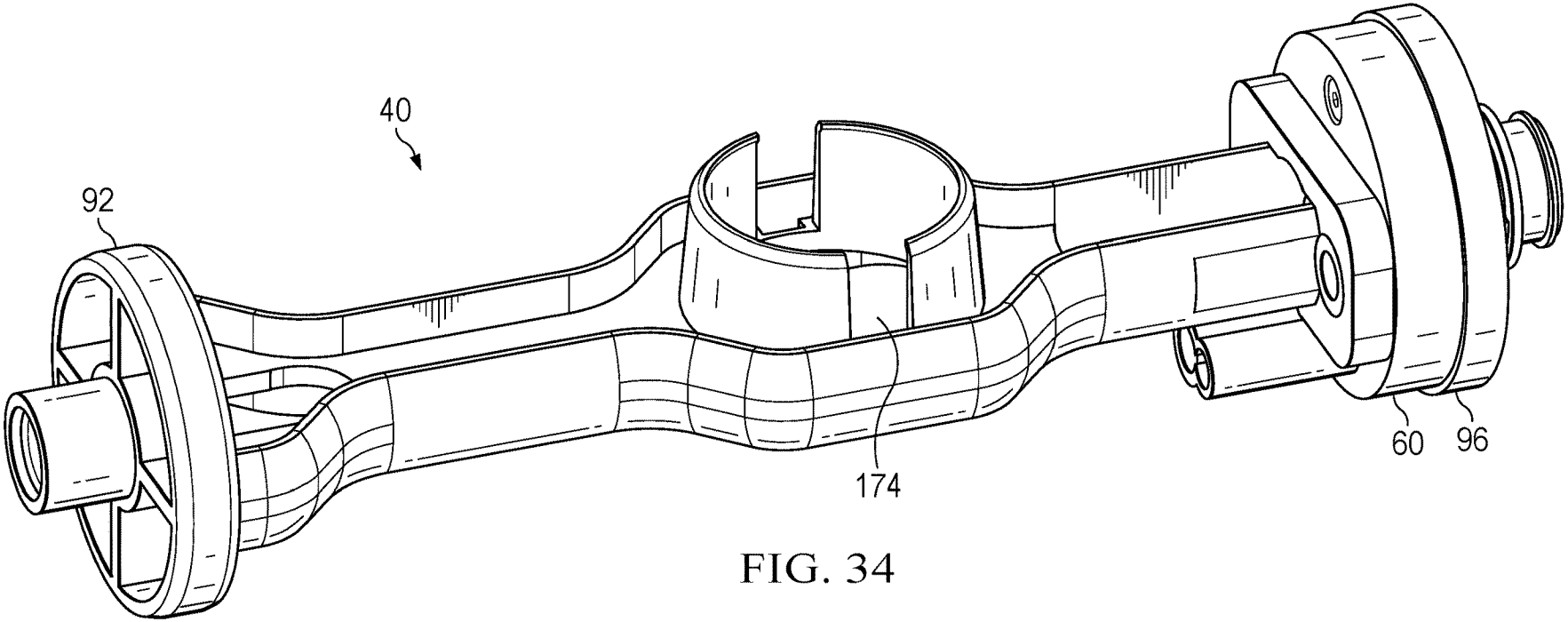
FIG. 34 illustrates the charge holder of a perforating gun, in accordance with embodiments of the present disclosure.

As illustrated in FIG. 34, the charge holder 40 comprises a charge hole 174 to house a shaped charge. The charge holder 40 also connects to an uphole end fitting 92 and a downhole end fitting 96. As discussed above, the downhole end fitting 96 is coupled to the switch 60 at the downhole end of the charge holder. The switch 60 and downhole end fitting 96 are configured to receive the detonator 50.

Figure 35:
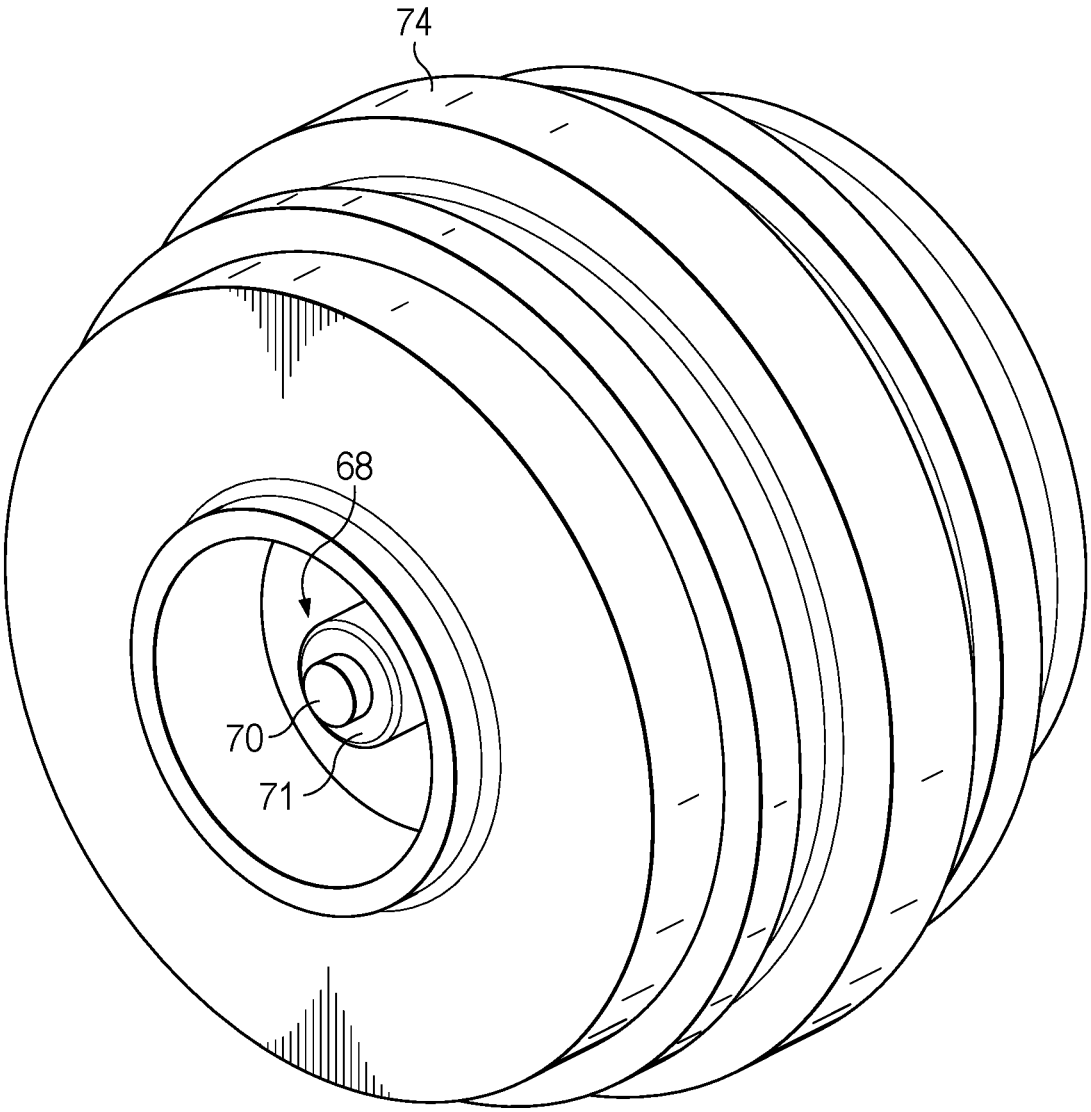
FIG. 35 illustrates the bulkhead, in accordance with embodiments of the present disclosure.

A bulkhead 74 is disposed between adjacent gun carriers. As illustrated in FIG. 35, a feedthrough 68 is disposed within the bulkhead 74. The feedthrough 68 does not contact the bulkhead 74, but is encompassed by insulator 71. In this embodiment, insulator 71 is formed around the conductor pin 70 of feedthrough 68 after the feedthrough 68 has been disposed within the bulkhead 74. In this way, the insulator 71 seals the feedthrough 68 within the central bore of the bulkhead without the need for o-rings or other additional sealing elements. In some embodiments, the insulator material is PEEK. It would be understood by one of skill in the art that alternative materials could be used.

Figure 40:
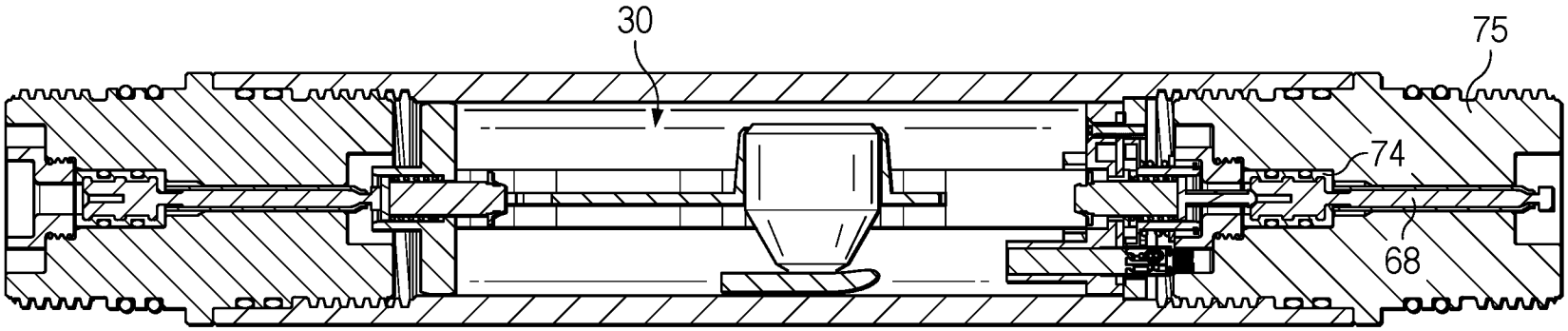
FIG. 40 illustrates an alternate embodiment of a perforating gun system, in which the bulkhead and feedthrough are located in a tandem sub adjacent to the gun carrier.

In addition to being disposed within gun carrier 30, as shown in FIG. 33, bulkhead 74 and feedthrough 68 could also disposed in, or configured to be part of, an adjacent component. For example, as shown in FIG. 40, bulkhead 74 and feedthrough 68 could be disposed in a tandem sub 75, which may be attached via a threaded connection to the downhole end of gun carrier 30. Although FIG. 40 depicts a more traditional bulkhead and feedthrough configuration, one of skill in the art would understand that a separate component such as a tandem sub may also include a feedthrough 68 with an insulator 71 formed around the conductor pin 70, as discussed in the preceding paragraph.

Figure 36:
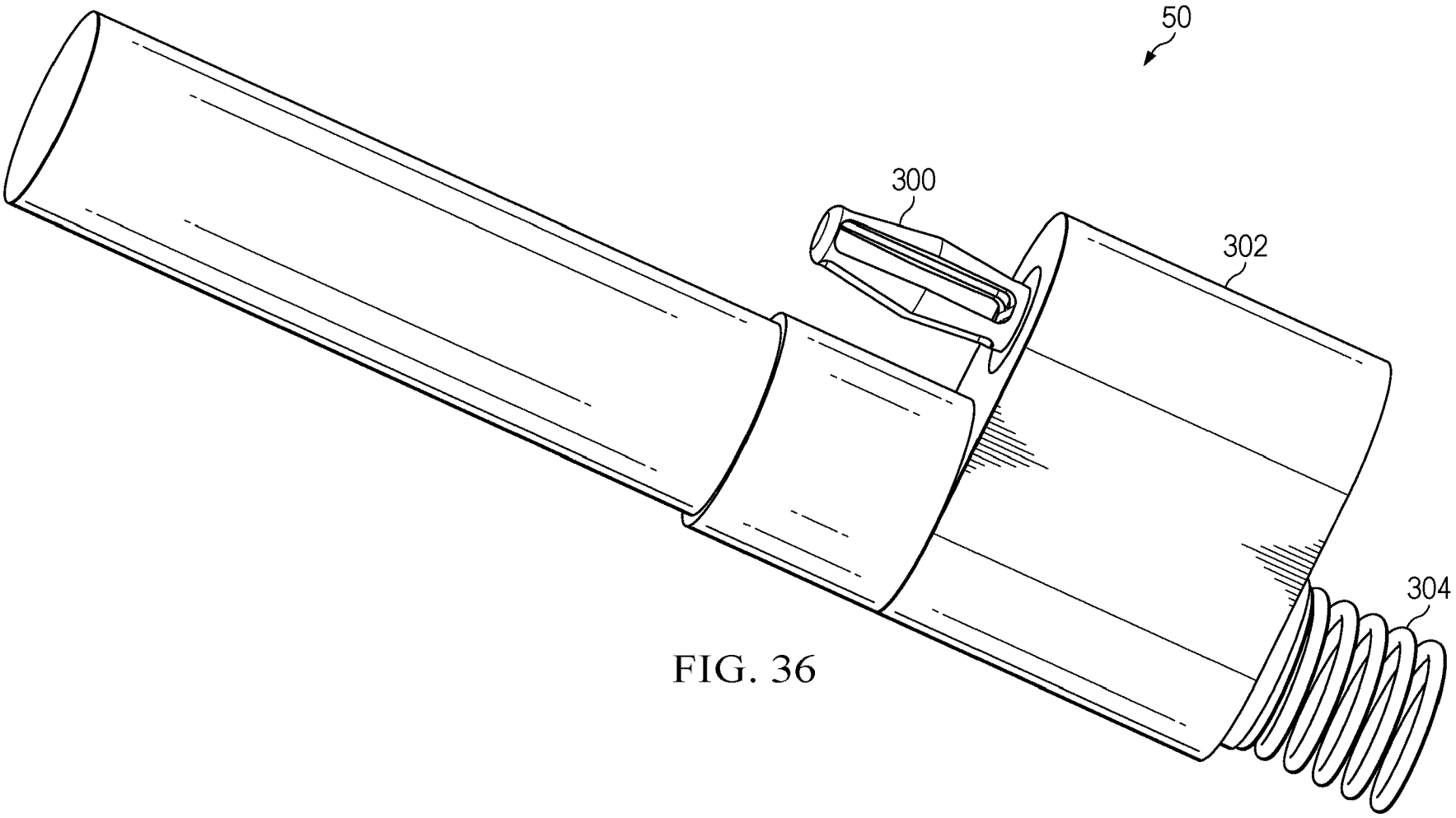
FIG. 36 illustrates the detonator, in accordance with embodiments of the present disclosure.

As illustrated in FIG. 36, the wireless detonator 50 is housed within a detonator cap 302. The detonator cap 302 includes a banana plug 300 and a spring contact 304. The banana plug 300 and spring contact 304 provide the conductive contacts that enable the detonator 50 to maintain electrical contact with the switch 60 and electrical components of the perforating gun system.

Figure 37:
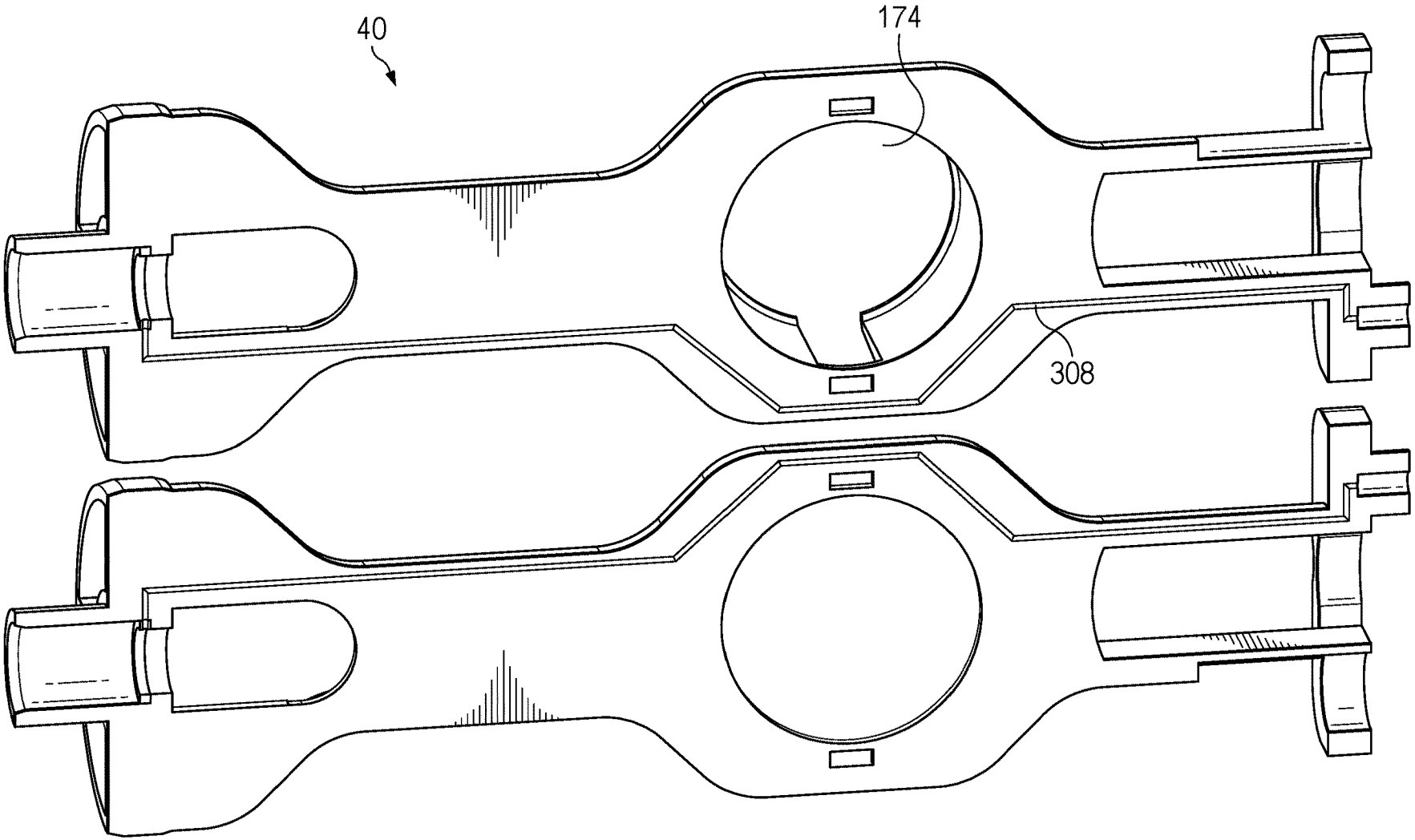
FIG. 37 illustrates a split view of the charge holder, in accordance with embodiments of the present disclosure.

As illustrated in FIG. 37, the charge holder 40 can be molded with a split mold design. In this design, the split charge holder 40 includes a channel 308 that allows a signal to travel from one end of the carrier to another end of the carrier. In certain embodiments, the channel 308 houses a wire. In other embodiments, the charge holder 40 is wireless and the channel 308 is configured to carry the signal without a wire. For example, through-connector 44 may be disposed within channel 308 to provide a wire-free electrical connection along at least part of the length of gun 16. The charge holder 40 also includes a charge hole 174 to house a shaped charge.

Figure 38:
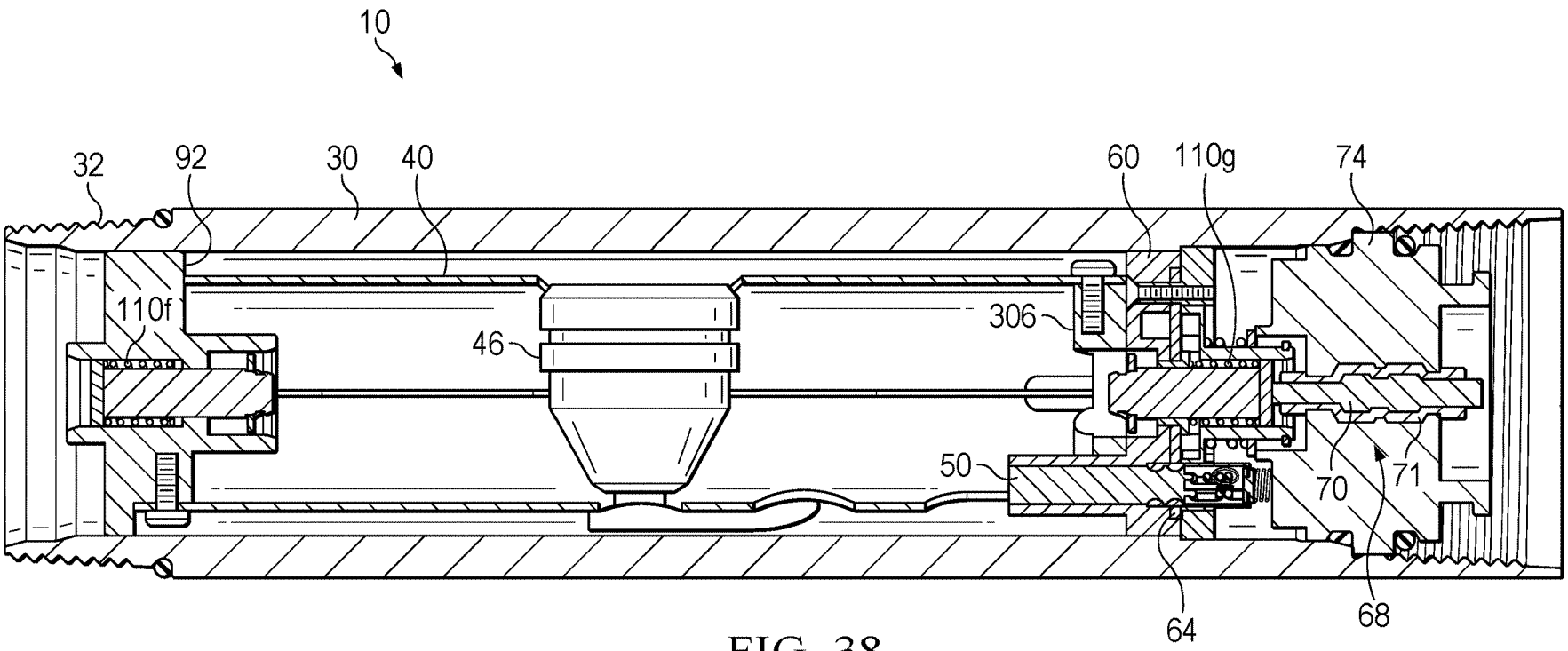
FIG. 38 is a cross-sectional side view of a perforating gun with the charge tube adapter, in accordance with embodiments of the present disclosure.

Now referring to FIG. 38, in other distinct independent aspects of the present disclosure, the gun 16 may be configured to operate with a charge tube adapter. In this embodiment, the gun 16 may include all of the features of the embodiments described above and shown in the corresponding figures, except as described differently below or as may be evident from the appended figures or otherwise to persons skilled in the field of downhole perforating guns. With that caveat, all of the detail description above and referenced figures are incorporated herein for the embodiment shown in FIG. 38.

Figure 39A:
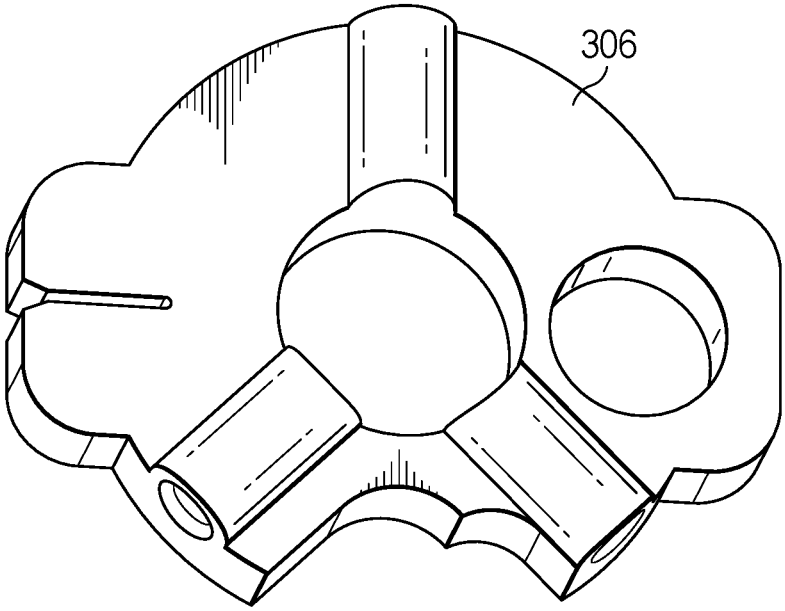
FIG. 39A illustrates the charge tube adapter, in accordance with embodiments of the present disclosure.
Figure 39B:
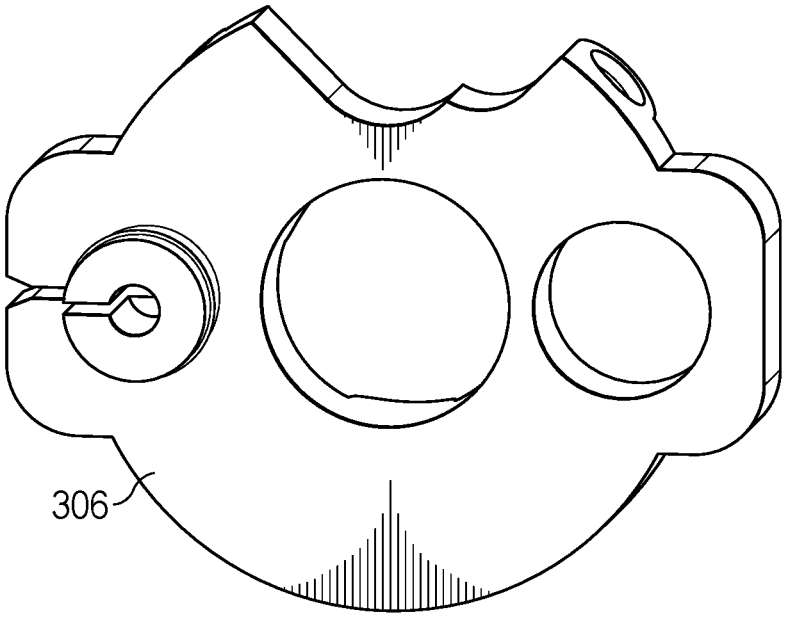
FIG. 39B illustrates the charge tube adapter, in accordance with embodiments of the present disclosure.

In this embodiment, the charge holder 40 couples to a charge tube adapter 306. The charge tube adapter 306 is compatible with traditional charge tube so that a traditional charge tube 40 can be used with the components of the perforating gun system described herein. The charge tube adapter 306 is coupled to switch 60. As shown in FIGS. 39A and 39B, the charge tube adapter 306 is also configured to receive the isolated detonator shown in FIG. 36 above.

In accordance with various distinct independent aspects of the present disclosure, various methods of manufacture, assembly and used of the exemplary guns 16 and gun system are apparent from the detailed description above and appended drawings.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. A perforating gun for use in line with gun components on a gun string, the perforating gun comprising:

a gun carrier being configured to couple at end connections to the gun components on the gun string, the gun carrier having first and second ends and defining an interior therethrough, the first end having an internal tapered thread defined in the interior, the internal tapered thread being configured to thread to a first of the gun components at a first of the end connections, the second end having an external tapered thread defined externally on the gun carrier, the external tapered thread being configured to thread to a second of the gun components at a second of the end connections; and a charge holder disposed within the interior of the gun carrier and being configured to hold one or more charges; and a bulkhead disposed in the interior toward the second end of the gun carrier and sealing the interior of the gun carrier from the second gun component connected at the second end connection, the bulkhead comprises a flange captured between a distal face of the second end of the gun carrier and an internal shoulder of the second gun component, the bulkhead having a feedthrough conductor, the feedthrough conductor being configured to electrically conduct across the second end connection between the interior of the gun carrier and the second gun component.

2. The perforating gun of claim 1, wherein the internal tapered thread and the external tapered thread at each of the first and second end connections comprise a metal-to-metal contact configured to seal the interior of the gun carrier from an external environment.

3. The perforating gun of claim 1, wherein the bulkhead comprises one or more annular seals disposed about the bulkhead and configured to seal an annular space between the bulkhead and the interior.

4. The perforating gun of claim 1, wherein the bulkhead comprises a switch disposed on the bulkhead and exposed to the second gun component connected at the second end connection to the gun carrier.

5. The perforating gun of claim 4, wherein the bulkhead defines a cavity exposed to the second gun component; and wherein the switch comprises a housing disposed in the cavity, the housing being biased by a spring in the cavity and being retained in the cavity by a retainer ring.

6. The perforating gun of claim 1, wherein the flange comprises a rim extending circumferentially about an end of the bulkhead.

7. The perforating gun of claim 1, wherein the gun carrier has a main outside diameter along a length thereof; wherein the first end of the gun carrier comprises a first outside diameter being no greater than the main outside diameter; and wherein the second end of the gun carrier comprises a second outside diameter being no greater than the main outside diameter; and wherein the end connection having the internal and external tapered threads are threaded together in a metal-to-metal contact and are configured to seal the interiors of the gun carriers from an external environment without any annular seal at the end connection.

8. The perforating gun of claim 7, wherein the first outside diameter of the first end of the gun carrier is the main outside diameter; and wherein the second outside diameter of the second end of the gun carrier is smaller than the main outside diameter.

9. A downhole perforating system, comprising:

a plurality of gun carriers each having first and second ends and each defining an interior therethrough, the first and second ends of the gun carriers being configured to couple together end-to-end at end connections; and a plurality of charge holders disposed within the interiors of the gun carriers and being configured to hold one or more charges, wherein each first end of the gun carriers comprises an internal tapered thread defined in the interior of the gun carrier, wherein each second end of the gun carriers comprises an external tapered thread defined externally on the gun carrier, and wherein the internal tapered thread of each given gun carrier is configured to thread to the external tapered thread of another of the gun carriers; and a plurality of bulkheads each being disposed in the interior toward the second end of each given one of the gun carriers, each bulkhead sealing the interiors between the gun carriers at the end connections, each bulkhead having a feedthrough conductor, the feedthrough conductors being configured to electrically conduct across the end connections between the interiors of the gun carriers, each bulkhead comprises a flange captured between a distal face of the second end of the given gun carrier and an internal shoulder of the first end of the gun carrier connected at the end connection to the given gun carrier.

10. The downhole perforating system of claim 9, wherein each of the end connections comprises a metal-to-metal contact between the internal tapered thread threaded to the external tapered thread, the metal-to-metal contact being configured to seal the interiors of the gun carriers from an external environment.

11. The downhole perforating system of claim 9, wherein each of the bulkheads comprise one or more annular seals disposed about the bulkhead and configured to seal an annular space between the bulkhead and the interior.

12. The downhole perforating system of claim 9, wherein each given one of the gun carriers connected to another one of the gun carriers comprises:

a switch disposed in the interior of the given gun carrier proximate the bulkhead of the other gun carrier and being in electrical communication with the feedthrough conductor;

a body conductor disposed in the interior of the given gun carrier and being in electrical communication with the switch; and a detonator disposed in the interior of the given gun carrier proximate the switch and being in electrical communication with the switch.

13. The downhole perforating system of claim 9, wherein each of the bulkheads for each given one of the gun carriers connected to another one of the gun carriers comprises a switch disposed on the each bulkhead and exposed in the interior of the other gun carrier connected at the end connection to the given gun carrier.

14. The downhole perforating system of claim 13, wherein the bulkhead defines a cavity exposed to the interior of the other gun carrier connected at the end connection; and wherein the switch comprises a housing disposed in the cavity, the housing being biased by a spring in the cavity and being retained in the cavity by a retainer ring.

15. The downhole perforating system of claim 9, wherein the flange comprises a rim extending circumferentially about an end of the bulkhead.

16. The downhole perforating system of claim 9, wherein each gun carrier has a main outside diameter along a length thereof; wherein the first end of each gun carrier comprises a first outside diameter being no greater than the main outside diameter; wherein the second end of each gun carrier comprises a second outside diameter being no greater than the main outside diameter; and wherein each end connection having the internal and external tapered threads are threaded together in a metal-to-metal contact and are configured to seal the interiors of the gun carriers from an external environment without any annular seal at the end connection.

17. The downhole perforating system of claim 16, wherein the first outside diameter of each first end of the gun carriers is the main outside diameter; and wherein the second outside diameter of each second end of the gun carriers is smaller than the main outside diameter.

18. A method, comprising:

providing a plurality of perforating guns, each perforating gun comprising a gun carrier having first and second ends and defining an interior therethrough;

installing a bulkhead in the interior at the second end of a first of the gun carriers of a first of the perforating guns and engaging a flange on the bulkhead against a distal face on the second end, the first gun carrier having an external tapered thread defined externally on the second end, the bulkhead having a feedthrough conductor passing therethrough;

installing a charge holder in the interior at the first end of a second of the gun carriers of a second of the perforating guns, the second gun carrier having an internal tapered thread defined in the interior at the first end;

electrically connecting between electrical components at an end connection between the first and second gun carriers by threading the internal tapered thread defined in the interior at the first end of the second gun carrier to the external tapered thread defined externally on the second end of the first gun carrier; and capturing the flange between (i) the distal face of the second end of the first gun carrier and (ii) an internal shoulder of the first end of the second gun carrier connected at the end connection.

19. The method of claim 18, wherein threading the internal tapered thread to the external tapered thread comprises sealing the interiors of the first and second gun carriers from an external environment by making metal-to-metal contact between the internal tapered thread threaded to the external tapered thread.

20. The method of claim 18, wherein installing the bulkhead in the interior at the second end comprise sealing an annular space between the bulkhead and the interior using one or more annular seals disposed about the bulkhead.

21. The method of claim 18, wherein installing the charge holder in the interior at the first end of the second gun carrier of the second of the perforating guns comprises installing:

a switch in the interior of the second gun carrier to be positioned proximate the bulkhead and to be in electrical communication with the feedthrough conductor;

a body conductor in the interior of the second gun carrier and in electrical communication with the switch; and a detonator in the interior of the second gun carrier proximate the switch and in electrical communication with the switch.

22. The method of claim 18, wherein the bulkhead comprises a switch disposed on the bulkhead and exposed in the interior of the second gun carrier of the second perforating gun connected at the end connection.

23. The method of claim 22, comprising installing a housing of the switch and a spring in a cavity defined in the bulkhead; and retaining the housing and the spring in the cavity with a retainer ring.

24. The method of claim 18, wherein the flange comprises a rim extending circumferentially about an end of the bulkhead.

25. The method of claim 18, wherein each gun carrier has a main outside diameter along a length thereof; wherein the first end of each gun carrier comprises a first outside diameter being no greater than the main outside diameter; wherein the second end of each gun carrier comprises a second outside diameter being no greater than the main outside diameter; and wherein threading the internal tapered thread to the external tapered thread comprises making metal-to-metal contact between the internal tapered thread threaded to the external tapered thread at the end connection, and sealing the interiors of the first and second gun carriers from an external environment without any annular seal at the end connection.

26. The method of claim 25, wherein the first outside diameter of each first end of the gun carriers is the main outside diameter; and wherein the second outside diameter of each second end of the gun carriers is smaller than the main outside diameter.

27. A downhole perforating system, comprising:

a plurality of gun carriers each having first and second ends, having a main outside diameter along a length thereof, and each defining an interior therethrough, the first and second ends of the gun carriers being configured to couple together end-to-end at end connections;

a plurality of charge holders disposed within the interiors of the gun carriers and being configured to hold one or more charges; and a plurality of bulkheads each being disposed in the interior toward one of the first and second ends of each given one of the gun carriers, each bulkhead sealing the interiors between the gun carriers at the end connections, each bulkhead having a feedthrough conductor, the feedthrough conductors being configured to electrically conduct across the end connections between the interiors of the gun carriers, wherein each first end of the gun carriers comprises a first outside diameter being no greater than the main outside diameter and comprises an internal tapered thread defined in the interior of the gun carrier, wherein each second end of the gun carriers comprises a second outside diameter being no greater than the main outside diameter and comprises an external tapered thread defined externally on the gun carrier, and wherein the end connections having the internal and external tapered threads threaded together in a metal-to-metal contact are configured to seal the interiors of the gun carriers from an external environment without additional annular seals at the end connections.

28. The downhole perforating system of claim 27, wherein the first outside diameter of each first end of the gun carriers is the main outside diameter; and wherein the second outside diameter of each second end of the gun carriers is smaller than the main outside diameter.

29. The downhole perforating system of claim 28, wherein each of the bulkheads is disposed in the interior toward the second end of each given one of the gun carriers; and wherein each of the bulkheads comprises:

a flange captured between a distal face of the second end of the given gun carrier and an internal shoulder of the first end of the gun carrier connected at the end connection to the given gun carrier; and at least one annular seal disposed about the bulkhead and configured to seal an annular space between the bulkhead and the interior of the given gun carrier.

* * * * *